US006672273B2

(12) United States Patent
Ito et al.

(10) Patent No.: US 6,672,273 B2
(45) Date of Patent: Jan. 6, 2004

(54) HANDHELD TYPE FOUR-CYCLE ENGINE

(75) Inventors: Keita Ito, Wako (JP); Koji Kasai, Wako (JP); Takao Nishida, Wako (JP); Yasuhiro Shimizu, Wako (JP); Takeshi Maeda, Wako (JP); Yasutake Ryu, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/315,185

(22) Filed: Dec. 10, 2002

(65) Prior Publication Data

US 2003/0079711 A1 May 1, 2003

Related U.S. Application Data

(62) Division of application No. 09/803,663, filed on Mar. 12, 2001, now Pat. No. 6,508,224.

(30) Foreign Application Priority Data

| | | |
|---|---|---|
| Mar. 14, 2000 | (JP) | 2000-076406 |
| Sep. 12, 2000 | (JP) | 2000-276457 |
| Sep. 12, 2000 | (JP) | 2000-276458 |
| Sep. 12, 2000 | (JP) | 2000-276460 |
| Sep. 13, 2000 | (JP) | 2000-278543 |
| Nov. 1, 2000 | (JP) | 2000-335075 |
| Nov. 10, 2000 | (JP) | 2000-343639 |

(51) Int. Cl.[7] ..... F01M 1/00
(52) U.S. Cl. ..... 123/196 R; 123/90.31
(58) Field of Search ..... 123/90.31, 196 R, 123/195 HC

(56) References Cited

U.S. PATENT DOCUMENTS

| | | | | |
|---|---|---|---|---|
| 5,947,068 A | | 9/1999 | Araki | |
| 5,960,764 A | | 10/1999 | Araki | |
| 5,988,135 A | | 11/1999 | Moorman et al. | |
| 6,152,098 A | | 11/2000 | Becker et al. | |
| 6,223,713 B1 | * | 5/2001 | Moorman et al. | 123/196 R |
| 6,332,440 B1 | * | 12/2001 | Nagai et al. | 123/90.31 |

FOREIGN PATENT DOCUMENTS

| | | |
|---|---|---|
| EP | 0 779 412 A2 | 6/1997 |
| EP | 752 518 A1 | 8/1997 |
| EP | 0 887 520 A1 | 12/1998 |
| EP | 0 962 630 A2 | 12/1999 |
| EP | 1 172 529 A1 | 1/2002 |
| EP | 1 172 540 A1 | 1/2002 |
| JP | 10-288019 | 10/1998 |

* cited by examiner

*Primary Examiner*—Noah P. Kamen
(74) *Attorney, Agent, or Firm*—Westerman, Hattori, Daniels & Adrian, LLP

(57) ABSTRACT

In a handheld type four-cycle engine, a valve operation mechanism includes a camshaft rotatably supported in a cylinder head so as to open and close an intake valve and an exhaust valve and a timing transmission placed on one side outside an engine main body and providing association between a crankshaft and the camshaft, and a centrifugal clutch for power output is mounted on the crankshaft on the opposite side outside the engine main body. The timing transmission and the centrifugal clutch being positioned at the two ends of the crankshaft improves the weight balance, the centre of gravity of the engine can be made as close to the central part of the crankshaft as possible, which, together with the reduced weight, can enhance the operability of the engine.

4 Claims, 36 Drawing Sheets

UPSIDE- DOWN STATE

LAID-SIDEWAYS STATE

UPSIDE- DOWN STATE

LAID-SIDEWAYS STATE

HANDHELD TYPE FOUR-CYCLE ENGINE

This application is a divisional of prior application Ser. No. 09/803,663 filed Mar. 12, 2001, now U.S. Pat. No. 6,508,224.

BACKGROUND OF THE INVENTION

Field of the Invention

The present invention relates to handheld type four-cycle engines which are mainly used as a power source for machines for portable operation such as trimmers. More particularly, it relates to improvement of a four-cycle engine that includes an engine main body, the engine main body including a crankcase having a crank chamber, a cylinder block having a cylinder bore and a cylinder head having an intake port and an exhaust port; a crankshaft supported in the crankcase and housed inside the crank chamber; a piston fitted in the cylinder bore and connected to the crankshaft; an intake valve and an exhaust valve for opening and closing the intake port and exhaust port, the intake valve and exhaust valve being mounted in the cylinder head; a valve operation mechanism operable in association with the rotation of the crankshaft so as to open and close the intake valve and exhaust valve; and a power output or takeoff mechanism provided on one end of the crankshaft, the end projecting out of the engine main body.

DESCRIPTION OF THE PRIOR ART

Such a handheld type four-cycle engine is already known as disclosed in, for example, Japanese Patent Application Laid-open No. 10-288019.

Handheld type four-cycle engines are of course useful in terms of the prevention of environmental pollution as well as assuring the operators' health since the exhaust gas is comparatively clean. However, since the structure thereof is more complicated than that of two-cycle engines, there is a drawback that it is difficult to reduce the weight thereof. Weight reduction is an important issue for improvements particularly in the operability of handheld four-cycle engines.

However, in the handheld type four-cycle engine disclosed in the above-mentioned patent publication, a valve operation mechanism for opening and closing intake and exhaust valves provided in the upper part of a cylinder head is of a type that includes pushrods and rocker arms, and a valve operation chamber for housing the pushrods, a camshaft for driving the pushrods, etc. is formed in a side wall of the engine main body; the size of the engine main body therefore inevitably increases thus making it difficult to reduce the weight of the engine.

SUMMARY OF THE INVENTION

The present invention has been carried out in view of the above-mentioned circumstances, and it is an object of the present invention to provide a lightweight handheld type four-cycle engine having good operability by making the engine main body compact.

In accordance with a first characteristic of the present invention in order to achieve the above-mentioned objective, there is proposed a handheld type four-cycle engine including an engine main body, the engine main body including a crankcase having a crank chamber, a cylinder block having a cylinder bore and a cylinder head having an intake port and an exhaust port; a crankshaft supported in the crankcase and housed inside the crank chamber; a piston fitted inside the cylinder bore and connected to the crankshaft; an intake valve and an exhaust valve for opening and closing the intake port and exhaust port, the intake valve and the exhaust valve being mounted in the cylinder head; a valve operation mechanism operable in association with the rotation of the crankshaft so as to open and close the intake valve and the exhaust valve; and a power output mechanism provided on one end of the crankshaft projecting out of the engine main body, wherein the valve operation mechanism includes a camshaft rotatably supported in the cylinder head so as to open and close the intake valve and the exhaust valve, and a dry type timing transmission placed outside the engine main body on the side opposite the power output mechanism and providing association between the crankshaft and the camshaft.

The above-mentioned power output mechanism corresponds to the centrifugal clutch described in the embodiments below.

In accordance with the above-mentioned first characteristic, since the timing transmission and the power output mechanism are mounted on either side of the cylinder head on the two ends of the crankshaft, the weight balance at the two ends of the crankshaft is improved, the centre of gravity of the engine can be made as close to the central part of the crankshaft as possible, which, together with the reduced weight, can enhance the operability of the engine. Furthermore, since the loads arising from the timing transmission and the drive shaft separately work on the two ends of the crankshaft during operation of the engine so avoiding the load on the crankshaft and its bearings from being localised, the durability thereof can be enhanced.

In accordance with a second characteristic of the present invention, in addition to the above-mentioned first characteristic, there is proposed a handheld type four-cycle engine wherein the timing transmission is made as a dry type and is separate from the crank chamber.

In accordance with the above-mentioned second characteristic, since it is unnecessary to provide the side wall of the engine main body with a special chamber for housing the timing transmission, the engine main body can be made thinner and more compact thus achieving a large reduction in the weight of the entire engine.

In accordance with a third characteristic of the present invention, in addition to the above-mentioned first or second characteristic, there is proposed a handheld type four-cycle engine wherein a flywheel is mounted on the crankshaft between the engine main body and the power output mechanism, the flywheel including cooling vanes for sending cooling air to the engine main body and having a diameter larger than that of the power output mechanism.

In accordance with the above-mentioned third characteristic, the cooling air can be supplied appropriately to the engine main body, without obstruction from the power output mechanism, by rotation of the cooling vanes while minimising any increase in the size of the engine due to the flywheel, and the cooling performance thereof can be enhanced.

In accordance with a fourth characteristic of the present invention, in addition to the above-mentioned first or second characteristic, there is proposed a handheld type four-cycle engine wherein an oil tank for storing a lubricating oil for lubricating the inside of the engine main body is placed outside the timing transmission so as to adjoin it and is supported on the engine main body.

In accordance with the above-mentioned fourth characteristic, since the oil tank covers at least one part of the timing transmission, the transmission can be protected. Moreover, since the oil tank and the flywheel are positioned opposite to each other, the centre of gravity of the engine can be made as close to the central part of the crankshaft as possible and the operability of the engine can be further enhanced.

In accordance with a fifth characteristic of the present invention, in addition to the above-mentioned first characteristic, there is proposed a handheld type four-cycle engine wherein the valve operation mechanism includes the timing transmission placed outside the engine main body and linked to one end of the crankshaft and a cam system for transmitting the rotational force of the driven side of the timing transmission to the intake and exhaust valves for opening and closing forces, a first valve mechanism chamber housing the timing transmission is provided integrally with an oil tank that is placed outside of the engine main body on the same side as the timing transmission, a second valve mechanism chamber housing at least one part of the cam system is formed in the cylinder head, and a pair of oil slingers for stirring and scattering the oil stored in the oil tank in order to generate an oil mist that is to be supplied to the second valve operation chamber and the crank chamber are fixed to the crankshaft so that the timing transmission is interposed between the pair of the slingers.

In accordance with the above-mentioned fifth characteristic, since the oil tank is placed on one side outside the engine main body, the total height of the engine can be greatly reduced. Moreover, since the first valve operation chamber housing the timing transmission is provided integrally with the oil tank, one part of the timing transmission is housed in the oil tank so making the engine more compact.

Furthermore, since the lubrication system of the valve operation mechanism is divided into two parts, that is, a part for lubricating the timing transmission inside the first valve operation chamber with the oil scattered inside the oil tank, and a part for lubricating the cam system inside the second valve operation chamber with the oil mist generated inside the oil tank, the load put on each part of the lubrication system is lessened and the entire valve operation mechanism can be lubricated thoroughly.

Moreover, the pair of the oil slingers are fixed to the crankshaft with the timing transmission is placed therebetween, the oil stored inside the oil tank can be stirred and scattered without obstruction from the timing transmission regardless of the operational position of the engine and the oil mist can be generated effectively.

Furthermore, in accordance with a sixth characteristic of the present invention, in addition to the above-mentioned fifth characteristic, there is proposed a handheld type four-cycle engine wherein a through hole through which the oil mist generated in the oil tank is supplied to the crank chamber is provided in the crankshaft, and an open end of the through hole in the oil tank is positioned between the timing transmission and an oil slinger.

In accordance with the above-mentioned sixth characteristic, the open end of the through hole of the crankshaft can be positioned in the central area of the oil tank or in the vicinity thereof without obstruction from the timing transmission or the oil singers, and it is possible to prevent the oil stored inside the oil tank from entering the through hole directly.

Furthermore, in accordance with a seventh characteristic of the present invention, in addition to the above-mentioned fifth characteristic, there is proposed a handheld type four-cycle engine wherein the oil tank for storing lubricating oil and the timing transmission of the valve operation mechanism are placed on one side of the engine main body, the timing transmission extending into the oil tank, a belt guide tube housing the timing transmission is provided integrally with the oil tank, and the open end of the belt guide tube inside the oil tank projects towards the central part of the oil tank so that the open end is above the liquid level of the stored oil regardless of whether the engine is upside down or laid on its side.

In accordance with the above-mentioned seventh characteristic, the total height of the engine can be reduced, at the same time any increase in the width of the engine can be minimised, and the engine can therefore be made more compact. Moreover, since the open end inside the oil tank of the belt guide tube housing the timing transmission is always above the liquid level of the stored oil even when the engine is upside down or laid on its side, the stored oil is prevented from flowing towards the timing transmission, oversupply of oil to the timing transmission can be prevented and at the same time the amount of oil stored in the oil tank can be maintained at a predetermined level.

Furthermore, in accordance with an eighth characteristic of the present invention, in addition to the above-mentioned fifth characteristic, there is proposed a handheld type four-cycle engine wherein the oil tank, an end of the crankshaft extending into the oil tank, and the timing transmission of the valve operation mechanism linked to the crankshaft inside the oil tank are placed outside the engine main body on the side opposite to the power output mechanism, and the timing transmission is lubricated by the oil inside the oil tank.

In accordance with the above-mentioned eighth characteristic, it is unnecessary to provide a special chamber for housing the timing transmission in the side wall itself of the engine main body, the total height of the engine can be reduced due to the sideways arrangement of the oil tank, the side wall of the engine main body can thus be made thinner and more compact, and the weight of the entire engine can be greatly reduced. Moreover, the weight balance at the two ends of the crankshaft is improved by placing the power output mechanism on one side of the engine main body and the timing transmission and the oil tank on the other side, the centre of gravity of the engine can be made as close to the central part of the crankshaft as possible, which, together with the reduced weight, can enhance the operability of the engine.

Moreover, since the loads arising from the timing transmission and the power output mechanism during operation of the engine separately work on the two ends of the crankshaft so avoiding the load on the crankshaft and its bearings from being localised, the durability thereof can be enhanced.

Furthermore, since the timing transmission is lubricated directly with oil inside the oil tank, the lubrication system can be simplified.

In accordance with a ninth characteristic of the present invention, in addition to the above-mentioned eighth characteristic, there is proposed a handheld type four-cycle engine wherein a cooling fan is fixed to the crankshaft between the engine main body and the power output mechanism, the cooling fan having a diameter larger than that of the power output mechanism.

In accordance with the above-mentioned ninth characteristic, any increase in size of the engine can be minimised while enhancing the air supply performance of the cooling fan.

In accordance with a tenth characteristic of the present invention, in addition to the above-mentioned eighth characteristic, there is proposed a handheld type four-cycle engine wherein the cam system for transmitting the rotation of the driven side of the timing transmission to the intake valve and the exhaust valve for opening and closing forces is placed in the valve operation chamber provided in the cylinder head, and oil mist generation means for generating an oil mist inside the oil tank is linked to the crankshaft, the oil mist being supplied to the valve operation chamber.

In accordance with the above-mentioned tenth characteristic, since the lubrication system of the valve operation mechanism is divided into two part, that is, a part for lubricating the timing transmission with oil inside the oil tank, and a part for lubricating the cam system with oil mist generated inside the oil tank, the load put on each part of the lubrication system is lessened and the entire valve operation mechanism can be lubricated thoroughly.

Furthermore, in accordance with an eleventh characteristic of the present invention, in addition to the above-mentioned fifth characteristic, there is proposed a handheld type four-cycle engine the timing transmission of the valve operation mechanism is constructed as a wrap-around type having a wrap-around member, the drive side of the wrap-around member extending into the oil tank, oil mist generation means for generating an oil mist for lubricating the timing transmission by scattering oil stored inside the oil tank is provided in the oil tank, and an oil droplet guide wall is provided so as to project out of the inner wall of the oil tank, the oil droplet guide wall guiding and dripping the attached oil droplets onto the part of the timing transmission extending into the oil tank when the engine is laid on its side.

In accordance with the above-mentioned eleventh characteristic, when the engine is operated in a laid-sideways state, the oil mist attached to the oil droplet guide wall turns into oil droplets, the droplets then fall down onto the wrap-around member on the drive side of the timing transmission and, in particular, when the upper part of the wrap-around member moves from the drive side to the driven side, the above-mentioned oil droplets can be carried by the wrap-around member to the driven side with hardly any influence from centrifugal force and the driven side can be lubricated reliably.

The above-mentioned wrap round member corresponds to the timing belt 25, 125, 225 in the embodiments of the present invention described below.

Furthermore, in accordance with a twelfth characteristic of the present invention, in addition to the above-mentioned first characteristic, there is proposed a handheld type four-cycle engine wherein the valve operation mechanism is provided over an oil tank placed outside the engine main body and storing a lubricating oil, a first valve operation chamber formed so as to extend upwards from the oil tank, and a second valve operation chamber formed in the cylinder head; the oil tank and the crank chamber are communicated with each other by means of a through hole; the crank chamber and the second valve operation chamber are communicated with each other by means of an oil feed pipe provided outside the engine main body; the second valve operation chamber and the oil tank are communicated with each other by means of an oil return passage; the oil tank includes oil mist generation means for generating an oil mist by stirring and scattering the stored oil; and transfer means for transferring the oil mist inside the oil tank to the oil feed pipe via the crank chamber is connected to the oil feed pipe so that the valve operation mechanism inside the first valve operation chamber is lubricated with the oil scattered inside the oil tank; and the valve operation mechanism inside the second valve operation chamber is lubricated with oil mist transferred from the oil feed pipe to the second valve operation chamber.

In accordance with the twelfth characteristic of the present invention, since the oil feed pipe is placed outside the engine main body, it is possible to make the side wall of the engine main body thinner regardless of the presence of the pipe, the engine main body can be made more compact and the weight of the entire engine can thus be reduced. Moreover, since the oil feed pipe outside the engine main body easily radiates heat, cooling of the oil mist passing through the pipe can be improved.

Since the lubrication system of the valve operation mechanism is divided into two parts, that is, a part for lubricating the valve operation mechanism inside the oil tank and the first valve operation chamber with the oil scattered inside the oil tank, and a system for lubricating the valve operation mechanism inside the second valve operation chamber with the oil mist transferred to the second valve operation chamber, the load put on each part of the lubrication system is lessened and the entire valve operation mechanism can be lubricated thoroughly.

Moreover, each part of the engine can be lubricated reliably regardless of the operational position of the engine by the use of oil droplets and oil mist.

Furthermore, in accordance with a thirteenth characteristic of the present invention, in addition to the above-mentioned twelfth characteristic, there is proposed a handheld type four-cycle engine wherein the transfer means includes valve means that closes the oil feed pipe when the pressure of the crank chamber is negative and opens the pipe when the pressure is positive.

In accordance with the thirteenth characteristic of the present invention, it is unnecessary to employ a special oil pump for circulating the oil mist, and the structure can be simplified.

Furthermore, in accordance with a fourteenth characteristic of the present invention, in addition to the above-mentioned twelfth or thirteenth characteristic, there is proposed a handheld type four-cycle engine wherein the oil feed pipe and the oil return passage are connected to each other via a bypass.

In accordance with the above-mentioned fourteenth characteristic, the amount of oil mist supplied to the second valve operation chamber from the oil feed pipe can be controlled by appropriately selecting the flow resistance of the bypass.

In accordance with a fifteenth characteristic of the present invention, in addition to the above-mentioned first characteristic, there is proposed a handheld type four-cycle engine wherein the valve operation mechanism includes the timing transmission which has a rotating drive member linked to the crankshaft and a cam system for transmitting the rotational force of a rotating driven member of the timing transmission to the intake valve and exhaust valve for opening and closing forces; a first valve operation chamber and an oil tank are provided on one side of the engine main body, the first valve operation chamber housing the timing transmission, the oil tank including oil mist generation means for generating an oil mist from stored oil, and the lower end of the first valve operation chamber opening inside the oil tank; a second valve operation chamber housing the cam system is provided in the upper part of the engine main body so as to be in line with the first valve operation chamber; a first lubrication system includes first and second oil passages placed alongside each other and providing communication between the oil tank and the crank chamber, and first oil feed means for circulating the oil mist generated inside the oil tank from the oil tank via the first oil passage, the crank chamber, and the second oil passage, back to the oil tank; and a second lubrication system includes a third oil passage providing communication between the first valve operation chamber and the second valve operation chamber, a fourth oil passage providing communication between the second valve operation chamber and the crank chamber, the second oil passage, and second oil feed means for circulating the oil mist generated inside the oil tank from the oil tank via the first valve operation chamber, the third oil passage, the second valve operation chamber, the fourth oil passage, the crank chamber, and the second oil passage, back to the oil tank. The rotating drive member and the rotating driven member correspond to the drive pulley 223 and the driven pulley 224 of the third embodiment of the present invention described below, and the oil mist generation means corresponds to the oil slingers 256*a* and 256*b*.

In accordance with the fifteenth characteristic, since the surroundings of the crank shaft are lubricated by the first and second lubrication systems, and the timing transmission and the cam system of the valve operation system are lubricated by the second lubrication system, the circumference of the crankshaft which is subjected to a comparatively high load can be lubricated adequately, at the same time it is possible to prevent excessive lubrication of the valve operation mechanism which is subjected to a comparatively low load, the amount of oil mist circulated can be minimised, the amount of oil stored in the oil tank can be reduced, and not only the oil tank but also the entire engine can be made more compact and lighter.

In accordance with a sixteenth characteristic of the present invention, in addition to the above-mentioned fifteenth characteristic, there is proposed a handheld type four-cycle engine wherein the first oil feed means includes a first one-way valve provided in the second oil passage, closing when the pressure of the crank chamber decreases and opening when the pressure increases, and the second oil feed means includes a second one-way valve provided in the third oil passage, closing when the pressure of the crank chamber decreases and opening when the pressure increases.

In accordance with the sixteenth characteristic, the oil mist inside the oil tank can be circulated by utilising the pressure pulsations within the crank chamber and the one-way transfer functions of the first and second one-way valves, it is therefore unnecessary to employ a special oil pump for circulation of the oil mist and the structure can thus be simplified.

The above-mentioned objects, other objects, characteristics and advantages of the present invention will become apparent from an explanation of preferable embodiments which will be described in detail below by reference to the attached drawings.

BRIEF DESCRIPTION OF THE DRAWINGS

FIG. 1 is an oblique view showing one embodiment of the handheld type four-cycle engine of the present invention in practical use.

FIG. 2 is a longitudinal side view of the above-mentioned four-cycle engine.

FIG. 3 is a enlarged view of an essential part of FIG. 2.

FIG. 4 is a enlarged vertically sectioned view around the camshaft in FIG. 3.

FIG. 5 is a cross-sectional view at line 5—5 in FIG. 3.

FIG. 6 is a schematic view of the lubrication system of the above-mentioned engine.

FIG. 7 is a cross-sectional view at line 7—7 in FIG. 3.

FIG. 8 is a cross-sectional view at line 8—8 in FIG. 7.

FIG. 9 is a bottom view of the head cover.

FIG. 10 is an explanatory view of the action of the suction of the oil residing in the cylinder head in various operational positions of the engine.

FIG. 11 is a cross-sectional view corresponding to FIG. 7, showing a modified embodiment of the oil feed pipe and oil return pipe.

FIG. 12 is a longitudinal side view of the handheld type four-cycle engine of the present invention.

FIG. 13 is a cross-sectional view at line 13—13 in FIG. 12.

FIG. 14 is a cross-sectional view at line 14—14 in FIG. 12.

FIG. 15 is a enlarged cross-sectional view of an essential part of FIG. 12.

FIG. 16 is a exploded view of an essential part of FIG. 15.

FIG. 17 is a cross-sectional view at line 17—17 in FIG. 14.

FIG. 18 is a cross-sectional view at line 18—18 in FIG. 14.

FIG. 19 is a cross-sectional view at line 19—19 in FIG. 18.

FIG. 20 is a cross-sectional view at line 20—20 in FIG. 15 (view of the head cover from below).

FIG. 21 is a cross-sectional view at line 21—21 in FIG. 15.

FIG. 22 is a diagram showing the lubrication route of the above-mentioned engine.

FIG. 23 is a view corresponding to FIG. 14 in which the above-mentioned engine is in an upside down state.

FIG. 24 is a view corresponding to FIG. 14 in which the above-mentioned engine is in a laid-sideways state.

FIG. 25 is a longitudinal side view of the handheld type four-cycle engine of the present invention.

FIG. 26 is a cross-sectional view at line 26—26 in FIG. 25.

FIG. 27 is a cross-sectional view at line 27—27 in FIG. 25.

FIG. 28 is a enlarged cross-sectional view of an essential part of FIG. 25.

FIG. 29 is a exploded view of an essential part of FIG. 28.

FIG. 30 is a cross-sectional view at line 30—30 in FIG. 27.

FIG. 31 is a cross-sectional view at line 31—31 in FIG. 27.

FIG. 32 is a cross-sectional view at line 32—32 in FIG. 28 (view of the head cover from below).

FIG. 33 is a cross-sectional view at line 33—33 in FIG. 28.

FIG. 34 is a diagram showing the lubrication route of the above-mentioned engine.

FIG. 35 is a view corresponding to FIG. 27 in which the above-mentioned engine is in an upside down state.

FIG. 36 is a view corresponding to FIG. 27 in which the above-mentioned engine is in a laid-sideways state.

DESCRIPTION OF PREFERRED EMBODIMENTS

Firstly, the first embodiment of the present invention shown in FIGS. 1 to 11 is explained below.

Figure 1:
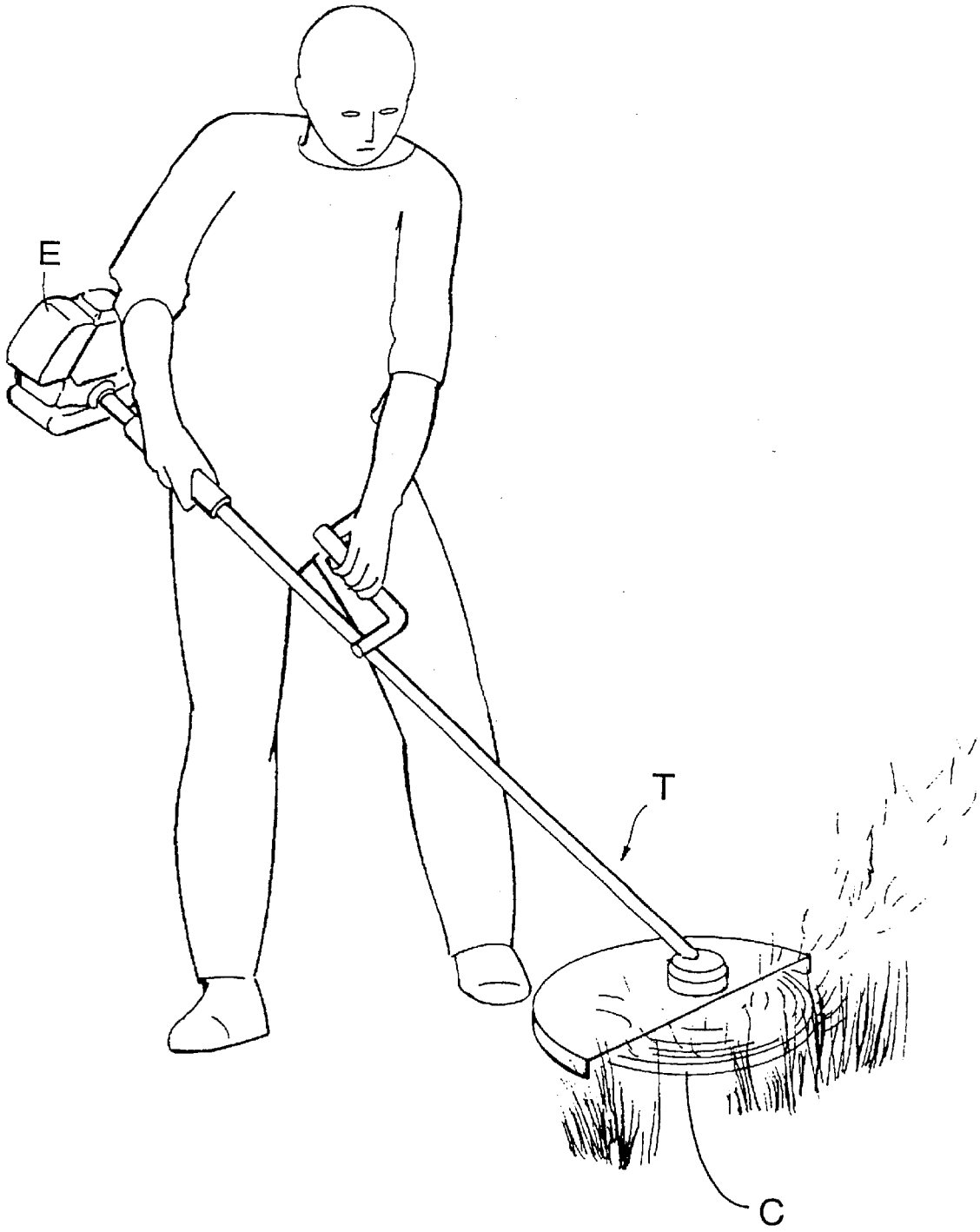
FIGS. 1 to 11 show a first embodiment of the present invention.

As shown in FIG. 1, a handheld type four-cycle engine E is attached as a source of power to the drive section of, for example, a powered trimmer T. Since the powered trimmer T is used in a manner in which a cutter C is positioned in various directions according to the operational conditions, the engine E is also tilted to a large extent or turned upside-down, and as a result and the operational position is unstable.

First of all, the overall construction of the handheld type four-cycle engine is explained by reference to FIGS. 2 to 5.

Figure 2:
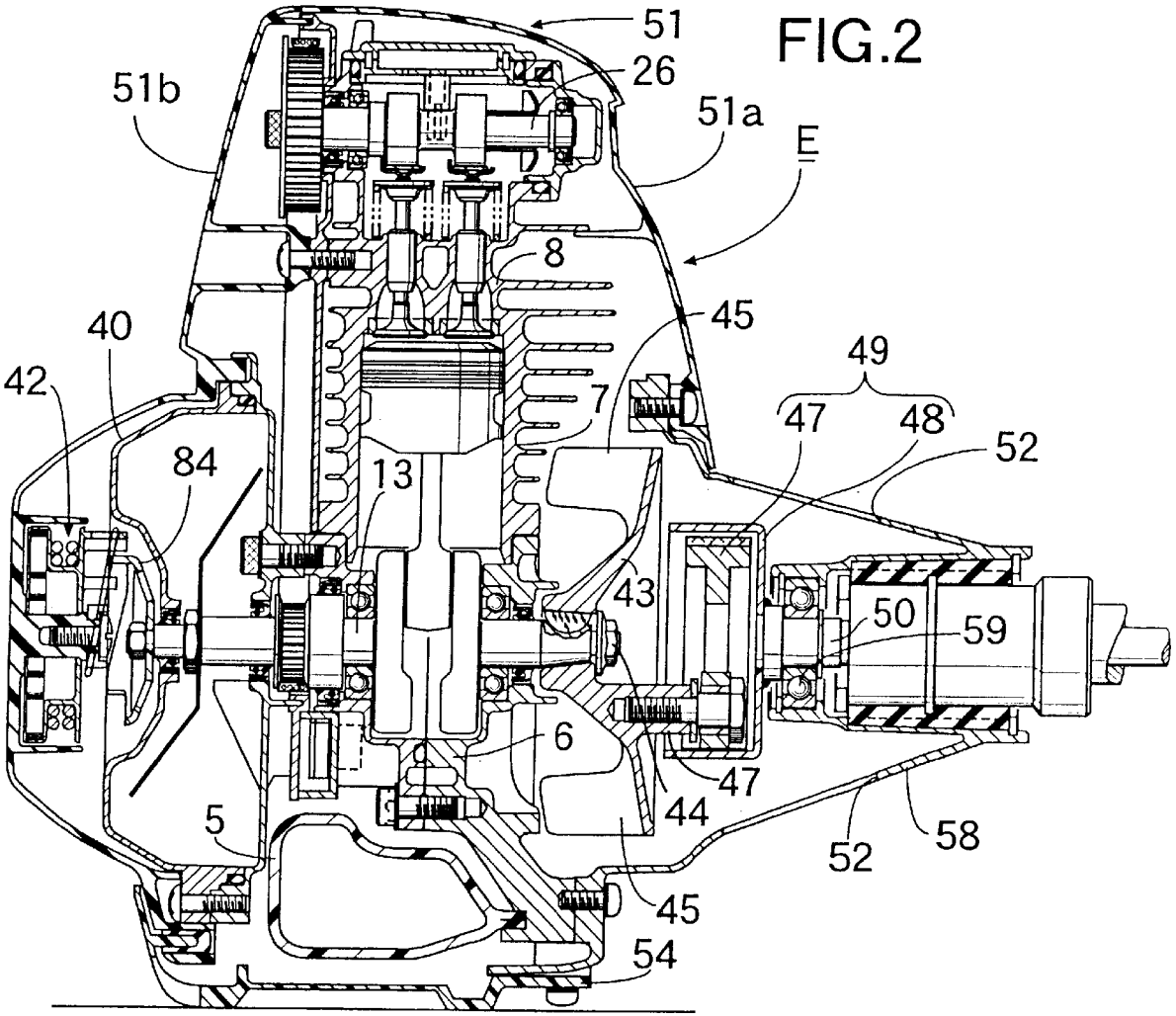
Figure 3:
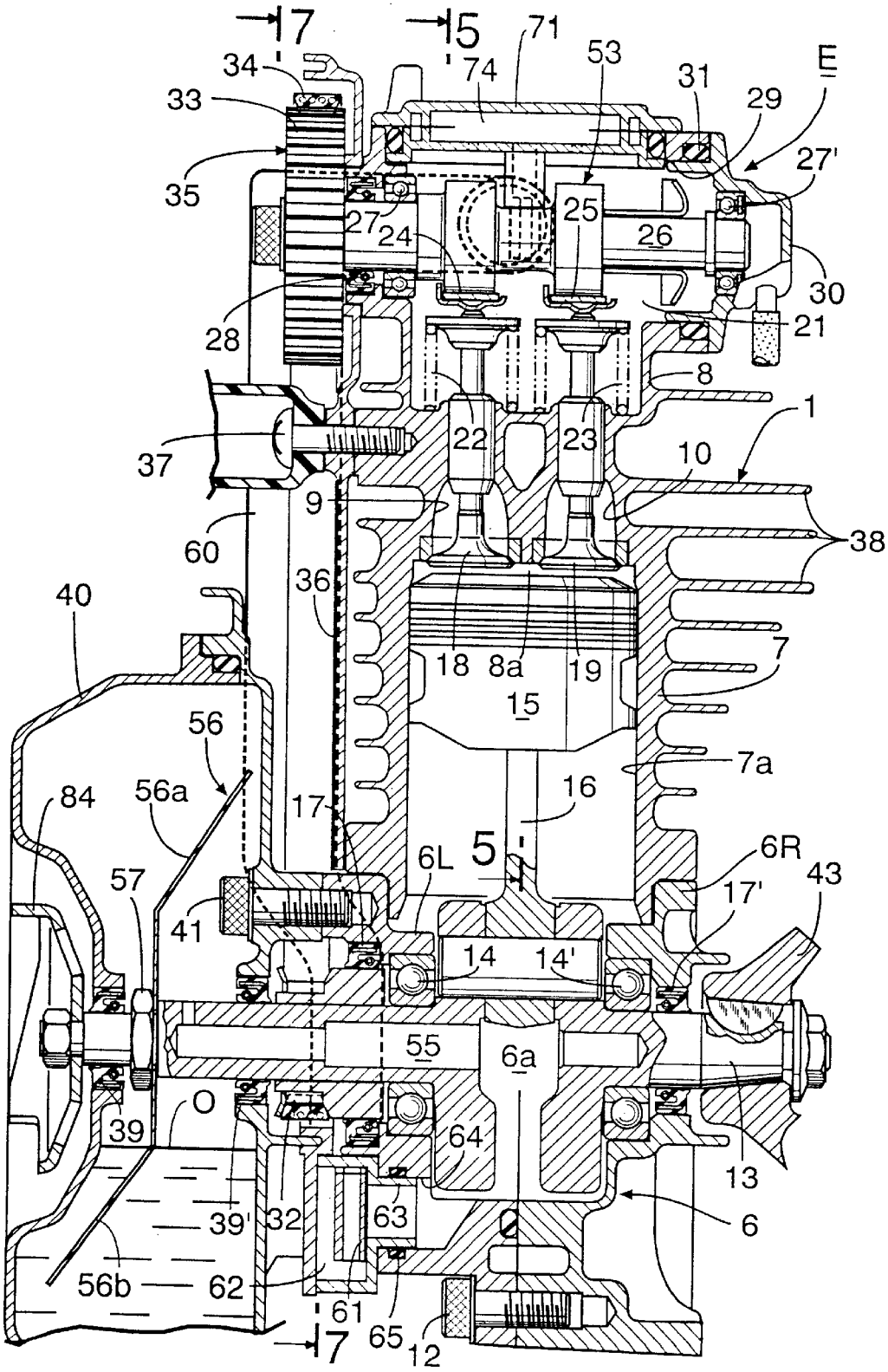
Figure 5:
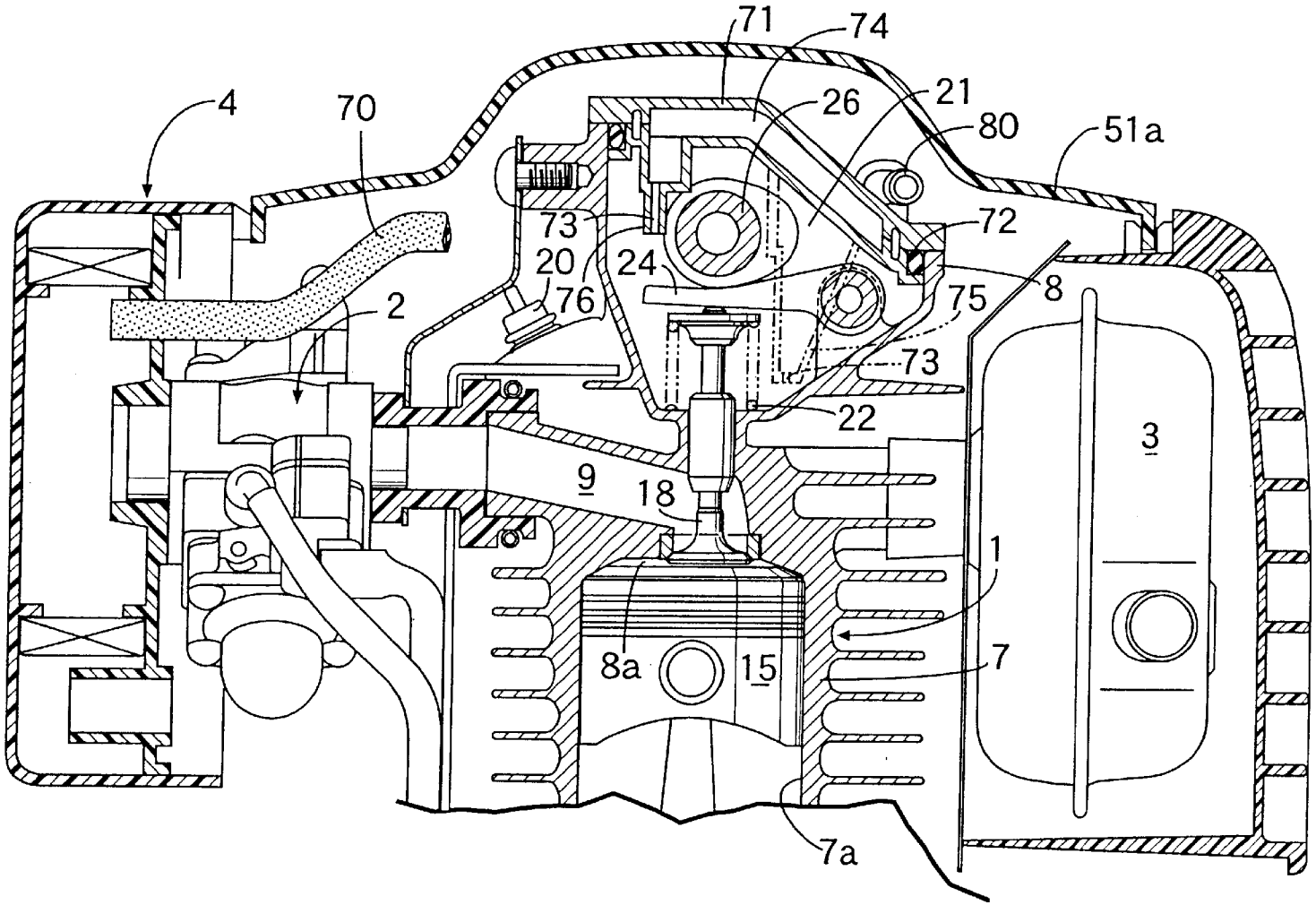

As shown in. FIGS. 2, 3 and 5, a carburettor 2 and an exhaust muffler 3 are attached to the front and back respectively of an engine main body 1 of the above-mentioned handheld type four-cycle engine E, and an air cleaner 4 is attached to the inlet of the carburettor 2. A fuel tank 5 made of a synthetic resin is attached to the lower face of the engine main body 1.

The engine main body 1 includes a crankcase 6 having a crank chamber 6*a*, a cylinder block 7 having one cylinder bore 7*a*, and a cylinder head 8 having a combustion chamber 8*a* and intake and exhaust ports 9 and 10 which open into the combustion chamber 8*a*. The cylinder block 7 and the cylinder head 8 are integrally cast, and the separately cast crankcase 6 is bolt-joined to the lower end of the cylinder block 7. The crankcase 6 is formed from first and second case halves 6L and 6R, and the two case halves 6L and 6R are joined to each other by means of a bolt 12 in the centre of the crankcase 6. A large number of cooling fins 38 are formed on the outer peripheries of the cylinder block 7 and the cylinder head 8.

A crankshaft 13 housed in the crank chamber 6*a* is rotatably supported in the first and second case halves 6L and 6R via ball bearings 14 and 14', and is connected to a piston 15 fitted in the cylinder bore 7*a* via a connecting rod 16. Moreover, oil seals 17 and 17' are fitted in the first and second case halves 6L and 6R, the oil seals 17 and 17' adjoining the above-mentioned bearings 14 and 14' and being in close contact with the outer circumference of the crankshaft 13.

An intake valve 18 and an exhaust valve 19 for opening and closing the intake port 9 and the exhaust port 10 respectively are provided in the cylinder head 8 parallel to the axis of the cylinder bore 7*a*, and a spark plug 20 is screwed in so that the electrodes thereof are close to the central area of the combustion chamber 8*a*.

The intake valve 18 and the exhaust valve 19 are forcedly closed by means of valve springs 22 and 23 in a valve cam operation chamber 21 formed in the cylinder head 8. In the valve cam operation chamber 21, cam followers 24 and 25 supported in the cylinder head 8 in a vertically rockable manner are superimposed on top of the intake valve 18 and the exhaust valve 19, and a camshaft 26 for opening and closing the intake valve 18 and the exhaust valve 19 via the cam followers 24 and 25 is rotatably supported via ball bearings 27' and 27 in the right and left side walls of the valve cam operation chamber 21, the camshaft 26 being parallel to the crankshaft 13. One side wall of the valve cam operation chamber 21 in which the bearing 27 is mounted is formed integrally with the cylinder head 8, and an oil seal 28 is mounted in this side wall in close contact with the outer circumference of the camshaft 26. The other side wall of the valve cam operation chamber 21 is provided with an insertion opening 29 to allow the camshaft 26 to be inserted into the valve cam operation chamber 21, and after inserting the camshaft 26 the other bearing 27' is mounted in a side wall cap 30 that blocks the insertion opening 29. The side wall cap 30 is fitted in the insertion opening 29 via a sealing member 31 and joined to the cylinder head 8 by means of a bolt.

Figure 4:
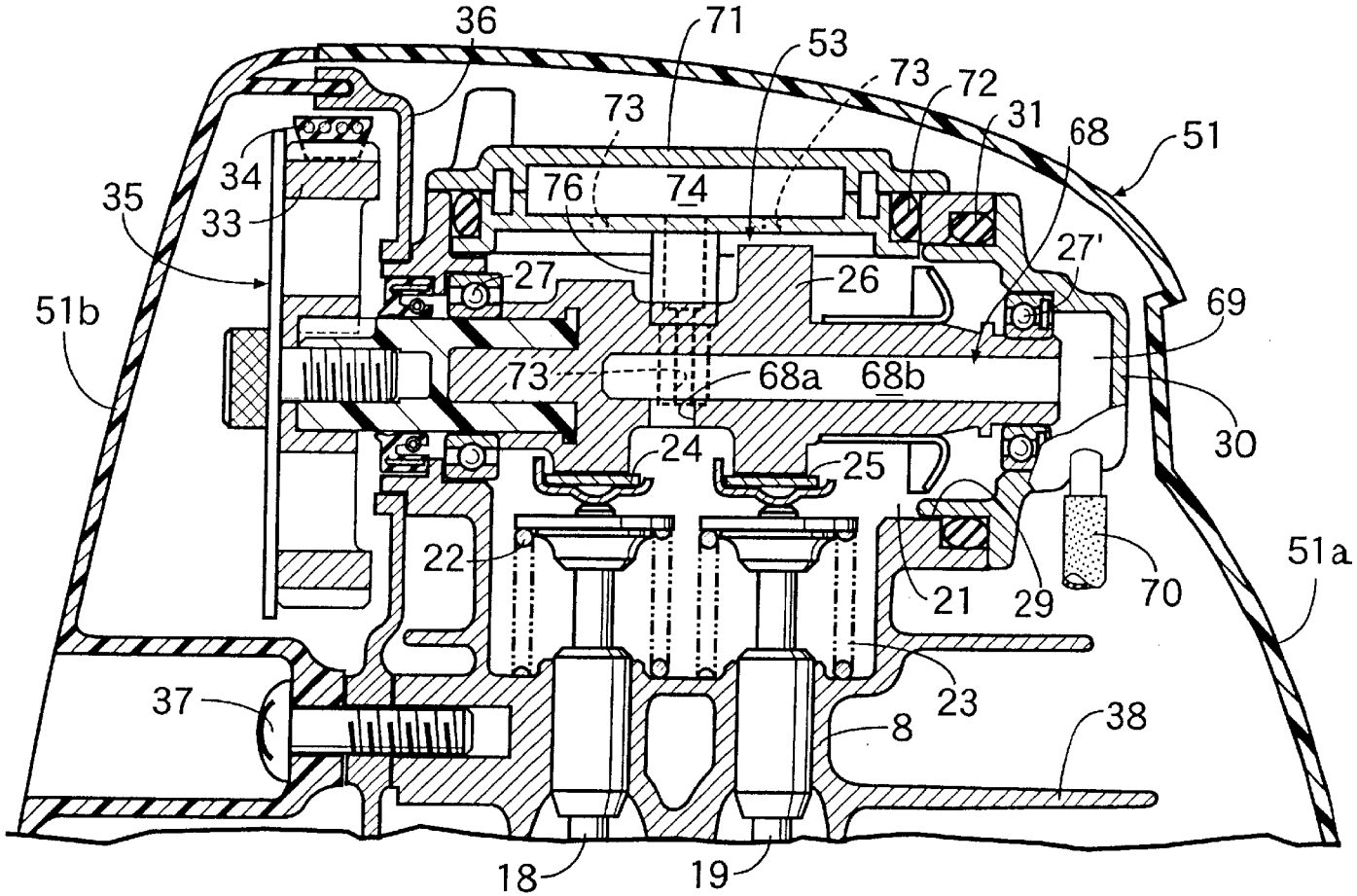

As is clearly shown in FIGS. 3 and 4, one end of the camshaft 26 projects out of the cylinder head 8 on the side of the above-mentioned oil seal 28. One end of the crankshaft 13 also projects out of the crankcase 6 on the same side, a toothed drive pulley 32 is fixed to this end of the crankshaft 13, and a toothed driven pulley 33 having twice as many teeth as that of the drive pulley 32 is fixed to the end of the above-mentioned camshaft 26. A toothed timing belt 34 is wrapped around the two pulleys 32 and 33 so that the crankshaft 13 can drive the camshaft 26 at a reduction rate of ½. The above-mentioned camshaft 26 and a timing transmission 35 form a valve operation mechanism 53.

The engine E is thus arranged in the form of an OHC type, and the timing transmission 35 is in the form of a dry type which is placed outside the engine main body 1.

A belt cover 36 made of a synthetic resin is placed between the engine main body 1 and the timing transmission 35, the belt cover 36 being fixed to the engine main body 1 by means of a bolt 37, so that the heat radiated from the engine main body 1 is prevented from affecting the timing transmission 35.

An oil tank 40 made of a synthetic resin placed so as to cover a part of the outer face of the timing transmission 35 is fixed to the engine main body 1 by means of a bolt 41 and, moreover, a recoil type starter 42 (see FIG. 2) is fitted to the outer face of the oil tank 40.

Referring again to FIG. 2, the end of the crankshaft 13 opposite to the end of the timing transmission 35 also projects out of the crankcase 6, and a flywheel 43 is fixed to the end by means of a nut 44. A large number of cooling vanes 45, 45 . . . are integrally provided on the inner face of the flywheel 43 so that the flywheel 43 can also function as cooling means. A plurality of fitting bosses 46 (one thereof is shown in FIG. 2) are formed on the outer face of the flywheel 43, and a centrifugal shoe 47 is pivotally supported on each of the fitting bosses 46. These centrifugal shoes 47, together with a clutch drum 48 fixed to a drive shaft 50 which will be described below, form a centrifugal clutch 49, and when the rotational rate of the crankshaft 13 exceeds a predetermined value, the centrifugal shoes 47 are pressed onto the inner periphery of the clutch drum 48 due to the centrifugal force of the shoes so transmitting the output torque of the crankshaft 13 to the drive shaft 50. The flywheel 43 has a larger diameter than that of the centrifugal clutch 49.

An engine cover 51 covering the engine main body 1 and its attachments is divided at the position of the timing transmission 35 into a first cover half 51*a* on the side of the flywheel 43 and a second cover half 51*b* on the side of the starter 42, and each of the cover halves 51*a* and 51*b* is fixed to the engine main body 1. A truncated cone shaped bearing holder 58 coaxially arranged with the crankshaft 13 is fixed to the first cover half 51*a*, the bearing holder 58 supporting the drive shaft 50 which rotates the above-mentioned cutter C via a rotating bearing 59, and an air intake opening 52 is provided in the bearing holder 58 so that outside air is drawn inside the engine cover 51 by rotation of the cooling vanes 45, 45 . . . Furthermore, a base 54 for covering the lower face of the fuel tank 5 is fixed to the engine cover 51 and the bearing holder 58.

As mentioned above, since the timing transmission 35 for operatively connecting the crankshaft 13 to the camshaft 26 is constructed as a dry type outside the engine main body 1, it is unnecessary to provide a special compartment for housing the transmission 35 on the side wall of the engine main body 1 and it is therefore possible to make the engine main body 1 thin and compact and greatly reduce the overall weight of the engine E.

Moreover, since the timing transmission 35 and the centrifugal shoes 47 of the centrifugal clutch 49 are connected to the two ends of the crankshaft 13 with the cylinder block 7 interposed between them, the weights at the two ends of the crankshaft 13 are well balanced, the centre of gravity of the engine E can be set as close to the central part of the crankshaft 13 as possible, and the operability of the engine E can thus be enhanced while reducing the weight. Furthermore, since the loads from the timing transmission 35 and the drive shaft 50 separately work on the two ends of the crankshaft 13 during operation of the engine E, it is possible to prevent the load on the crankshaft 13 and the bearings 14 and 14' supporting the crankshaft 13 from being localised and the durability thereof can thus be enhanced.

Furthermore, since the flywheel 43 having a diameter larger than that of the centrifugal clutch 49 and having the cooling vanes 45 is fixed to the crankshaft 13 between the engine main body 1 and the centrifugal clutch 49, external air can be supplied effectively around the cylinder block 7 and the cylinder head 8 by introducing the air through the air intake opening 52 by rotation of the cooling vanes 45 without interference from the centrifugal clutch 49 thus enhancing the cooling performance while preventing any increase in the size of the engine E due to the flywheel 43.

Moreover, since the oil tank 40 is fitted to the engine main body 1 so as to adjoin the outside of the timing transmission 35, the oil tank 40 covers at least a part of the timing transmission 35 and can protect the transmission 35 in co-operation with the second cover half 51*b* covering the other part of the transmission 35. In addition, since the oil tank 40 and the flywheel 43 are arranged so as to face each other with the engine main body 1 interposed between them, the centre of gravity of the engine E can be set closer to the central part of the crankshaft 13.

The lubrication system of the above-mentioned engine E is explained below by reference to FIGS. 3 to 10.

As shown in FIG. 3, the crankshaft 13 is arranged so that one end thereof runs through the oil tank 40 while being in close contact with the oil seals 39 and 39' mounted in both the outside and inside walls of the oil tank 40, and a through hole 55 providing communication between the inside of the oil tank 40 and the crank chamber 6*a* is provided in the crankshaft 13. Lubricating oil O is stored in the oil tank 40, and the amount stored is set so that an open end of the above-mentioned through hole 55 inside the oil tank 40 is always above the liquid level of the oil O regardless of the operational position of the engine E.

An oil slinger 56 is fixed to the crankshaft 13 inside the oil tank 40 by means of a nut 57. The oil slinger 56 includes two blades 56*a* and 56*b* which extend in directions radially opposite to each other from the central part where the oil slinger 56 is fitted to the crankshaft 13, and which are bent in directions axially opposite to each other. When the oil slinger 56 is rotated by the crank shaft 13, at least one of the two blades 56*a* and 56*b* scatters the oil 0 inside the oil tank 40 so as to generate an oil mist regardless of the operational position of the engine E.

Figure 6:
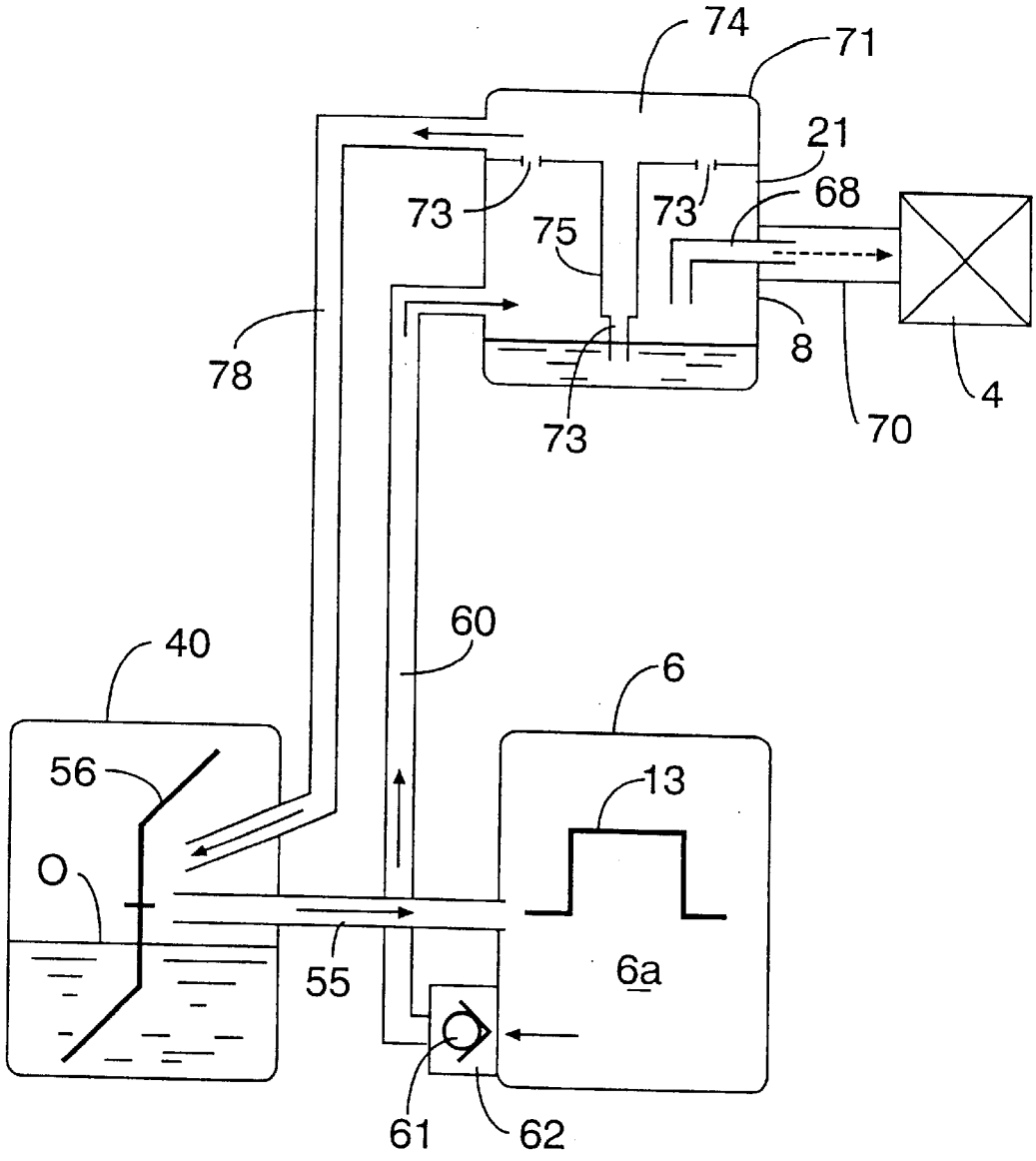
Figure 7:
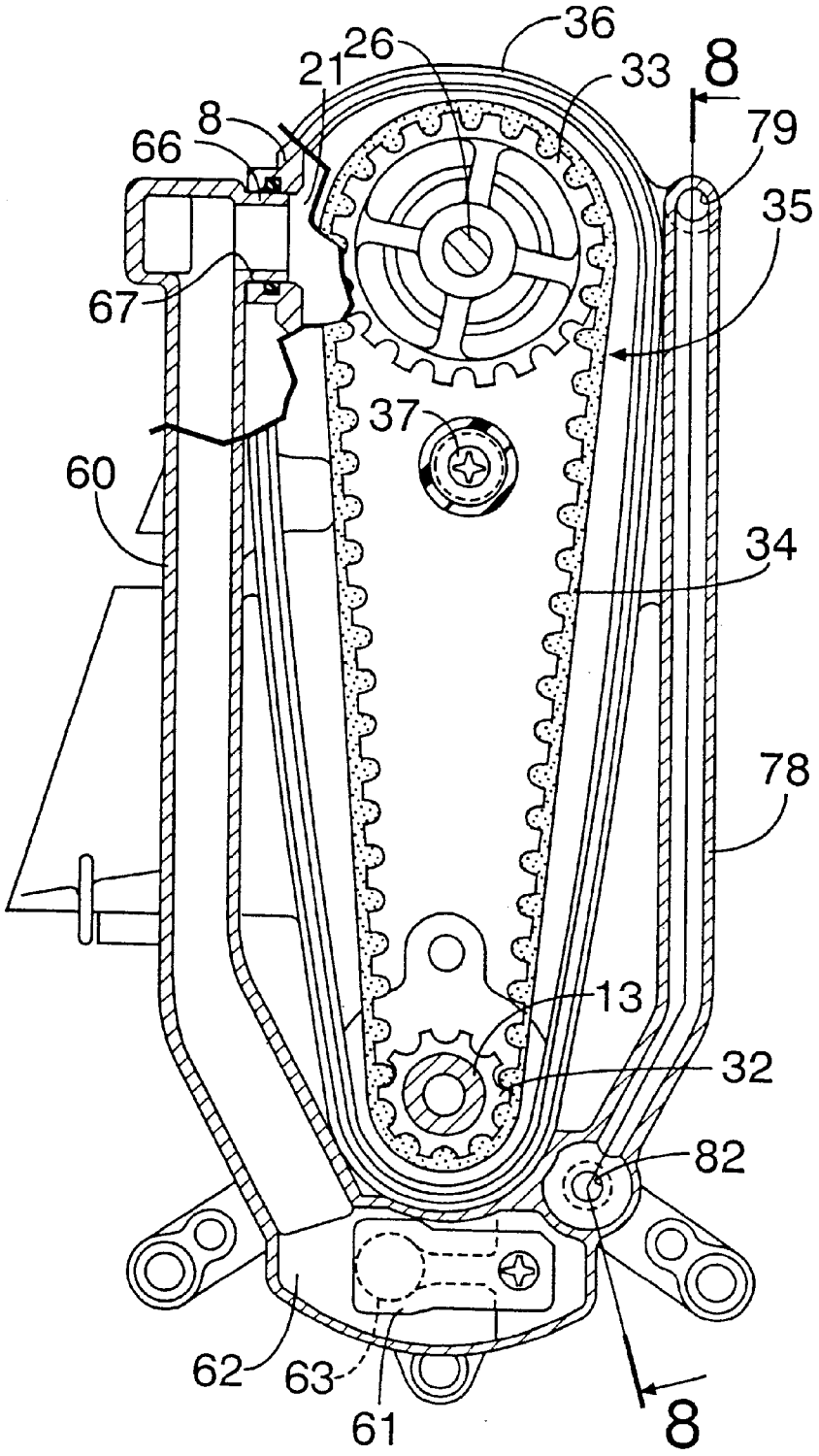

As shown in FIGS. 3, 6 and 7, the crank chamber 6*a* is connected to the valve operation camber 21 via an oil feed pipe 60, and a one-way valve 61 is provided in the oil feed pipe 60 so as to only allow flow in the direction from the crank chamber 6*a* to the valve cam operation chamber 21. The oil feed pipe 60 is formed integrally with the aforementioned belt cover 36 along one side edge thereof, and the lower end of the oil feed pipe 60 is formed in a valve chamber 62. An inlet pipe 63 projecting from the valve chamber 62 at the back of the belt cover 36 is formed integrally with the belt cover 36, and the inlet pipe 63 is fitted into a connection hole 64 in the lower part of the crankcase 6 via a sealing member 65 so that the inlet pipe 63 is communicated with to provide a link to the crank chamber 6*a*. The aforementioned one-way valve 61 is provided inside the valve chamber 62 so as to allow flow in the direction from the inlet pipe 63 to the valve chamber 62. This one-way valve 61 is a reed valve in the case of the illustrated embodiment.

An outlet pipe 66 projecting from the upper end of the oil feed pipe 60 at the back of the belt cover 36 is formed integrally with the belt cover 36, and the outlet pipe 66 is fitted into a connection hole 67 in a side of the cylinder head 8 so that the inlet pipe 66 is communicated with the valve cam operation chamber 21.

The valve cam operation chamber 21 thus communicated with the oil feed pipe 60 is communicated with a breather chamber 69 inside the side wall cap 30 via a gas-liquid separation passage 68 provided in the camshaft 26 and including a transverse hole 68*a* and a longitudinal hole 68*b*, and the breather chamber 69 is communicated with the inside of the aforementioned air cleaner 4 via a breather pipe 70.

Figure 9:
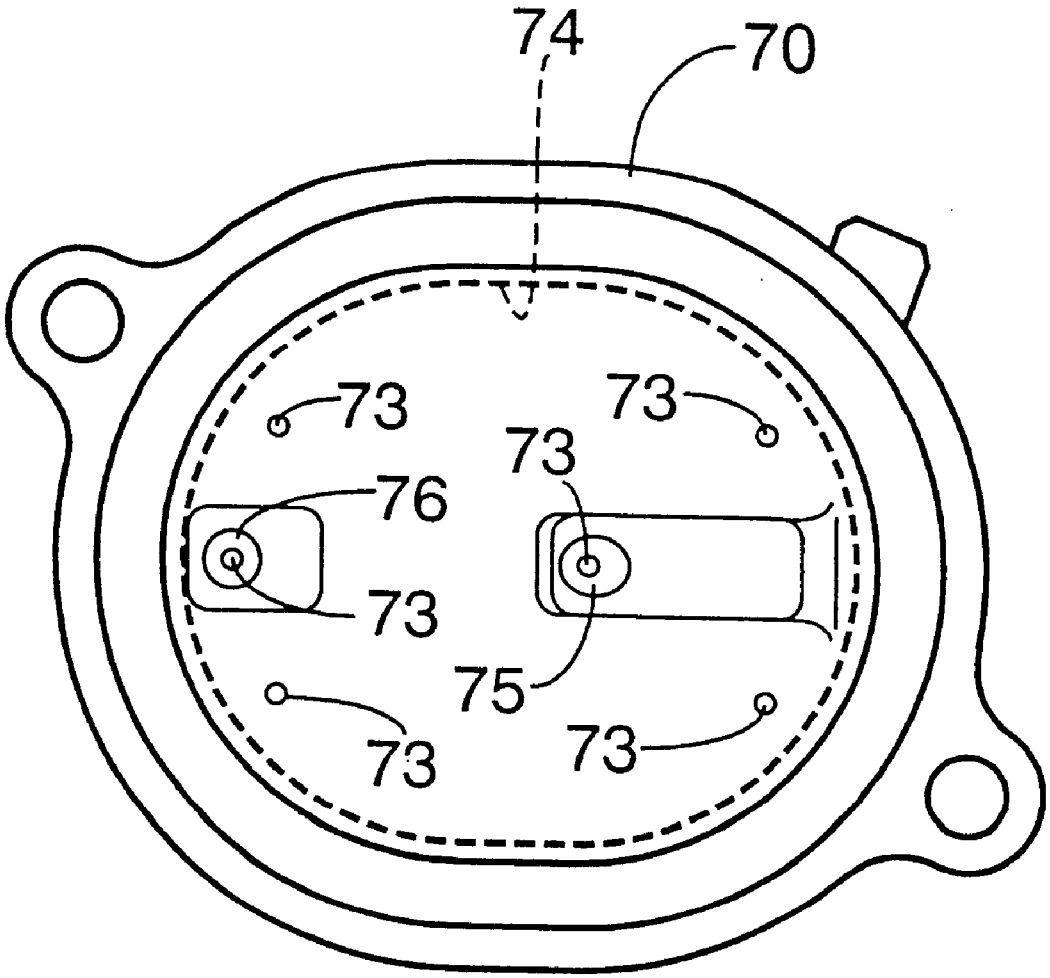
Figure 10A:
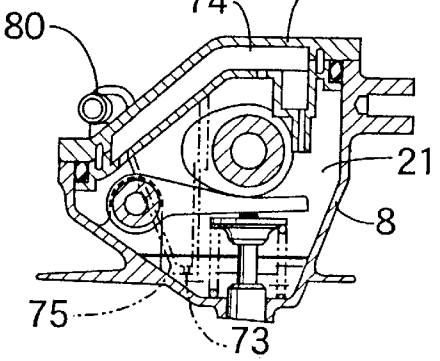
Figure 10B:
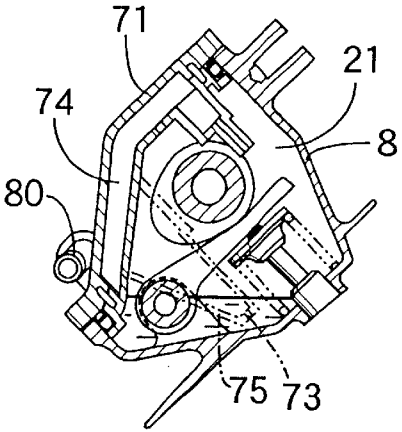
Figure 10C:
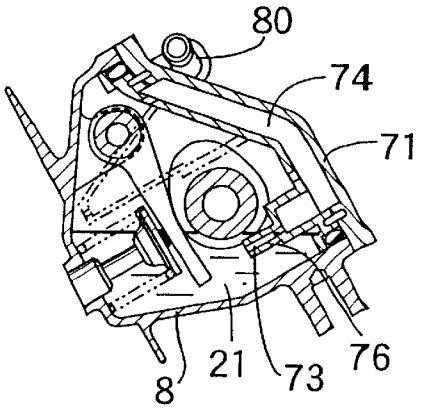
Figure 10D:
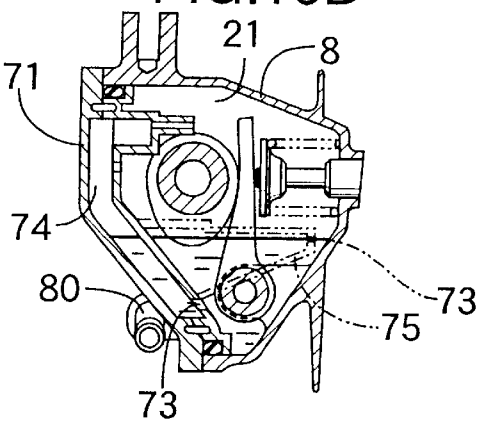
Figure 10E:
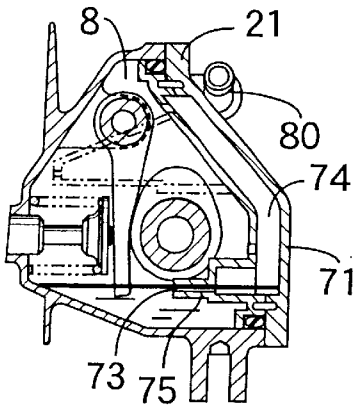
Figure 10F:
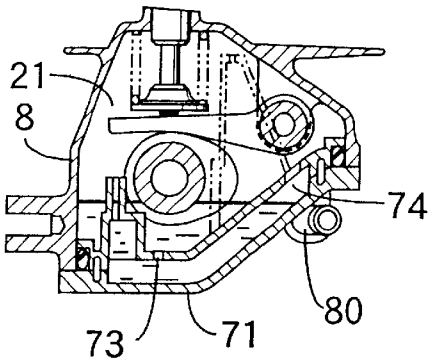

As is clearly shown in FIGS. 4 and 9, a head cover 71 for blocking the open upper face of the valve cam operation chamber 21 is joined to the cylinder head 8 via a sealing member 72. A suction chamber 74 communicated with the valve cam operation chamber 21 via a plurality of orifices 73, 73 . . . is formed in the head cover 71. The suction chamber 74 has a flattened shape along the upper face of the valve cam operation chamber 21, and is provided with four orifices 73, 73 . . . at four points in the bottom wall thereof. Long and short suction pipes 75 and 76 are formed integrally with the bottom wall of the suction chamber 74 in its central area, with a space between the long and short suction pipes 75 and 76 in the direction perpendicular to the axis of the camshaft 26, so as to project inside the valve cam operation chamber 21, and orifices 73 and 73 are provided in the suction pipes 75 and 76.

Figure 8:
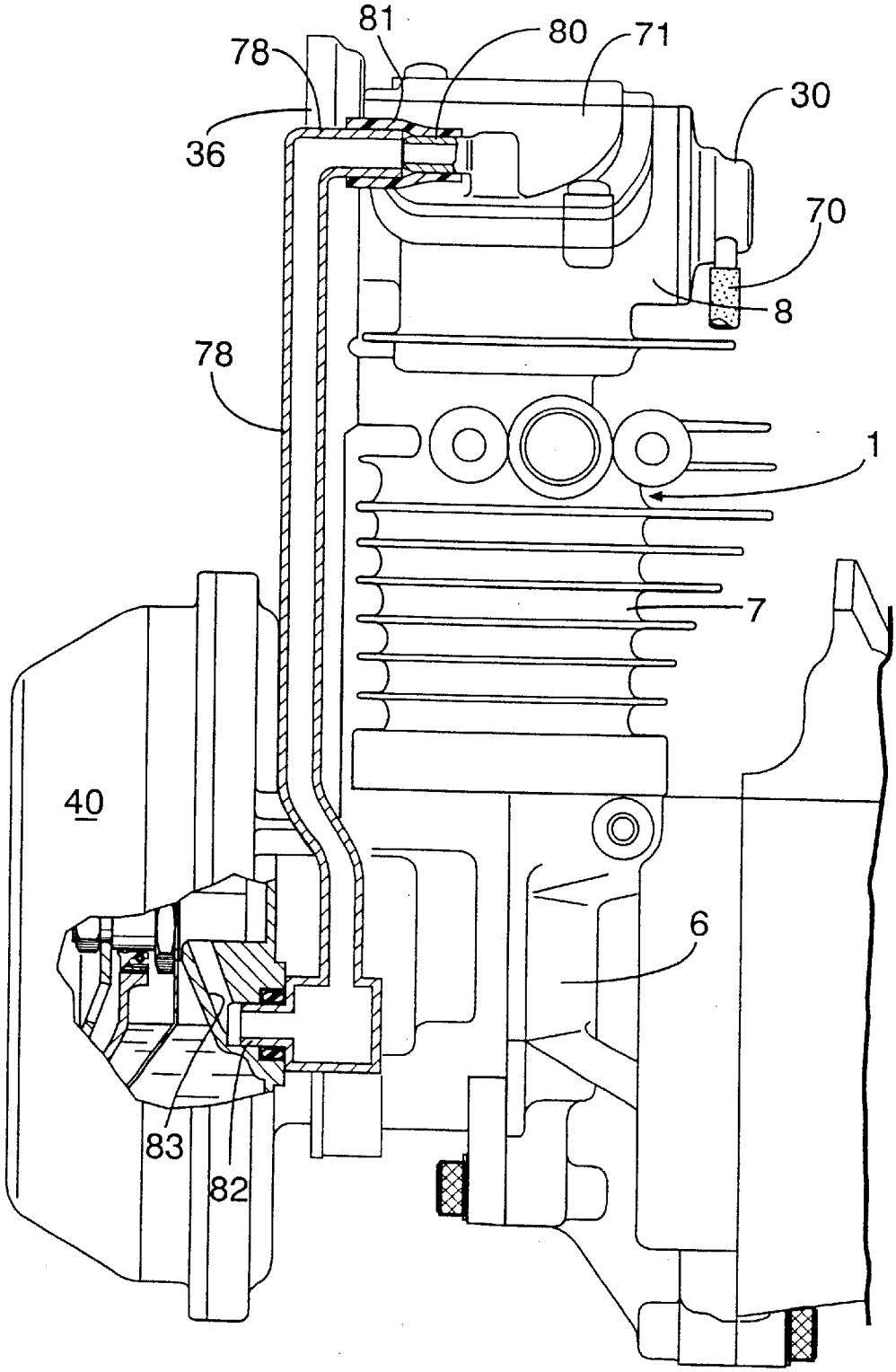

As shown in FIGS. 6 to 8, the suction chamber 74 is communicated also with the inside of the oil tank 40 via an oil return pipe 78. The oil return pipe 78 is formed integrally with the belt cover 36 along the edge thereof on the side opposite to that for the oil feed pipe 60. An inlet pipe 79 projecting from the upper end of the oil return pipe 78 at the back of the belt cover 36 is formed integrally with the belt cover 36, and the inlet pipe 79 is connected to an outlet pipe 80, which is formed in the head cover 71, via a connector 81, so that the inlet pipe 79 is communicated with the suction chamber 74.

Moreover, an outlet pipe 82 projecting from the lower end of the oil return pipe 78 at the back of the belt cover 36 is formed integrally with the belt cover 36, and the outlet pipe 82 is fitted into a return hole 83 provided in the oil tank 40 so that the outlet pipe 82 is communicated with the inside of the oil tank 40. The open end of the return hole 83 is positioned in the vicinity of the central part of the oil tank 40 so that the open end is above the liquid level of the oil inside the oil tank 40 regardless of the operational position of the engine E.

A driven member 84 driven by the above-mentioned recoil type starter 42 is fixed to the forward end of the crankshaft 13 which projects out of the oil tank 40.

Oil mist is generated by the oil slinger 56 scattering the lubricating oil O inside the oil tank 40 due to rotation of the crankshaft 13 during operation of the engine E, and when the pressure of the crank chamber 23 decreases due to the ascending movement of the piston 15 the oil mist so generated is taken into the crank chamber 6*a* via the through hole 55 so lubricating the crankshaft 13 and the piston 15. When the pressure of the crank chamber 6*a* increases due to the descending movement of the piston 15, the one-way valve 61 opens and, as a result, the above-mentioned oil mist ascends inside the oil feed pipe 60 together with the blowby gas generated in the crank chamber 6*a* and is supplied to the valve cam operation chamber 21, so lubricating the camshaft 26, the cam followers 24 and 25, etc.

When the oil mist and the blowby gas inside the valve cam operation chamber 21 enter the gas-liquid separation passage 68 inside the rotating camshaft 26, gas and liquid are separated by centrifugation inside the passage 68, the liquefied oil is returned to the valve cam operation chamber 21 via the transverse hole 68*a* of the gas-liquid separation passage 68, but the blowby gas is taken into the engine E via the breather chamber 69, the breather pipe 70 and the air cleaner 4, in that order, during the intake stroke of the engine E.

Since the valve cam operation chamber 21 is communicated with the inside of the air cleaner 4 as aforementioned via the gas-liquid separation passage 68, the breather chamber 69 and the breather pipe 70, the pressure within the valve cam operation chamber 21 is maintained at or slightly below atmospheric pressure.

On the other hand, the pressure of the crank chamber 6*a* is negative on average since the positive pressure component alone of the pressure pulsations is discharged through the one-way valve 61. The negative pressure is transmitted to the oil tank 40 via the through hole 55 and further to the suction chamber 74 via the oil return pipe 78. The pressure in the suction chamber 74 is therefore lower than that of the valve cam operation chamber 21, and the pressure in the oil tank 40 is lower than that in the suction chamber 74. As a result, the pressure is transferred from the valve cam operation chamber 21 to the suction chamber 74 via the suction pipes 75 and 76 and the orifices 73, 73 . . . and further to the oil tank 40 via the oil return pipe 78, and accompanying this transfer the oil mist inside the valve cam operation chamber 21 and the liquefied oil retained in the valve cam operation chamber 21 are drawn up into the suction chamber 74 through the suction pipes 75 and 76 and the orifices 73, 73 . . . and returned to the oil tank 40 through the oil return pipe 78.

As mentioned above, since the four orifices 73, 73 . . . are provided at four points of the bottom wall of the suction chamber 74 and the orifices 73 and 73 are provided in the long and short suction pipes 74 and 75 projecting into the valve cam operation chamber 21 from the central part of the bottom wall with a space between the long and short suction pipes 74 and 75 in the directions perpendicular to the axis of the camshaft 26, one of the six orifices 73, 73 . . . is immersed in the oil stored in the valve cam operation chamber 21 regardless of the operational position of the engine E such as an upright state (A), a leftward tilted state (B), a rightward tilted state (C), a leftward laid state (D), a rightward laid state (E) or an upside down state (F) as shown in FIG. 10 and the oil can be drawn up into the suction chamber 74.

Since the oil mist so generated in the oil tank 40 is thus supplied to the crank chamber 6*a* and the valve cam operation chamber 21 of the OHC type four-cycle engine E utilising the pressure pulsations within the crank chamber 6*a* and the function of the one-way valve 61 and is returned to the oil tank 40, the inside of the engine E can be lubricated reliably by the oil mist regardless of the operational position of the engine E; moreover a special oil pump for circulating the oil mist is unnecessary and the structure can thus be simplified.

Not only the oil tank 40 which is made of a synthetic resin but also the oil feed pipe 60 providing communication between the crank chamber 6*a* and the valve cam operation chamber 21 and the oil return pipe 78 providing communication between the suction chamber 74 and the oil tank 40 are placed outside the engine main body 1, there is no obstacle to making the engine main body 1 thinner and more compact, and this can thus contribute greatly to a reduction in the weight of the engine E. In particular, since the externally placed oil feed pipe 60 and oil return pipe 78 are less influenced by heat from the engine main body 1, overheating of the lubricating oil O can be prevented. Furthermore, the integral formation of the oil feed pipe 60, the oil return pipe 78 and the belt cover 36 can contribute to a reduction in the number of parts and an enhancement in the assembly performance.

Figure 11:
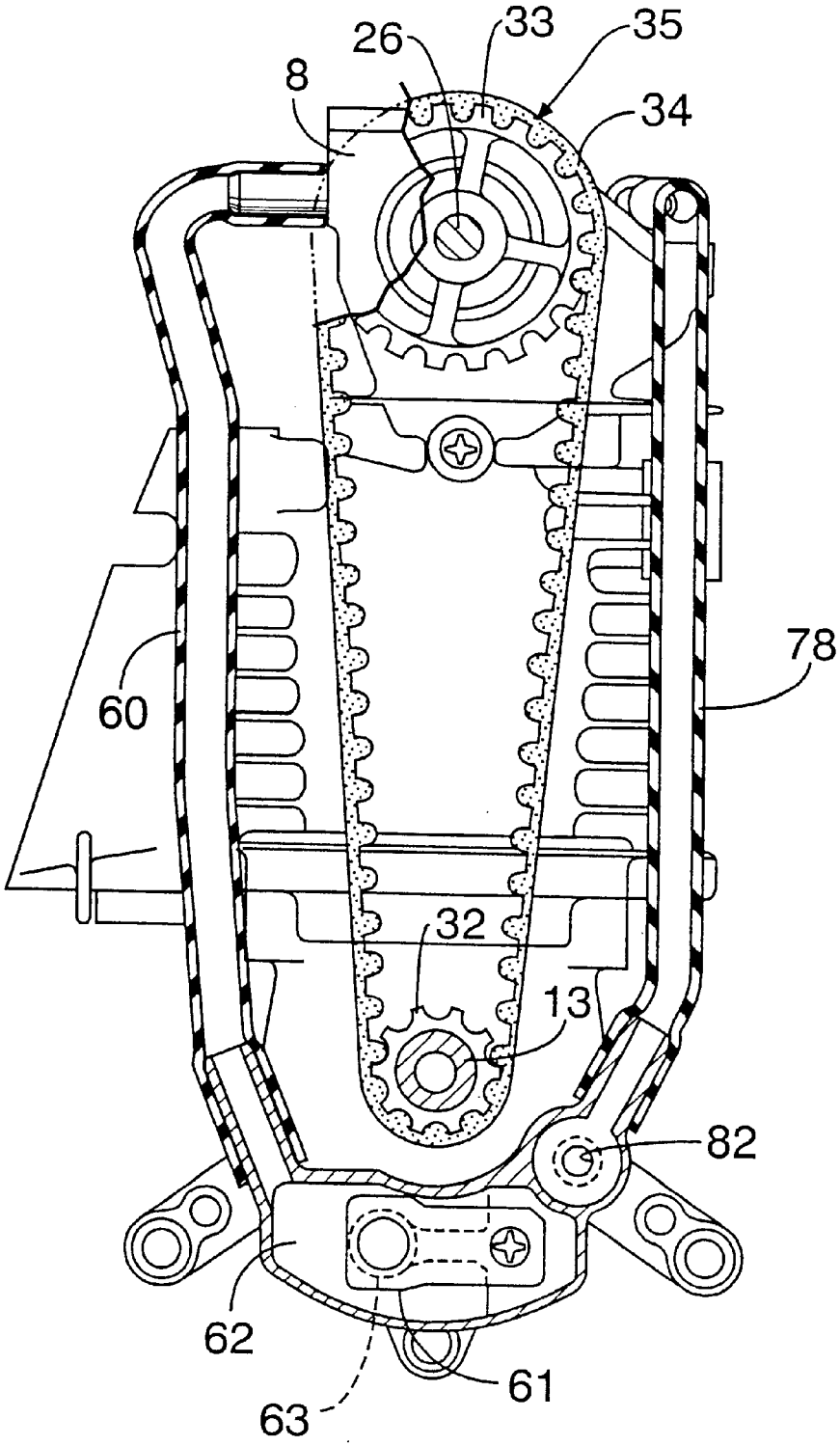

FIG. 11 shows a modified embodiment of the oil feed pipe 60 and the oil return pipe 78, and in this case the oil feed pipe 60 and the oil return pipe 78 are formed from a tube which is made of a flexible material such as rubber and which is separated from the belt cover 36. Since the other components are the same as those in the above-mentioned embodiment, the corresponding parts in the drawing are denoted by the same reference numerals and their explanation is omitted.

In accordance with the modified embodiment, the oil feed pipe 60 and the oil return pipe 78 can be freely fitted to connection points, wherever the points are located, by appropriately flexing the pipes 60 and 78, and the degrees of freedom of the layout can be increased.

It is also possible in the above-mentioned first embodiment that a rotary valve operatively connected to the crankshaft 13 and operating so as to unblock the oil feed pipe 60 when the piston 15 descends, and to block the oil feed pipe 60 when the piston 15 ascends is provided instead of the one-way valve 61.

Next, a second embodiment of the present invention is explained by reference to FIGS. 12 to 24.

Figure 12:
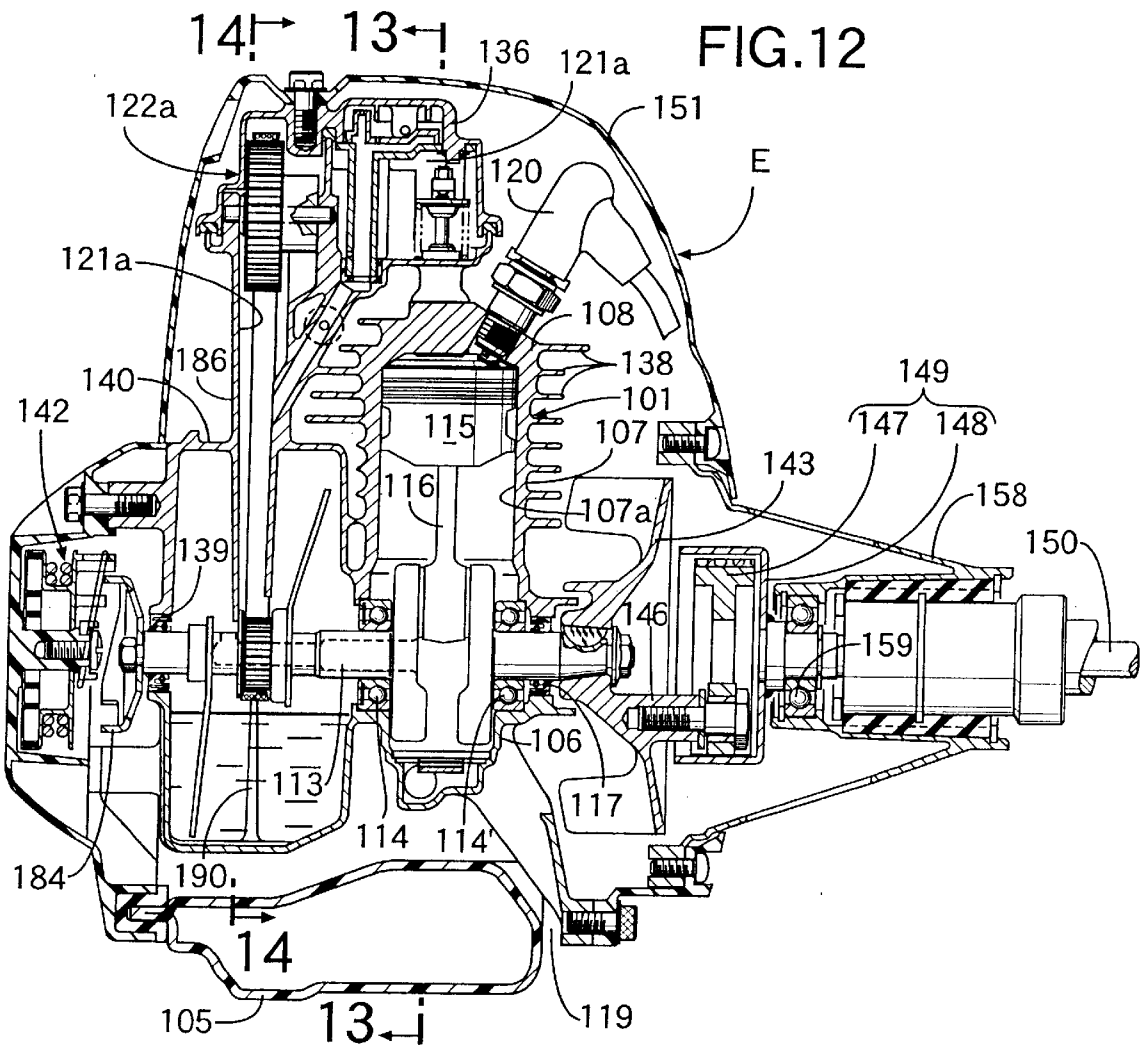
FIGS. 12 to 24 show a second embodiment of the present invention.
Figure 13:
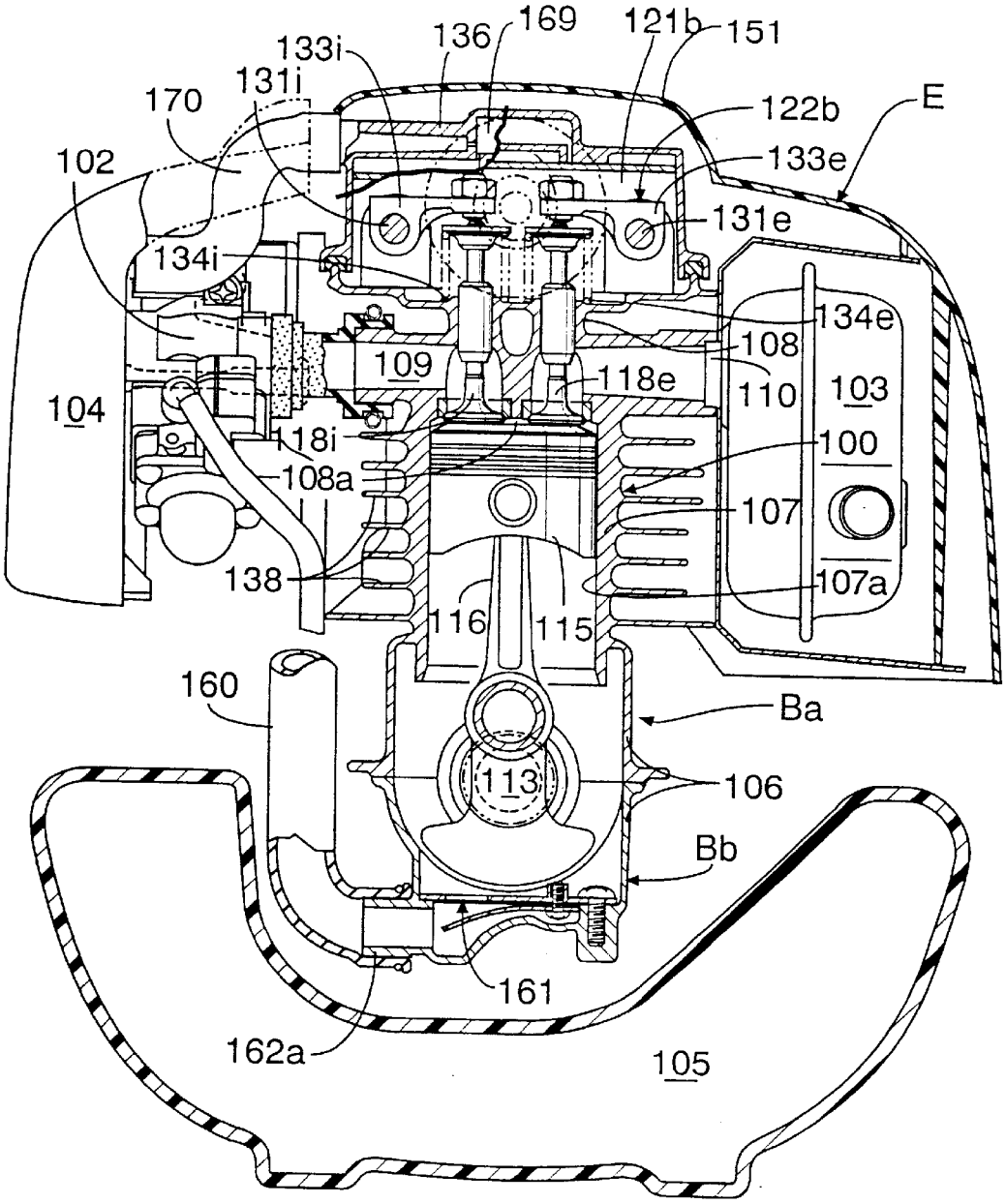

As shown in FIGS. 12 and 13, a carburettor 102 and an exhaust muffler 103 are attached to the back and front respectively of an engine main body 101 of a handheld type four-cycle engine E, and an air cleaner 104 is attached to the inlet of the carburettor 102. A fuel tank 105 made of a synthetic resin is attached to the lower face of the engine main body 101. The two ends of a crankshaft 113 project out through the engine main body 101 and an oil tank 140 adjacent to one side of the engine main body 101, and a recoil type starter 142 which can be transmittably connected to a driven member 184 fixed to one end of the crankshaft 113 is mounted on the outer face of the oil tank 140.

A cooling fan 143 that also functions as a flywheel is fixed to the other end of the crankshaft 113. A plurality of fitting bosses 146 (one thereof is shown in FIG. 12) are formed on the outer face of the cooling fan 143, and a centrifugal shoe 147 is pivotally supported on each of the fitting bosses 146. These centrifugal shoes 147, together with a clutch drum 148 fixed to a drive shaft 150 which will be described below, form a centrifugal clutch 149, and when the rotational rate of the crankshaft 113 exceeds a predetermined value, the centrifugal shoes 147 are pressed onto the inner periphery of the clutch drum 148 due to the centrifugal force of the shoes so transmitting the output torque of the crankshaft 113 to the drive shaft 150. The cooling fan 143 has a larger diameter than that of the centrifugal clutch 149.

An engine cover 151 covering the engine main body 101 and its attachments excluding the fuel tank 140 is fixed at appropriate positions to the engine main body 101, and a cooling air inlet 119 is provided between the engine cover 151 and the fuel tank 105. External air is thus taken in via the cooling air inlet 119 by the cooling fan 143 rotating and supplied for cooling each part of the engine E.

A truncated cone shaped bearing holder 158 coaxially disposed with the crankshaft 113 is fixed to the engine cover 151, and the bearing holder 158 supports the drive shaft 150 which rotates the cutter C of the trimmer T (see FIG. 1) via a bearing 159 in the same way as in the above-mentioned first embodiment.

Since the oil tank 140 and the starter 142 are disposed on one side and the cooling fan 143 and the centrifugal clutch 149 are disposed on the other side with the engine main body 101 placed therebetween, the weight balance of the engine E between the right and left is improved, and the centre of gravity of the engine E can be made closer to the central part of the engine main body 101 so enhancing the handling performance of the engine E.

Furthermore, since the cooling fan 143 having a larger diameter than that of the centrifugal shoes 147 is fixed to the crankshaft 113 between the engine main body 101 and the centrifugal clutch 149, it is possible to avoid any increase in the size of the engine E due to the cooling fan 143.

The structures of the engine main body 101 and the oil tank 140 are explained below by reference to FIGS. 12 to 15, 16, 20 and 21.

In FIGS. 12 to 15, the engine main body 101 includes a crankcase 106 having a crank chamber 106*a*, a cylinder block 107 having one cylinder bore 107*a*, and a cylinder head 108 having a combustion chamber 108*a* and intake and exhaust ports 109 and 110 which open into the combustion chamber 108*a*, and a large number of cooling fins 138 are formed on the outer peripheries of the cylinder block 107 and the cylinder head 108.

The crankshaft 113 housed in the crank chamber 106*a* is supported in the left and right side walls of the crankcase 106 via ball bearings 114 and 114'. In this case, the left-hand ball bearing 114 is equipped with a seal, and an oil seal 117 is provided so as to adjoin the outside of the right-hand ball bearing 114'. A piston 115 fitted in the cylinder bore 107*a* is conventionally connected to the crankshaft 113 via a connecting rod 116 in an ordinary manner.

The oil tank 140 is provided so as to be integrally formed with the left-hand wall of the crankcase 106, and is arranged so that the end of the crankshaft 113 on the side of the sealed ball bearing 114 runs through the oil tank 140. An oil seal 139 through which the crankshaft 113 runs is fitted in the outside wall of the oil tank 140.

A belt guide tube 186 having a flattened cross-section is provided integrally with the roof of the oil tank 140, the belt guide tube 186 running vertically through the roof of the oil tank 140 and having open upper and lower ends. The lower end of the belt guide tube 186 extends towards the vicinity of the crankshaft 113 inside the oil tank 140, and the upper end is provided integrally with the cylinder head 108 so as to share a partition 185 with the cylinder head 108. A line of circular sealing bead 187 is formed around the periphery of the upper end of the belt guide tube 186 and the cylinder head 108, and the partition 185 projects above the sealing bead 187.

Figure 16:
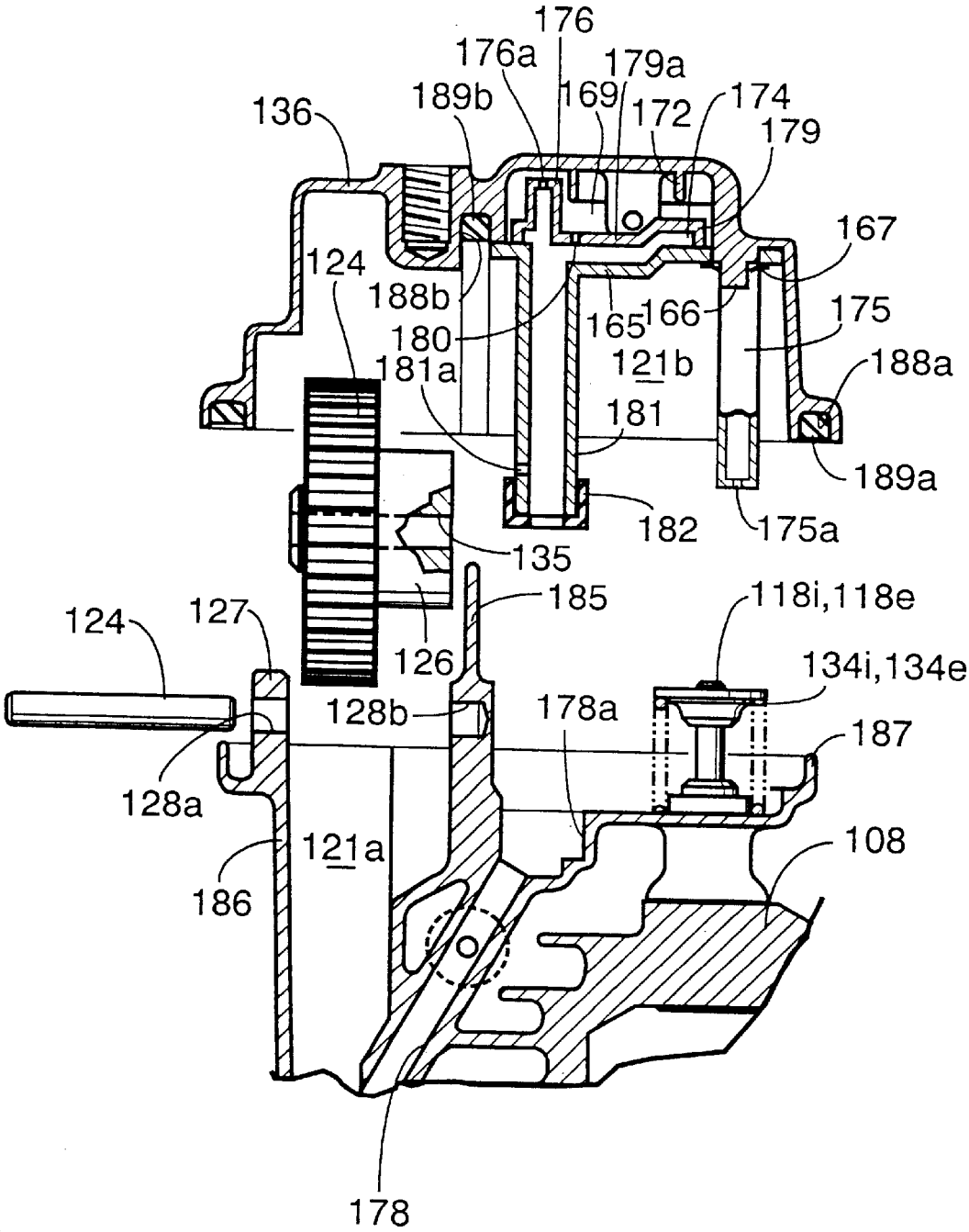
Figure 17:
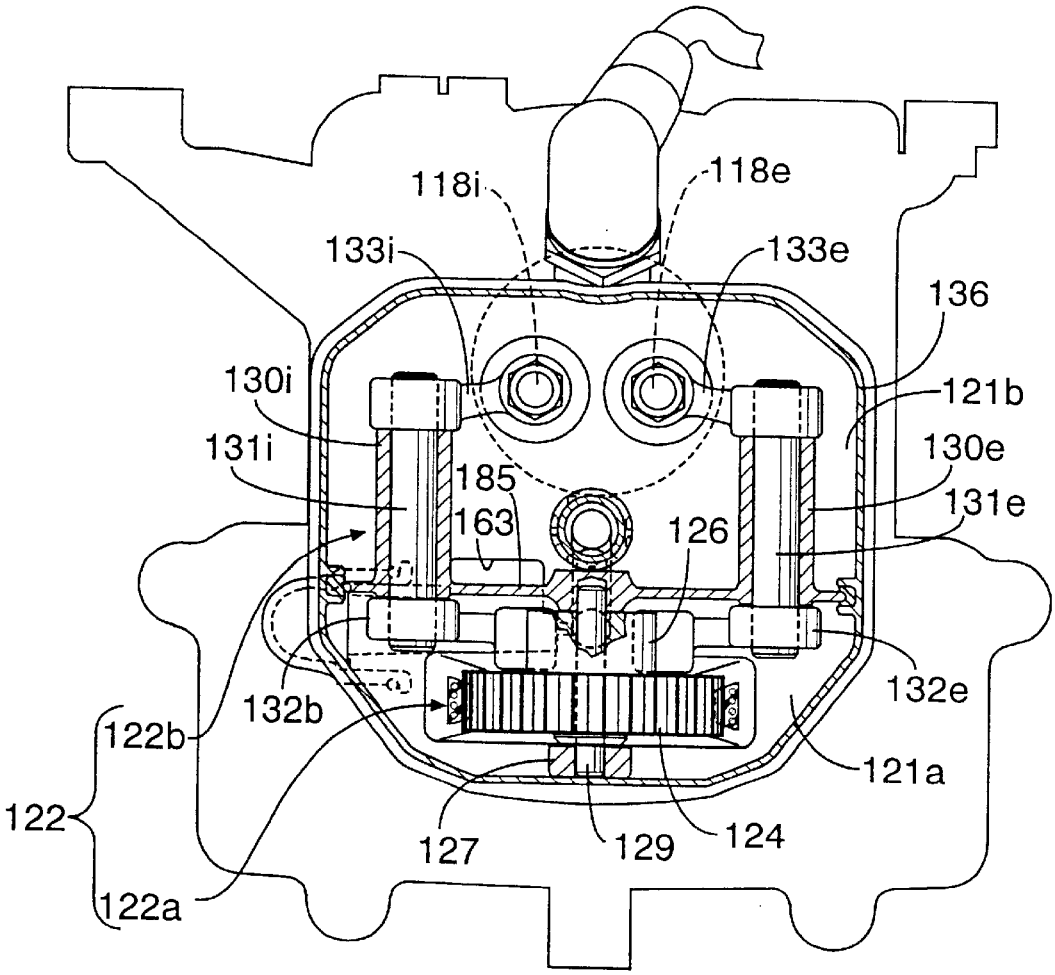
Figure 20:
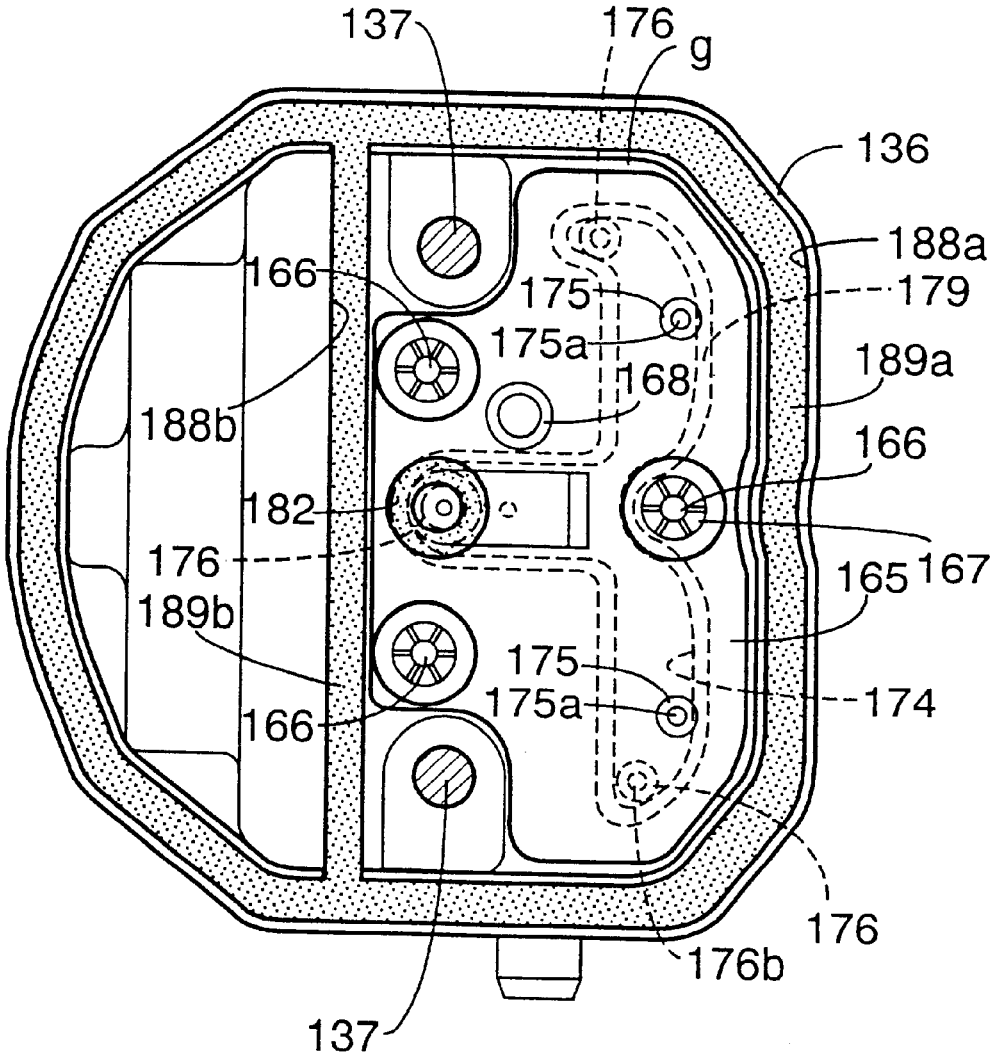
Figure 21:
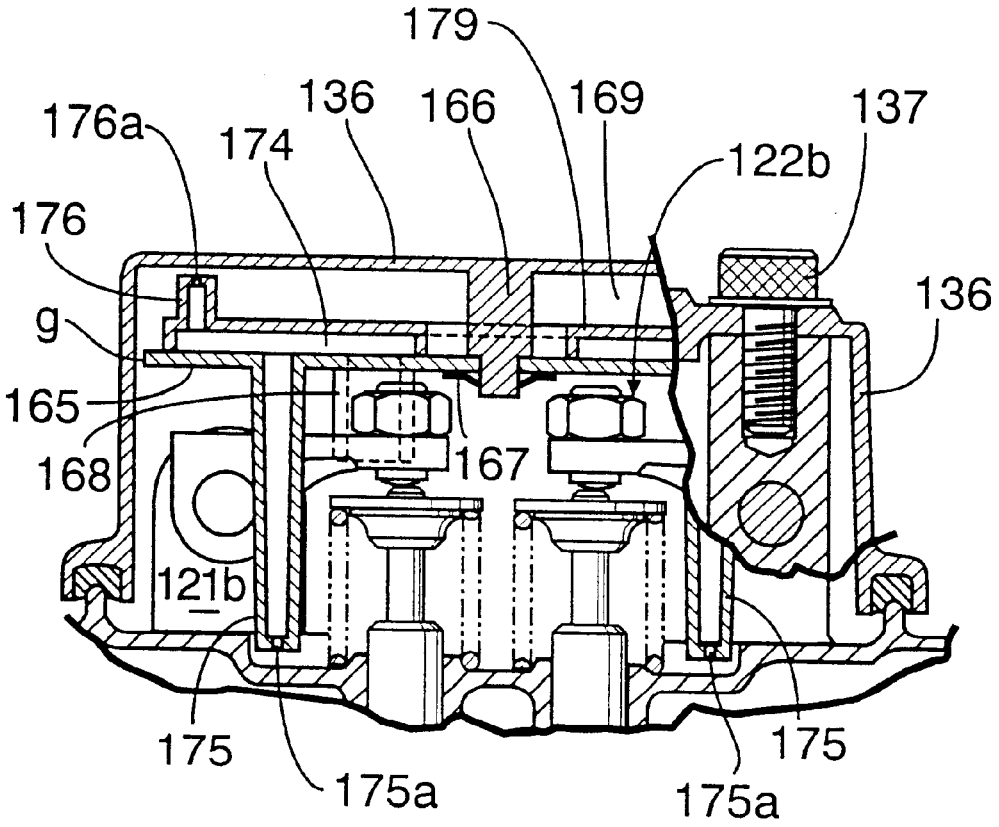

As shown in FIGS. 16, 20 and 21, a circular sealing groove 188*a* corresponding to the above-mentioned sealing bead 187 is formed in the lower end face of a head cover 136, and a linear sealing groove 188*b* linking two sides of the circular groove 188*a* to each other is formed in the inner face of the cover 136. A circular packing 189*a* is fitted in the circular sealing groove 188*a*, and a linear packing 189*b* formed integrally with the circular packing 189*a* is fitted in the linear sealing groove 188*b*. The head cover 136 is joined to the cylinder head 108 by means of a bolt 137 so that the sealing bead 187 and the partition 185 are pressed into contact with the circular packing 189*a* and the linear packing 189*b* respectively.

The belt guide tube 186 and one half of the head cover 136 form a first valve operation chamber 121*a*, the cylinder head 108 and the other half of the head cover 136 form a second valve operation chamber 121*b*, and the two valve operation chambers 121*a* and 121*b* are divided by the above-mentioned partition 185.

Referring again to FIGS. 12 to 15, the engine main body 101 and the oil tank 140 are divided into an upper block Ba and a lower block Bb on a plane which includes the axis of the crankshaft 113 and is perpendicular to the axis of the cylinder bore 107*a*. That is, the upper block Ba integrally includes the upper half of the crankcase 106, the cylinder block 107, the cylinder head 108, the upper half of the oil tank 140 and the belt guide tube 186. The lower block Bb integrally includes the lower half of the crankcase 106 and the lower half of the oil tank 140. These upper and lower blocks Ba and Bb are cast individually, and joined to each other by means of a plurality of bolts 112 (see FIG. 14) after each part has been machined.

An intake valve 118*i* and an exhaust valve 118*e* for opening and closing the intake port 109 and the exhaust port 110 respectively are provided in the cylinder head 108 so as to be parallel to the axis of the cylinder bore 107*a*, and a spark plug 120 is screwed in so that the electrodes thereof are close to the central area of the combustion chamber 108*a*.

A valve operation mechanism 122 for opening and closing the above-mentioned intake valve 118*i* and exhaust valve 118*e* is explained below by reference to FIGS. 13 to 17.

The valve operation mechanism 122 includes a wrap-around type timing transmission 122*a* that runs from the inside of the oil tank 140 to the first valve operation chamber 121*a*, and a cam system 122*b* that runs from the first valve operation chamber 121*a* to a second valve operation chamber 121*b*.

The wrap-around type timing transmission 122*a* includes a drive pulley 123 fixed to the crankshaft 113 inside the oil tank 140, a driven pulley 124 rotatably supported in the upper part of the belt guide tube 186, and a timing belt 125 wrapped around these drive and driven pulleys 123 and 124. On the side of the partition 185, the end face of the driven pulley 124 is joined integrally to a cam 126 which forms a part of the cam system 122*b*. The drive and driven pulleys 123 and 124 are toothed, and the drive pulley 123 drives the driven pulley 124 via the belt 125 at a reduction rate of ½.

A support wall 127 is formed integrally with the outside wall of the belt guide tube 186, the support wall 127 rising inside the circular sealing bead 187 and being in contact with or in the vicinity of the inner face of the head cover 136. A through hole 128*a* and a bottomed hole 128*b* arranged coaxially above the sealing bead 187 are provided in the support wall 127 and the partition 185 respectively. Both ends of a support shaft 129 are rotatably supported by the through hole 128*a* and the bottomed hole 128*b*, and the above-mentioned driven pulley 124 and the cam 126 are rotatably supported on the middle part of the support shaft 129. Before the head cover 136 is attached, the support shaft 129 is inserted from the through hole 128*a* into a shaft hole 135 of the driven pulley 124 and the cam 126, and into the bottomed hole 126*b*. After the insertion, the head cover 136 is joined to the cylinder head 108 and the belt guide tube 186, so that the inner face of the head cover 136 sits opposite the outer end of the support shaft 129 so functioning as a stopper for preventing the shaft 129 from falling out of the through hole 128*a*, and the bottom of the bottomed hole 128*b* restricts inward movement of the shaft 129. The support shaft 129 is thus restricted in its inward and outward movement in the axial direction.

It is therefore unnecessary to provide a special stopper member for the support shaft 129, the support shaft 129 can be lubricated inside the head cover 136, oil leakage can be prevented by an oil-tight joint between the head cover 136 and the cylinder head 108, and it is thus unnecessary to attach a special sealing member to the support shaft 129 so reducing the number of parts and the cost. Furthermore, the support wall 127 rising inside the sealing bead 187 has the through hole 128*a* at a higher position than that of the sealing bead 187, the head cover 136 is formed so that the inner face of the head cover 136 is in contact with or in the vicinity of the outer face of the support wall 127, and the head cover 136 can thus be made more compact while enabling the support shaft 129 to be detachable before attaching to the head cover 136.

A pair of bearing bosses 130*i* and 130*e* projecting parallel to the support shaft 129 are formed integrally with the partition 185 on the side of the second valve operation chamber 121*b*. The cam system 122*b* includes the above-mentioned cam 126; an intake rocker shaft 131*i* and an exhaust rocker shaft 131*e* rotatably supported in the above-mentioned bearing bosses 130*i* and 130*e* respectively; an intake cam follower 132*i* and an exhaust cam follower 132*e* fixed to one end of the rocker shafts 133*i* and 133*e* respectively inside the first valve operation chamber 121*a*, the forward end of each of the intake cam follower 132*i* and the exhaust cam follower 132*e* being in sliding contact with the lower face of the cam 126; an intake rocker arm 133*i* and an exhaust rocker arm 133*e* fixed to the other end of the intake and exhaust rocker shafts 133*i* and 133*e* respectively inside the second valve operation chamber 121*b*, the forward end of each of the intake rocker arm 133*i* and the exhaust rocker arm 133*e* being in contact with the upper end of each of the intake valve 118*i* and the exhaust valve 118*e*; and an intake spring 134*i* and an exhaust spring 134*e* mounted on the intake valve 118*i* and the exhaust valve 118*e* respectively and forcing them in the closing direction.

When the crankshaft 113 rotates, the drive pulley 123 rotating together with the crankshaft 113 rotates the driven pulley 124 and the cam 126 via the belt 125, the cam 126 then rocks the intake and exhaust cam followers 132*i* and 132*e* with appropriate timing, the rocking movements are transmitted to the intake and exhaust rocker arms 133*i* and 133*e* via the corresponding rocker shafts 131*i* and 131*e*, and the intake and exhaust rocker arms 133*i* and 133*e* so rocked can open and close the intake and exhaust valves 118*i* and 118*e* with appropriate timing while co-operatively working with the intake and exhaust springs 134*i* and 134*e*.

In the timing transmission 122*a*, since the driven pulley 124 and the cam 126 are rotatably supported by the support shaft 129 and the support shaft 129 is also rotatably supported in both side walls of the first valve operation chamber 121*a*, the support shaft 129 rotates due to frictional drag during rotation of the driven pulley 124 and the cam 126, the difference in rotational rate between the support shaft 129 and the driven pulley 124 and the cam 126 decreases and abrasion of the rotating and sliding areas can be suppressed. The durability of the cam 126 and the support shaft 129 can therefore be enhanced without employing any special material or surface treatment.

The cam 126 having a comparatively large diameter is placed on one side of the cylinder head 108 together with the driven pulley 124, and only the intake and exhaust rocker arms 133*i* and 133*e* and the intake and exhaust rocker shafts 131*i* and 131*e* having a comparatively small diameter are placed immediately above the cylinder head 108. The valve operation mechanism 122 therefore does not occupy a large volume above the cylinder head 108, and it is possible to reduce the total height of the engine E thus making the engine E more compact.

Furthermore, the support shaft 129 and the intake and exhaust rocker shafts 131*i* and 131*e* are positioned at a higher position than that of the line of circular sealing bead 187 at the upper end of the cylinder head 108 and the belt guide tube 186, it is therefore possible to assemble and disassemble the support shaft 129 and the intake and exhaust rocker shafts 131*i* and 131*e* above the sealing bead 187 without any obstruction therefrom in a state in which the head cover 136 is removed, and the ease of assembly and maintenance is extremely high.

The lubrication system of the above-mentioned engine E is explained below by reference to FIGS. 13 to 22.

Figure 14:
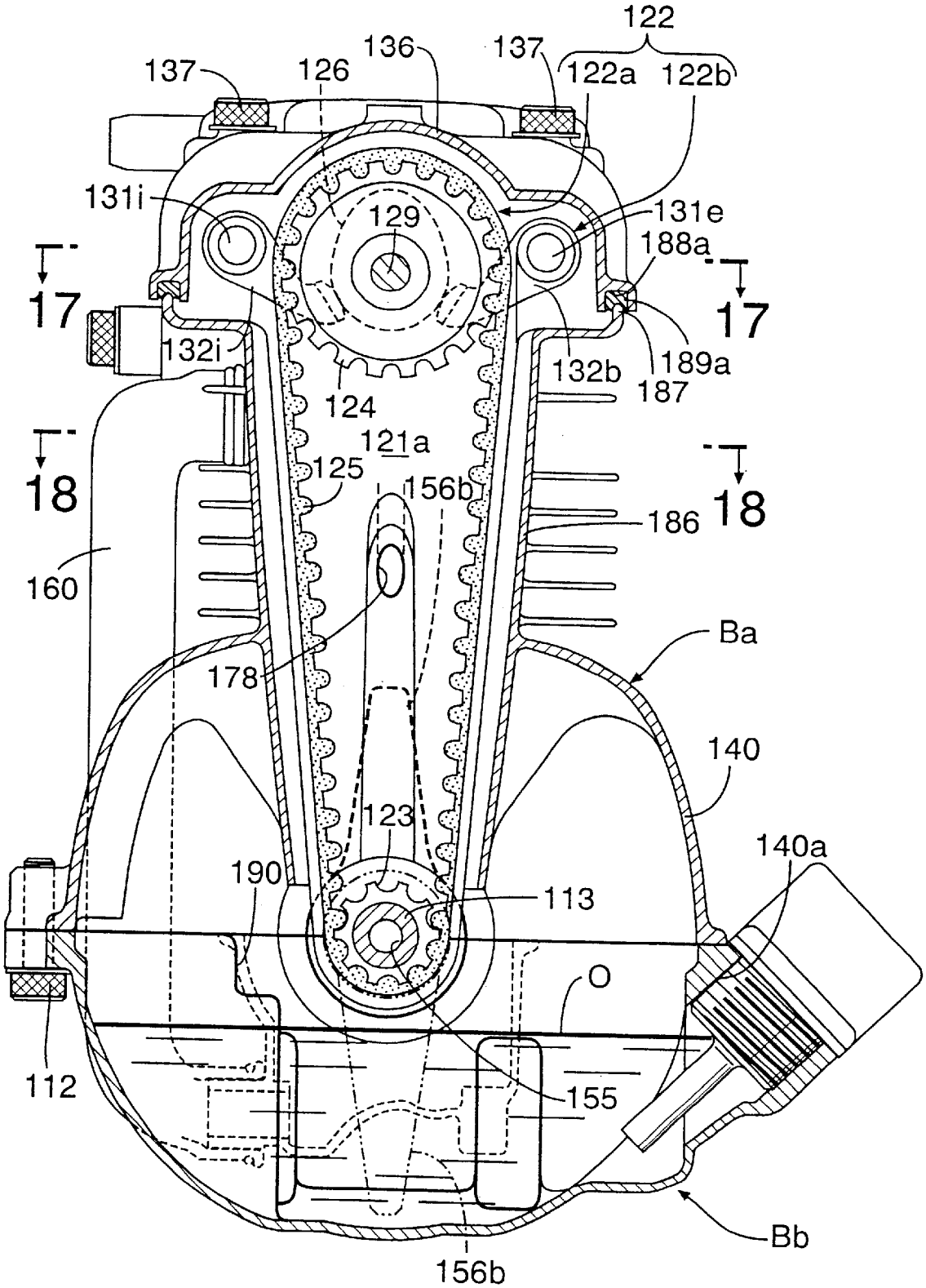
Figure 15:
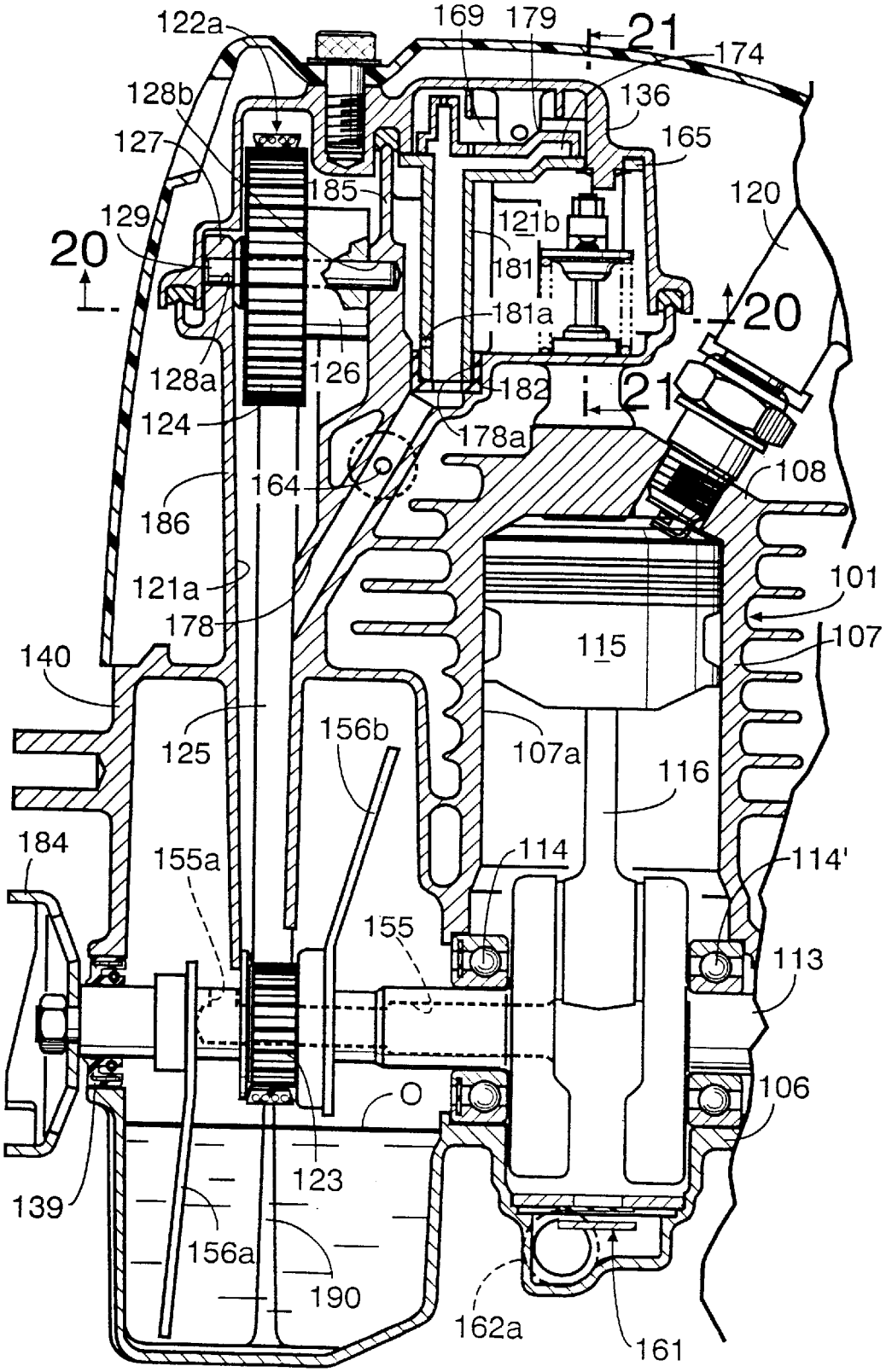

As shown in FIGS. 14 and 15, the oil tank 140 stores a predetermined amount of lubricating oil O poured in through an oil inlet 140*a*. Inside the oil tank 140, a pair of oil slingers 156*a* and 156*b* arranged on either side of the drive pulley 123 in the axial direction are press-fitted, etc. onto the crankshaft 113. These oil slingers 156*a* and 156*b* extend in directions radially opposite to each other and the forward ends thereof are bent so as to move away from each other in the axial direction so that when the oil slingers 156*a* and 156*b* are rotated by the crankshaft 113, at least one of the oil slingers 156*a* and 156*b* stirs and scatters the oil O stored inside the oil tank 140 so generating an oil mist regardless of the operational position of the engine E. In this case, the oil mist is sprinkled over a part of the timing transmission 122*a* which extends into the oil tank 140 from the first valve operation chamber 121*a*, or the oil mist enters the first valve operation chamber 121*a*, and the timing transmission 122*a* can thus be lubricated directly and this provides one lubrication system.

Another lubrication system includes, as shown in FIGS. 13 to 15 and 22, a through hole 155 provided in the crankshaft 113 so as to provide communication between the inside of the oil tank 140 and the crank chamber 106*a*; an oil feed pipe 160 provided outside the engine main body 101 so as to connect the lower part of the crank chamber 106*a* to the lower part of the second valve operation chamber 121*b*; an oil recovery chamber 174 provided in the cylinder head 108 in order to draw up liquefied oil residing in the second valve operation chamber 121*b*; an oil return passage 178 formed between the cylinder head 108 and the oil tank 140 so as to provide communication between the oil recovery chamber 174 and the oil tank 140 via the first valve operation chamber 121*a*; and a one-way valve 161 provided in the lower part of the crank chamber 106*a* and allowing the flow of oil mist only in the direction from the crank chamber 106*a* to the oil feed pipe 160.

An open end 155*a* of the above-mentioned through hole 155 inside the oil tank 140 is positioned in the central part or the vicinity thereof inside the tank 140 so that the open end 155*a* is always above the liquid level of the oil O inside the oil tank regardless of the operational position of the engine E. The drive pulley 123 and one of the oil slingers 156*a* are fixed to the crankshaft 113 with the open end 155*a* located therebetween so as not to block the open end 155*a*.

The above-mentioned one-way valve 161 (see FIG. 13) includes a reed valve in the illustrated embodiment, closes when the pressure of the crank chamber 106*a* becomes negative accompanying the reciprocating motion of the piston 115 and opens when the pressure becomes positive.

Figure 18:
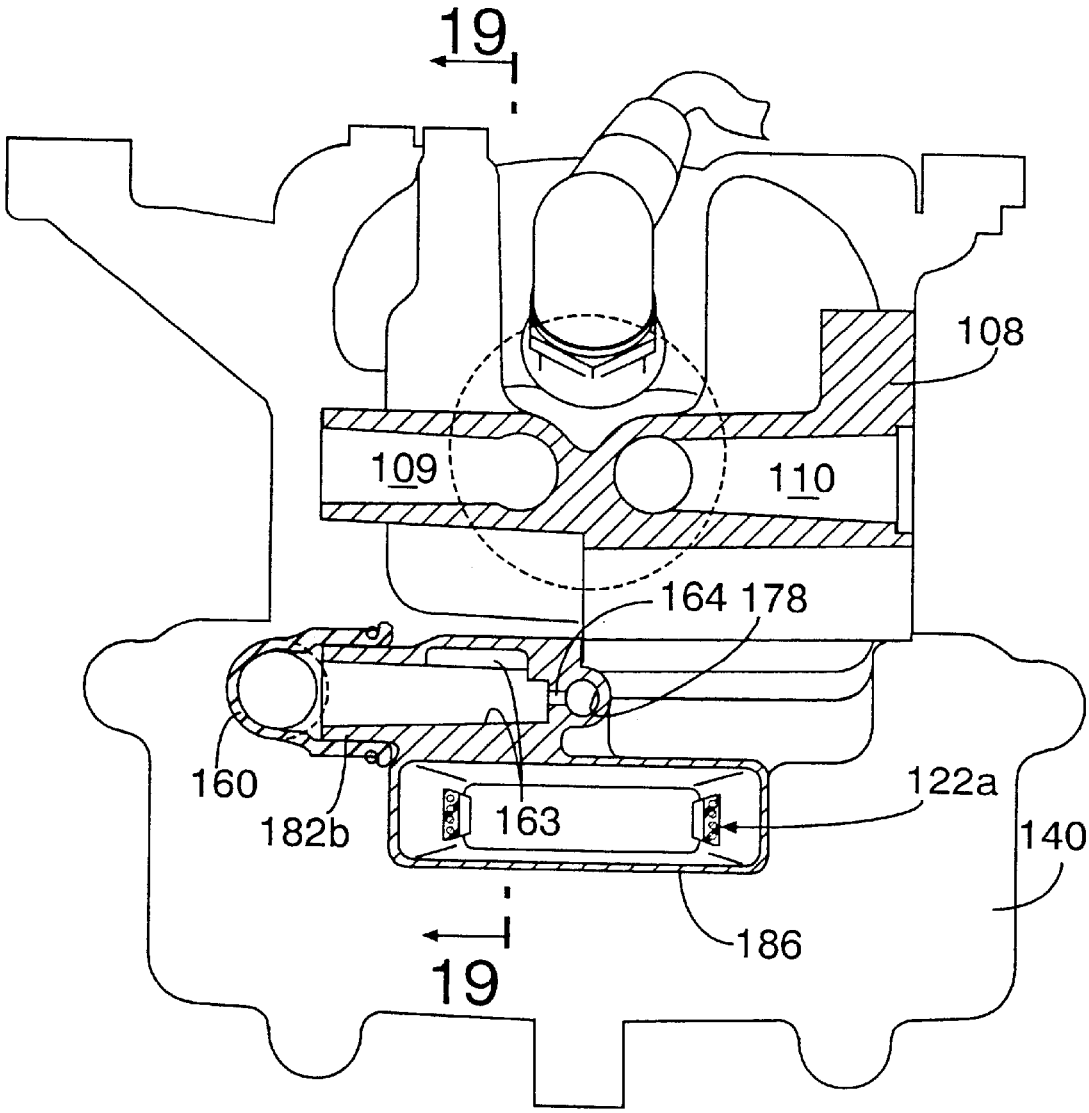
Figure 19:
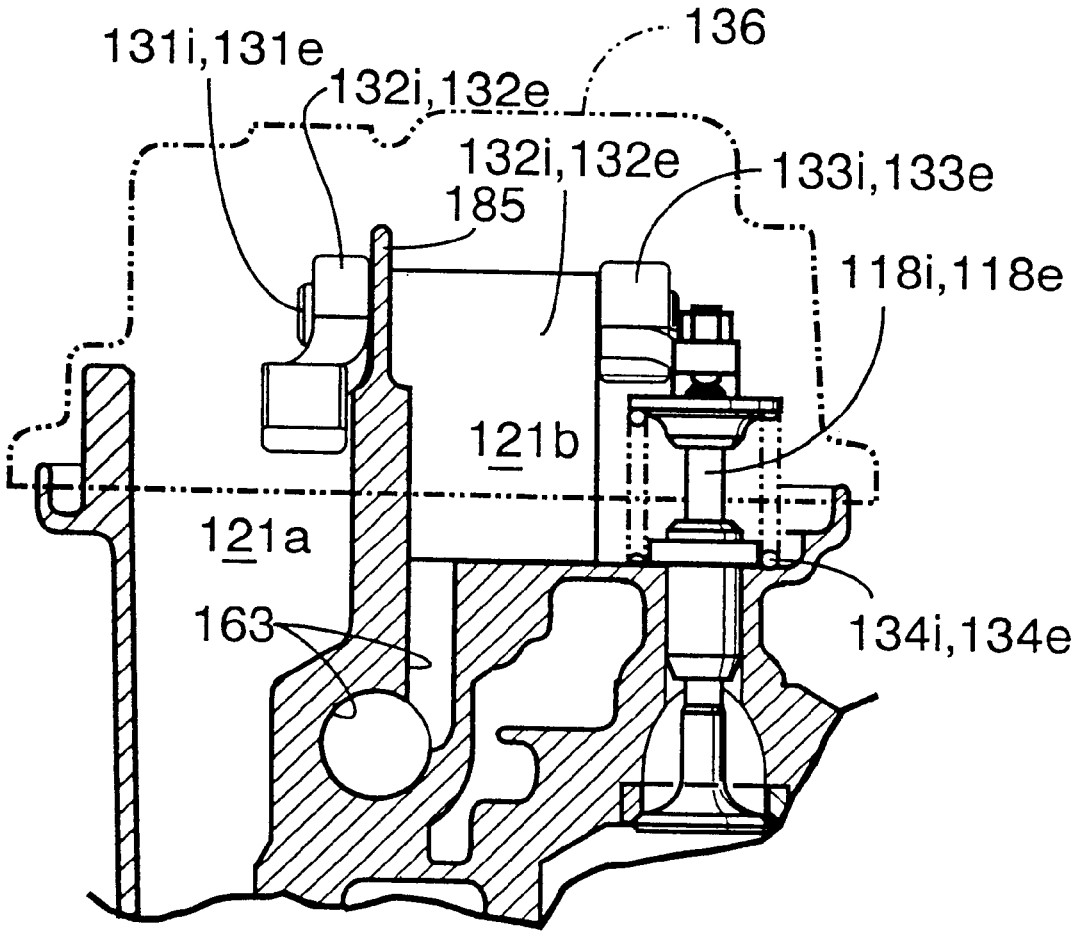

The lower end of the oil feed pipe 160 is connected by fitting it onto a lower connection pipe 162*a* provided so as to project out of the outer face of the crankcase 106 (see FIG. 13), and the upper end of the oil feel pipe 160 is connected by fitting it onto an upper connection pipe 182*b* provided so as to project out of the outer face of the cylinder head 108 (see FIGS. 14 and 18). The inside of the upper connection pipe 182*b* is communicated with the lower part of the second valve operation chamber 121*b* on one side via a link passage 163 (see FIGS. 18 and 19) formed in the cylinder head 108 and having large dimensions and is communicated with the oil return passage 178 on the other side via a bypass 164 having orifices (see FIG. 18).

As shown in FIGS. 15, 20 and 21, a partition plate 165 defining a breather chamber 169 in the upper part of the head cover 136 is fitted to the roof of the cover 136 by means of a plurality of support stays 166 and clips 167 fastened to the support stays 166, the support stays 166 provided so as to project from the roof. The breather chamber 169 is communicated with the second valve operation chamber 121*b* on one side via a communication pipe 168 and a gap g between the inner face of the head cover 136 and the partition plate 165, the communication pipe 168, which has large dimensions, is formed integrally with the partition plate 165 and projects towards the second valve operation chamber 121*b*. The breather chamber 169 is also communicated with the inside of the above-mentioned air cleaner 104 on the other side via a breather pipe 170. In the breather chamber 169, a mixture of oil and blowby gas is separated into gas and liquid, and a labyrinth wall 172 for promoting the gas-liquid separation is provided so as to project out of the inner face of the roof of the head cover 136.

Welded to the partition plate 165 is a box-shaped partition 179 having one open face and T-shape when viewed from above, the box-shaped partition 179 forming the above-mentioned oil recovery chamber 174 in the space on the upper face of the partition plate 165, and the oil recovery chamber 174 is therefore also T-shaped.

Two suction pipes 175 are formed integrally with the partition plate 165 so as to project therefrom, the two suction pipes 175 being communicated with the two ends respectively of the lateral bar of the T-shaped oil recovery chamber 174. The forward end of each of the suction pipes 175 extends towards the vicinity of the base of the second valve operation chamber 121*b*, and an opening in the tip of each of the suction pipes 175 forms an orifice 175*a*.

Three suction pipes 176 are provided integrally with the upper wall of the partition plate 179 so as to project therefrom, the three suction pipes 176 being communicated with three positions corresponding to the tips of the lateral and longitudinal bars of the T-shape of the oil recovery chamber 174. Each of the tips of these suction pipes 176 extends towards the vicinity of the roof of the breather chamber 169, and an opening in the tip of each of the suction pipes 176 forms an orifice 176*a*.

Furthermore, an orifice 180 is provided in the upper wall of the partition box 179, the orifice 180 providing communication between an indentation 179*a* in the upper face of the partition box 179 and the oil recovery chamber 174.

Moreover, one pipe 181 communicated with an area corresponding to the tip of the longitudinal bar of the T-shape of the oil recovery chamber 174 is provided integrally with the partition plate 165. The tip of the pipe 181 is fitted into an inlet 178*a* of the above-mentioned oil return passage 178 via a grommet 182, the inlet 178*a* opening onto the base of the second valve operation chamber 121*b*. The oil recovery chamber 174 is thus connected to the oil return passage 178. The above-mentioned pipe 181 is placed close to an inner face of the second valve operation chamber 121*b*, and an orifice 181*a* for drawing up oil is provided in the area close to the above-mentioned inner face, the orifice 181*a* providing communication between the second valve operation chamber 121*b* and the pipe 181.

Since the breather chamber 169 is communicated with the inside of the air cleaner 104 via the breather pipe 170, the pressure of the breather chamber 169 is generally maintained at atmospheric pressure even during operation of the engine E, and the pressure of the second valve operation chamber 121*b* communicated with the breather chamber 169 via the communication pipe pipe 168 having a low flow resistance is generally the same as that of the breather chamber 169.

Since the crank chamber 106*a* discharges only the positive pressure component of the pressure pulsations caused by the ascending and descending motion of the piston 115 into the oil feed pipe 160 through the one-way valve 161 during operation of the engine E, the pressure of the crank chamber 106*a* is negative on average, and since the second valve operation chamber 121*b* receiving the above-mentioned positive pressure is communicated with the breather chamber 169 via the communication pipe 168 having a small flow resistance, the pressure of the second valve operation chamber 121*b* is almost the same as that of the breather chamber 169. Since the negative pressure of the crank chamber 106*a* is transmitted to the oil tank 140 via the through hole 155 of the crankshaft 113 and further to the oil recovery chamber 174 via the oil return passage 178, the pressure of the oil recovery chamber 174 is lower than that of the second valve operation chamber 121*b* and the breather chamber 169, and the pressures of the oil tank 140 and the first valve operation chamber 121*a* are lower than that of the oil recovery chamber 174.

Figure 22:
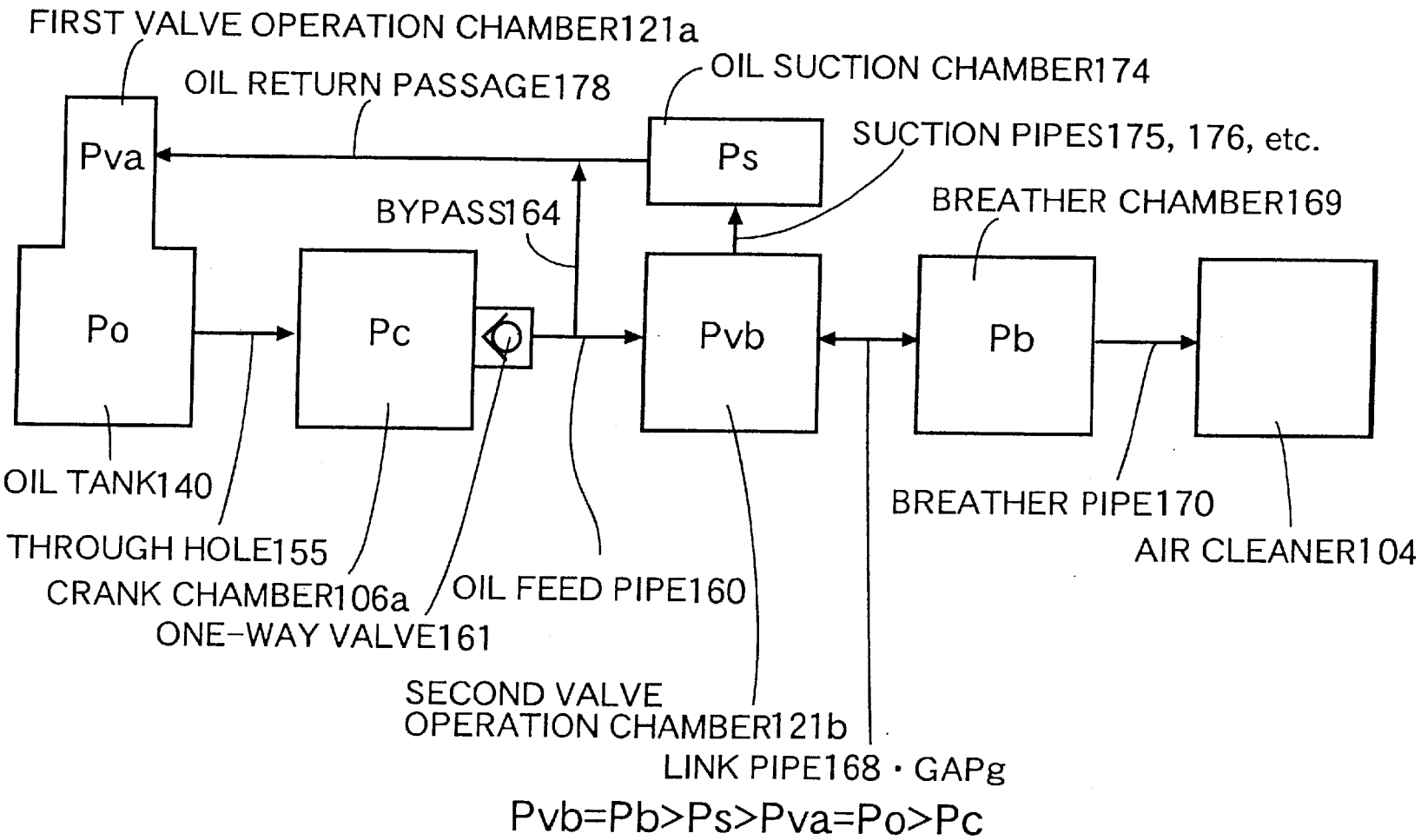

As shown in FIG. 22, when the pressure of the crank chamber 106*a* is denoted by Pc, the pressure of the oil tank 140 is denoted by Po, the pressure of the first valve operation chamber 121*a* is denoted by Pva, the pressure of the second valve operation chamber 121*b* is denoted by Pvb, the pressure of the oil recovery chamber 174 is denoted by Ps, and the pressure of the breather chamber 169 is denoted by Pb, the following relationship can therefore be satisfied.

$$Pvb=Pb>Ps>Po=Pva>Pc$$

As a result, the pressures of the second valve operation chamber 121*b* and the breather chamber 169 are transferred to the oil recovery chamber 174 via the suction pipes 175 and 176 and the orifice 180, further to the oil tank 140 via the oil return passage 178, and then to the crank chamber 106*a*.

Oil mist is generated by the oil slingers 156*a* and 156*b* stirring and scattering the lubricating oil O inside the oil tank 140 during operation of the engine E, the oil slingers 156*a* and 156*b* being rotated by the crankshaft 113. As described above, the oil mist so generated is sprinkled over a part of the timing transmission 122*a* exposed inside the oil tank 140 from the belt guide tube 186, that is, over the drive pulley 123 and part of the timing belt 125, or the oil mist enters the first valve operation chamber 121*a*, and the timing transmission 122*a* is thus lubricated directly. When the oil droplets are sprinkled over even a part of the timing transmission 122*a*, the oil is transferred not only to the entire transmission 122*a* but also to the cam 126 due to operation of the timing transmission 122*a* so lubricating them effectively.

The oil mist generated in the oil tank 140 is drawn into the crank chamber 106*a* via the through hole 155 of the crankshaft 113 along the direction of the above-mentioned pressure flow so lubricating the area around the crankshaft 113 and the piston 115. When the pressure of the crank chamber 106*a* becomes positive due to the piston 115 descending, the one-way valve 161 opens and the above-mentioned oil mist together with the blowby gas generated in the crank chamber 106*a* ascend through the oil feed pipe 160 and the link passage 163, and are supplied to the second valve operation chamber 121*b* so lubricating each part of the cam system 122*b* inside the chamber 121*b*, that is, the intake and exhaust rocker arms 133*i* and 133*e*, etc.

In this case, a portion of the oil mist passing through the above-mentioned link passage 163 is shunted to the oil return passage 178 via the hole-shaped bypass 164. It is therefore possible to control the amount of oil mist supplied to the second valve operation chamber 121*b* by setting the flow resistance of the bypass 164 appropriately.

The oil mist and the blowby gas inside the second valve operation chamber 121*b* are separated into gas and liquid by expansion and collision with the labyrinth wall 172 while being transferred to the breather chamber 169 through the communication pipe 168 and the gap g around the partition plate 165, and the blowby gas is taken into the engine E via the breather pipe 170 and the air cleaner 104 in that order during the intake stroke of the engine E.

Since, when the engine E is in an upright state, the oil liquefied in the breather chamber 169 resides in the indentation 179*a* in the upper face of the partition box 179 or flows down the communication pipe 168 or through the gap g to reside on the base of the second valve operation chamber 121*b*, the oil is drawn up into the oil recovery chamber 174 by means of the orifice 180 or the suction pipe 175 provided there. Since, when the engine E is in an upside down state, the above-mentioned liquefied oil resides on the roof of the head cover 136, the oil is drawn up into the oil recovery chamber 174 by means of the suction pipe 176 provided there.

The oil thus drawn up into the oil recovery chamber 174 returns to the oil tank 140 via the pipe 181 and the oil return passage 178. In this case, when the oil return passage 178 is communicated with the oil tank 140 via the first valve operation chamber 121*a* as in the illustrated embodiment, the oil discharged from the oil return passage 178 is sprinkled over the timing transmission 122*a*, so conveniently lubricating it.

Since the above-mentioned breather chamber 169 is defined between the roof of the head cover 136 and the partition plate 165 attached to the inner wall of the head cover 136 and the above-mentioned oil recovery chamber 174 is defined between the upper face of the above-mentioned partition plate 165 and the partition box 179 welded to the partition plate 165, the oil recovery chamber 174 and the breather chamber 169 can be provided in the head cover 136 without dividing the roof of the head cover 136. Moreover, since the breather chamber 169 and the oil recovery chamber 174 are present inside the head cover 136, even if some oil leaks from either of the chambers 169 and 174, the oil simply returns to the second valve operation chamber 121*b* without causing any problems, it is unnecessary to check whether the two chambers 169 and 174 are oil tight and the production cost can thus be reduced.

Since the partition box 179 can be welded to the partition plate 165 before attaching the partition plate 165 to the head cover 136, the oil recovery chamber 174 can easily be formed in the partition plate 165.

Since the oil suction pipes 175 and 176 are formed integrally with the partition plate 165 and the partition box 179 respectively, the oil suction pipes 175 and 176 can easily be formed.

Figure 23:
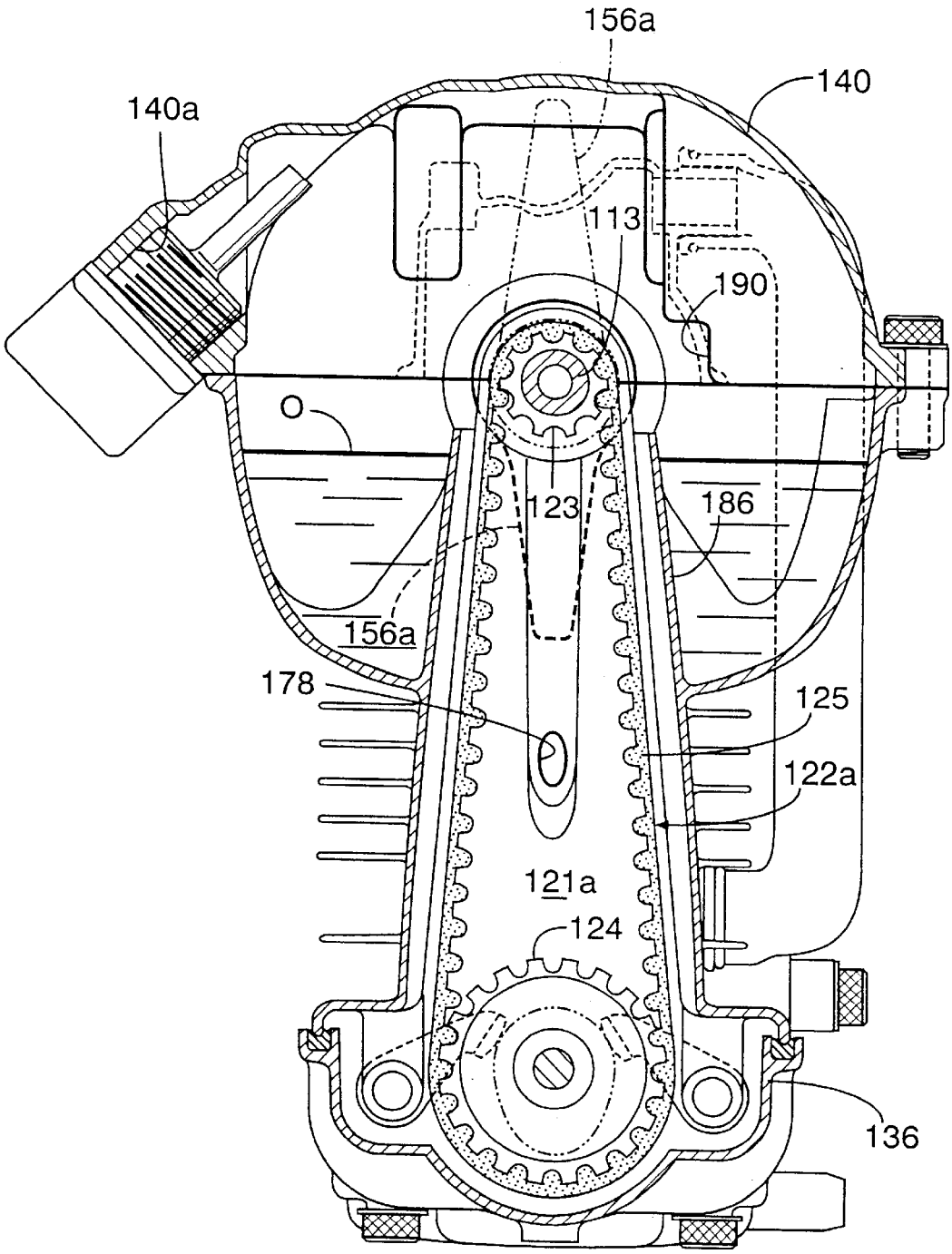

When the engine E is in an upside down state as shown in FIG. 23, the oil O stored in the oil tank 140 moves towards the roof of the tank 140, that is, the side of the first valve operation chamber 121*a*. Since the open end of the first valve operation chamber 121*a* inside the oil tank 140 is set so as to be at a higher level than the liquid level of the stored oil O by means of the belt guide tube 186, the stored oil O is prevented from entering the second valve operation chamber 121*b*, and it is possible to prevent excess oil from being supplied to the timing transmission 122*a* and maintain a predetermined amount of oil inside the oil tank 140 so allowing the oil slingers 156*a* and 156*b* to continuously generate oil mist.

Figure 24:
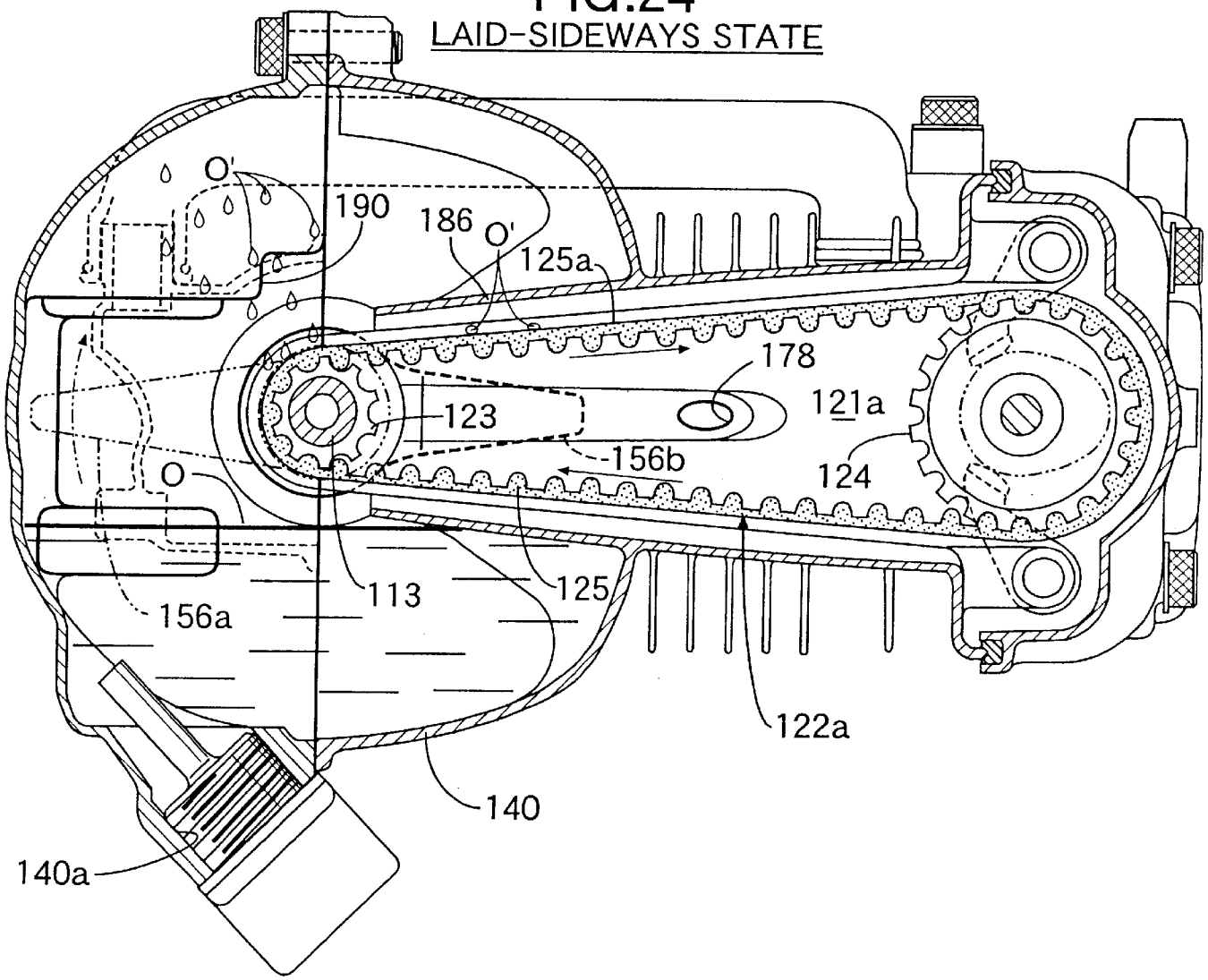

When the engine E is laid on its side as shown in FIG. 24 during its operation, the stored oil O moves towards the side face of the oil tank 140, however, since the open end of the first valve operation chamber 121*a* inside the oil tank 140 is set so as to be at a higher level than the liquid level of the stored oil O by means of the belt guide tube 186, the stored oil O is prevented from entering the second valve operation chamber 121*b*, and it is possible to prevent excess oil from being supplied to the timing transmission 122*a*, and maintain a predetermined amount of oil inside the oil tank 140 so allowing the oil slingers 156*a* and 156*b* to continuously generate oil mist.

An oil droplet guide wall 190 (see FIGS. 15 and 24) is provided integrally with the oil tank 140 so as to project out from the inner wall of the oil tank 140, the oil droplet guide wall 190 facing the upper side 125*a* of the timing belt 125 of the timing transmission 122*a* as it moves from the drive side to the driven side around the drive pulley 123.

As a result, in the case where the engine E is laid on its side and the upper side 25*a* of the timing belt 125 substantially moves horizontally from the drive side to the driven side, even when the oil O stored inside the oil tank 140 is present beneath the timing belt 125, a portion of the oil mist generated by the rotation of the oil slingers 156*a* and 156*b* attach to the oil droplet guide wall 190, the oil aggregates to form oil droplets O' which fall down onto the upper part of the timing belt 125 on the drive side, the oil droplets O' are carried on the upper side 125*a* of the timing belt 125 to the side of the driven pulley 124 while hardly receiving any influence from the centrifugal force, and at the same time the oil droplets O' move around to the back of the upper side 25*a* so lubricating the driven pulley 124 reliably.

In this case, if the oil droplet guide wall 190 is absent, most of the oil mist generated by the oil slingers 156*a* and 156*b* attaches to the lower side of the timing belt 125, the oil droplets are detached from the timing belt 125 due to centrifugal force as the lower side of the timing belt 125 is driven around to the upper side by rotation of the drive pulley 123, and it is difficult for the oil mist to reach the driven side of the timing belt 125.

The lubrication system of the valve operation mechanism 122 can thus be divided into two parts, that is, a part for lubricating portions of the cam system 122*b* and the timing transmission 122*a* inside the first valve operation chamber 121*a* and the oil tank 140 with the oil scattered inside the oil tank 140, and a part for lubricating the rest portions of the cam system 122*b* inside the second valve operation chamber 121*b* with the oil mist transferred to the second valve operation chamber 121*b*. The burden put on each part of the lubrication system can thus be lessened and the entire valve operation mechanism 122 can be lubricated thoroughly. Moreover, each part of the engine E can be lubricated reliably by the use of oil droplets and oil mist regardless of the operational position of the engine E.

Since the oil mist generated inside the oil tank 140 is circulated by utilising the pressure pulsations inside the crank chamber 106*a* and the one-way transfer function of the one-way valve 161, it is unnecessary to employ a special oil pump for circulating the oil mist and the structure can be simplified.

Not only the oil tank 140 but also the oil feed pipe 160 providing communication between the crank chamber 106*a* and the second valve operation chamber 121*b* are provided outside the engine main body 101, and the weight of the engine E can therefore be greatly reduced without interfering with the engine main body 101 being made thinner and more compact. In particular, since the externally placed oil feed pipe 160 is hardly influenced by the heat of the engine main body 101 and easily releases its heat, cooling of the oil mist passing through the oil feed pipe 160 can be promoted.

Furthermore, since the oil tank 140 is placed on one exterior side of the engine main body 101, the total height of the engine E can be greatly reduced, and since a part of the timing transmission 122*a* is housed inside the oil tank 140, any increase in the width of the engine E can be minimised so making the engine E more compact.

Next, a third embodiment of the present invention is explained by reference to FIGS. 25 to 36.

Figure 25:
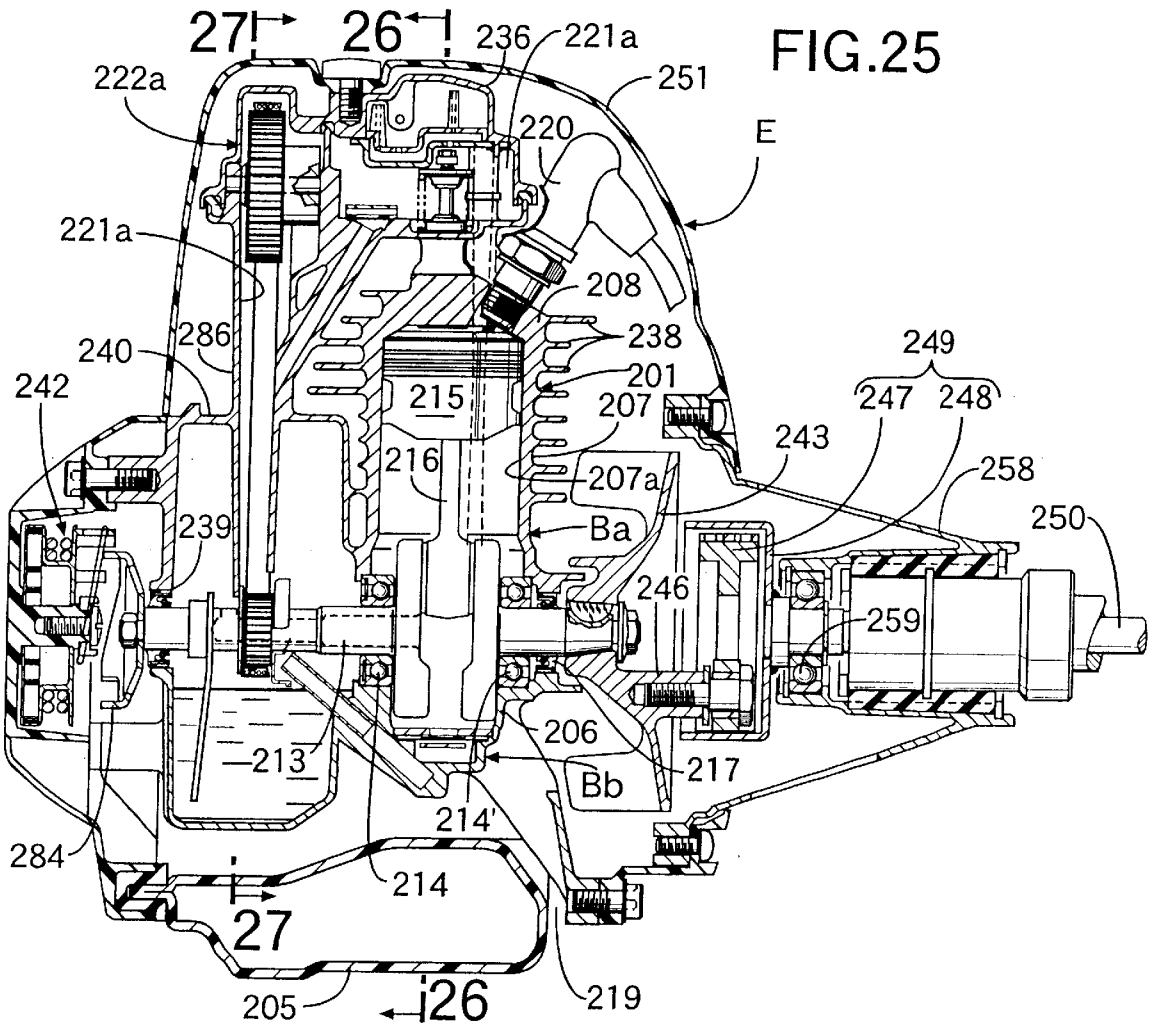
FIGS. 25 to 36 show a third embodiment of the present invention.
Figure 26:
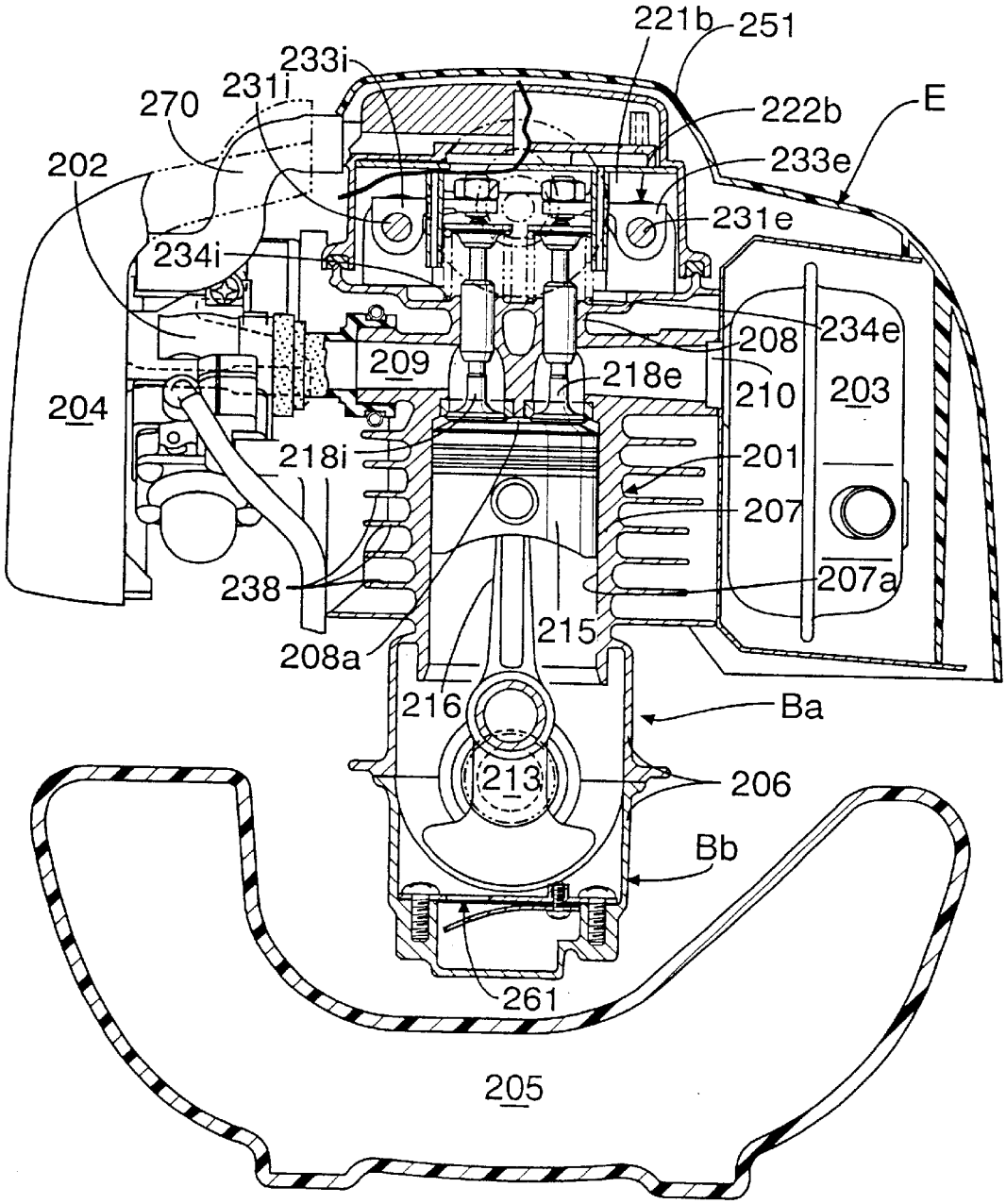

The external structure of the handheld type four-cycle engine E is explained by reference to FIGS. 25 and 26.

A carburettor 202 and an exhaust muffler 203 are attached to the front and back respectively of an engine main body 201 of the above-mentioned handheld type four-cycle engine E, and an air cleaner 204 is attached to the inlet of the carburettor 202. A fuel tank 205 made of a synthetic resin is attached to the lower face of the engine main body 201. The two ends of a crankshaft 213 project out of the engine main body 201 and an oil tank 240 adjacent to one side of the engine main body 201, and a recoil type starter 242 which can be transmittably connected to a driven member 284 fixed to one end of the crankshaft 213 is attached to the outer face of the oil tank 240.

A cooling fan 243 that also functions as a flywheel is fixed to the other end of the crankshaft 213. A plurality of fitting bosses 246 (one thereof is shown in FIG. 25) are formed on the outer face of the cooling fan 243, and a centrifugal shoe 247 is pivotally supported on each of the fitting bosses 246. These centrifugal shoes 247, together with a clutch drum 248 fixed to a drive shaft 250 which will be described below, form a centrifugal clutch 249, and when the rotational rate of the crankshaft 213 exceeds a predetermined value, the centrifugal shoes 247 are pressed onto the inner periphery of the clutch drum 248 due to the centrifugal force of the shoes so transmitting the output torque of the crankshaft 213 to the drive shaft 250. The cooling fan 243 has a larger diameter than that of the centrifugal clutch 249.

An engine cover 251 covering the engine main body 201 and its attachments excluding the fuel tank 240 is fixed at appropriate positions to the engine main body 201, and a cooling air inlet 219 is provided between the engine cover 251 and the fuel tank 205. External air is thus taken in via the cooling air inlet 219 by the cooling fan 243 rotating and supplied for cooling each part of the engine E.

A truncated cone shaped bearing holder 258 coaxially arranged with the crankshaft 213 is fixed to the engine cover 251, and the bearing holder 258 supports the drive shaft 250 which rotates the cutter C of the trimmer T (see FIG. 1) via a bearing 259 in the same way as in the above-mentioned first embodiment.

Since the oil tank 240 and the starter 242 are disposed on one side and the cooling fan 243 and the centrifugal clutch 249 are disposed on the other side with the engine main body 201 placed therebetween, the weight balance of the engine E between the right and left is improved, and the centre of gravity of the engine E can be made closer to the central part of the engine main body 201 so enhancing the handling performance of the engine E.

Furthermore, since the cooling fan 243 having a larger diameter than that of the centrifugal shoes 247 is fixed to the crankshaft 213 between the engine main body 201 and the centrifugal clutch 249, it is possible to avoid any increase in the size of the engine E due to the cooling fan 243.

The structures of the engine main body 201 and the oil tank 240 are explained below by reference to FIGS. 25 to 28, 29, 32 and 33.

In FIGS. 25 to 28, the engine main body 201 includes a crankcase 206 having a crank chamber 206*a*, a cylinder block 207 having one cylinder bore 207*a*, and a cylinder head 208 having a combustion chamber 208*a* and intake and exhaust ports 209 and 210 which open into the combustion chamber 208*a*, and a large number of cooling fins 238 are formed on the outer peripheries of the cylinder block 207 and the cylinder head 208.

The crankshaft 213 housed in the crank chamber 206*a* is supported in the left and right side walls of the crankcase 206 via ball bearings 214 and 214'. In this case, the left-hand ball bearing 214 is equipped with a seal, and an oil seal 217 is provided so as to adjoin the outside of the right-hand ball bearing 214'. A piston 215 fitted in the cylinder bore 207*a* is conventionally connected to the crankshaft 213 via a connecting rod 216 in an ordinary manner.

The oil tank 240 is provided so as to be integrally formed with the left-hand wall of the crankcase 206, and is arranged so that the end of the crankshaft 213 on the side of the sealed ball bearing 214 runs through the oil tank 240. An oil seal 239 through which the crankshaft 213 runs is fitted in the outside wall of the oil tank 240.

A belt guide tube 286 having a flattened cross-section is provided integrally with the roof of the oil tank 240, the belt guide tube 286 running vertically through the roof of the oil tank 240 and having open upper and lower ends. The lower end of the belt guide tube 286 extends towards the vicinity of the crankshaft 213 inside the oil tank 240, and the upper end is provided integrally with the cylinder head 208 so as to share a partition 285 with the cylinder head 208. A line of circular sealing bead 287 is formed around the periphery of the upper end of the belt guide tube 286 and the cylinder head 208, and the partition 285 projects above the sealing bead 287.

Figure 29:
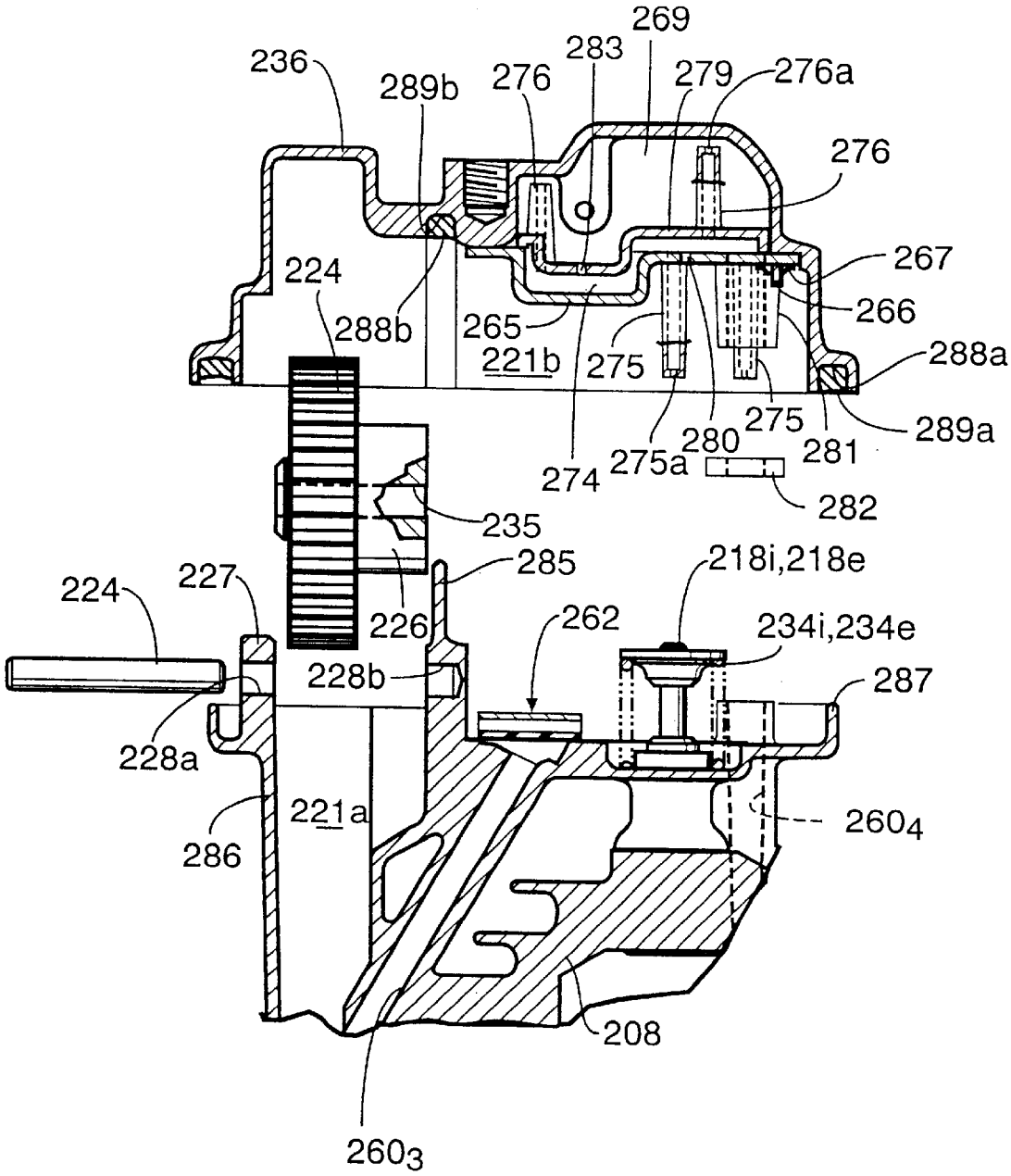
Figure 30:
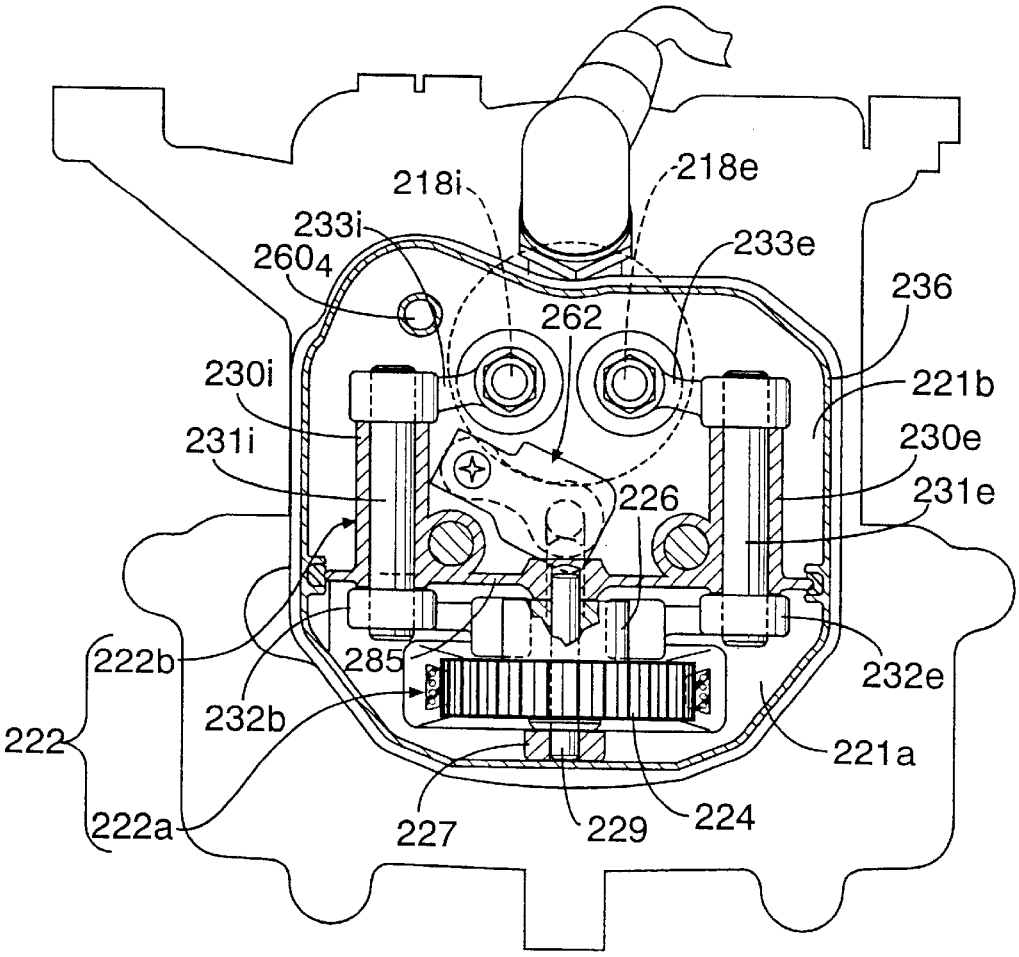
Figure 31:
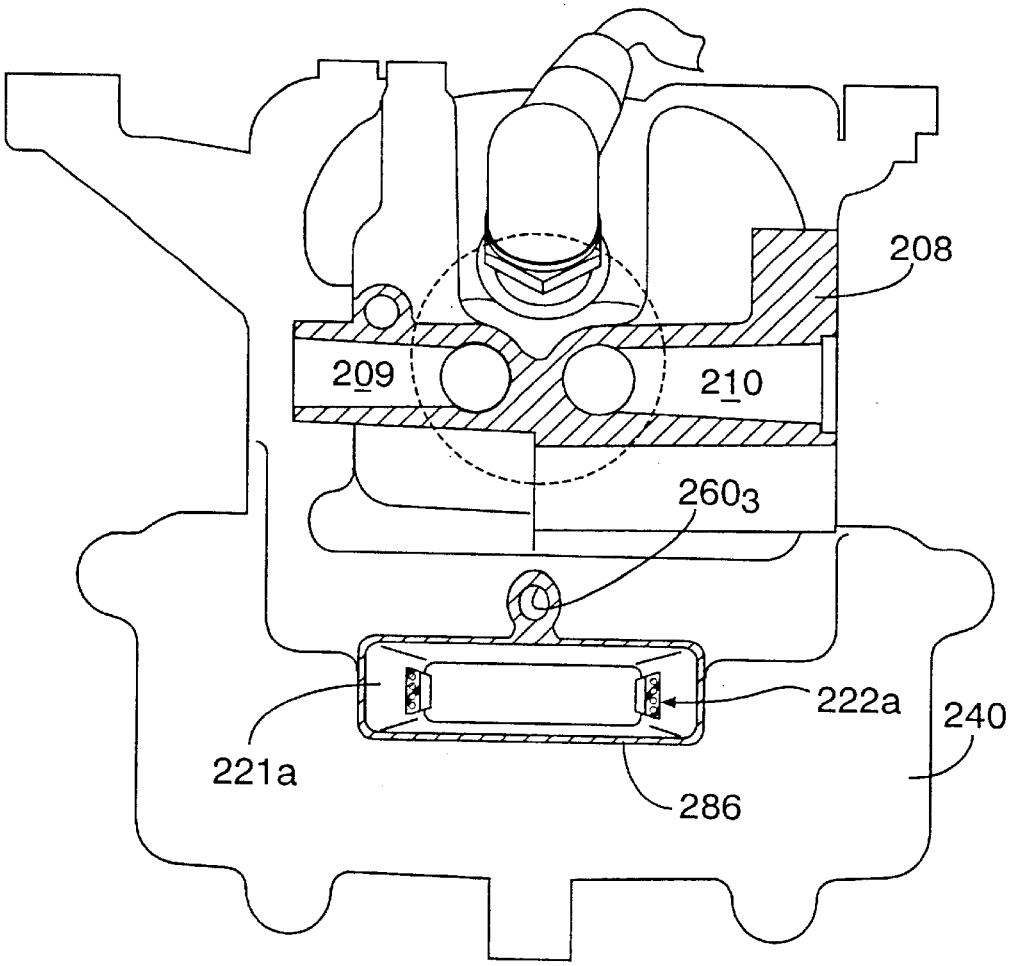
Figure 32:
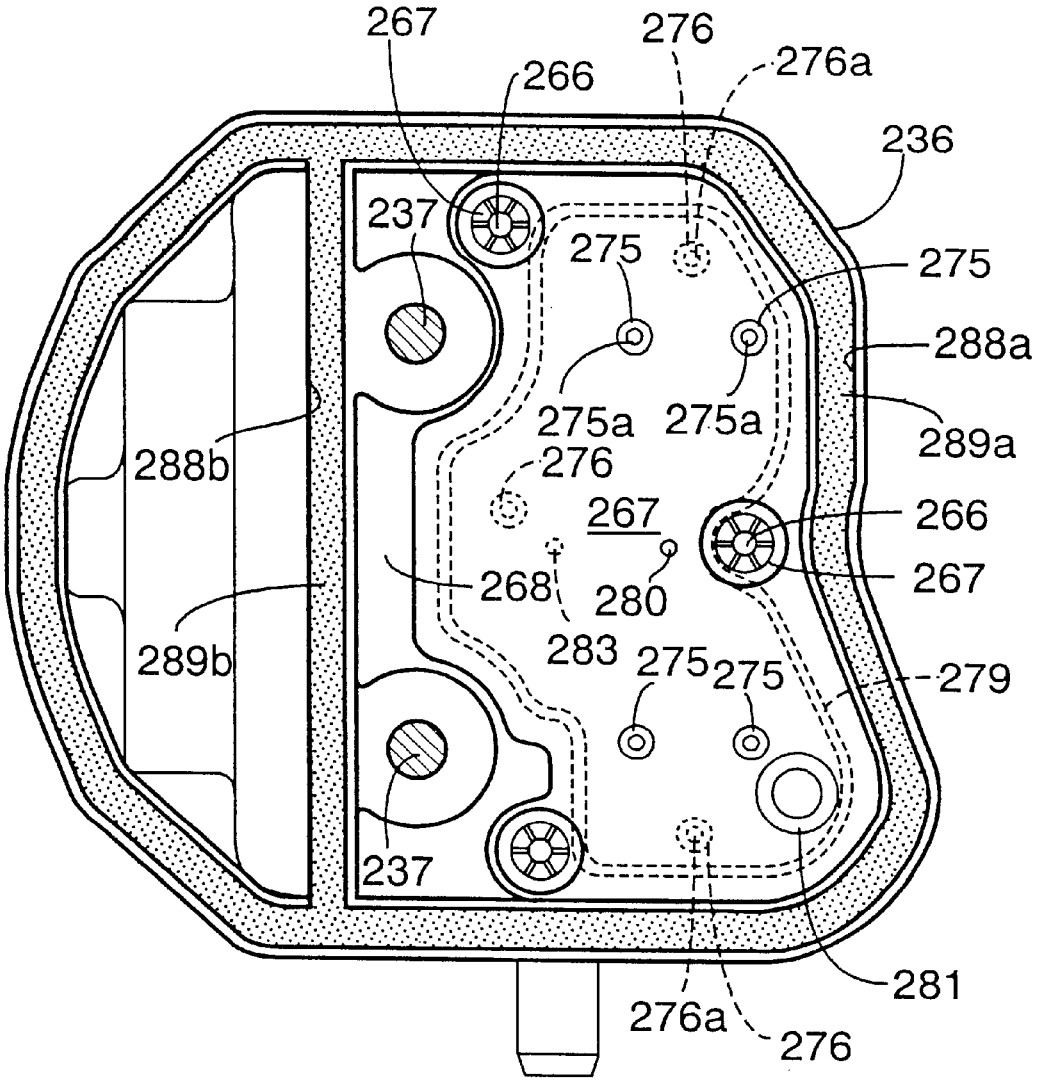
Figure 33:
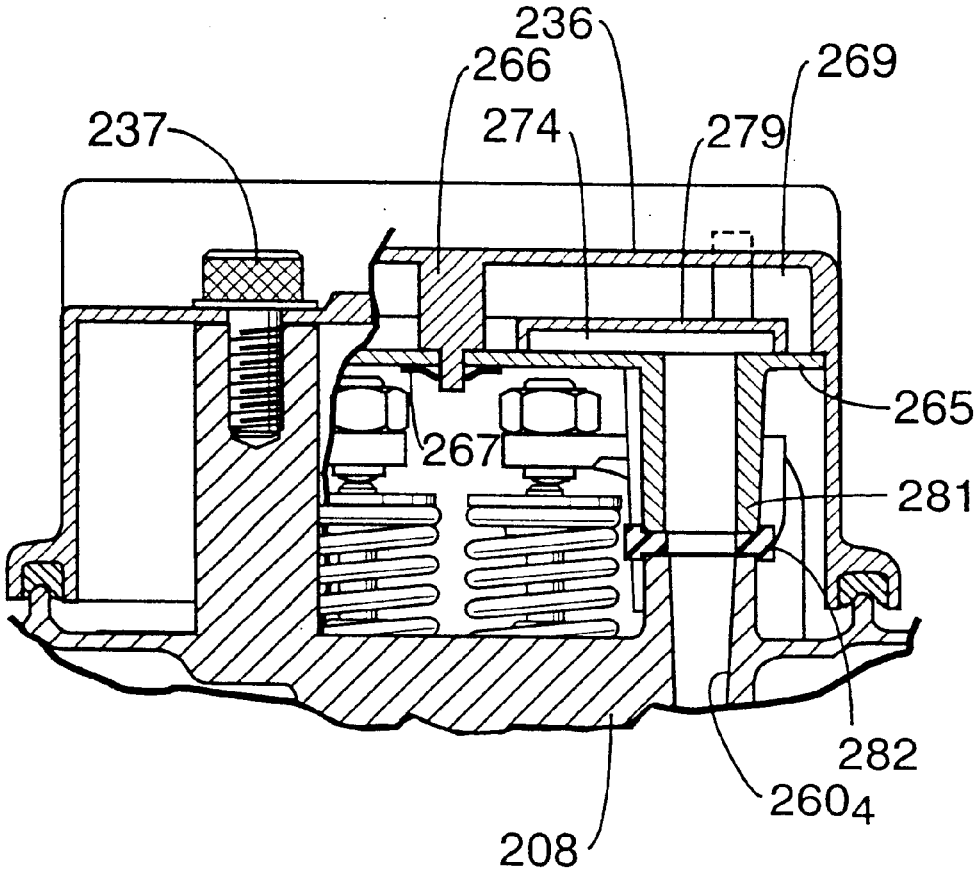
Figure 34:
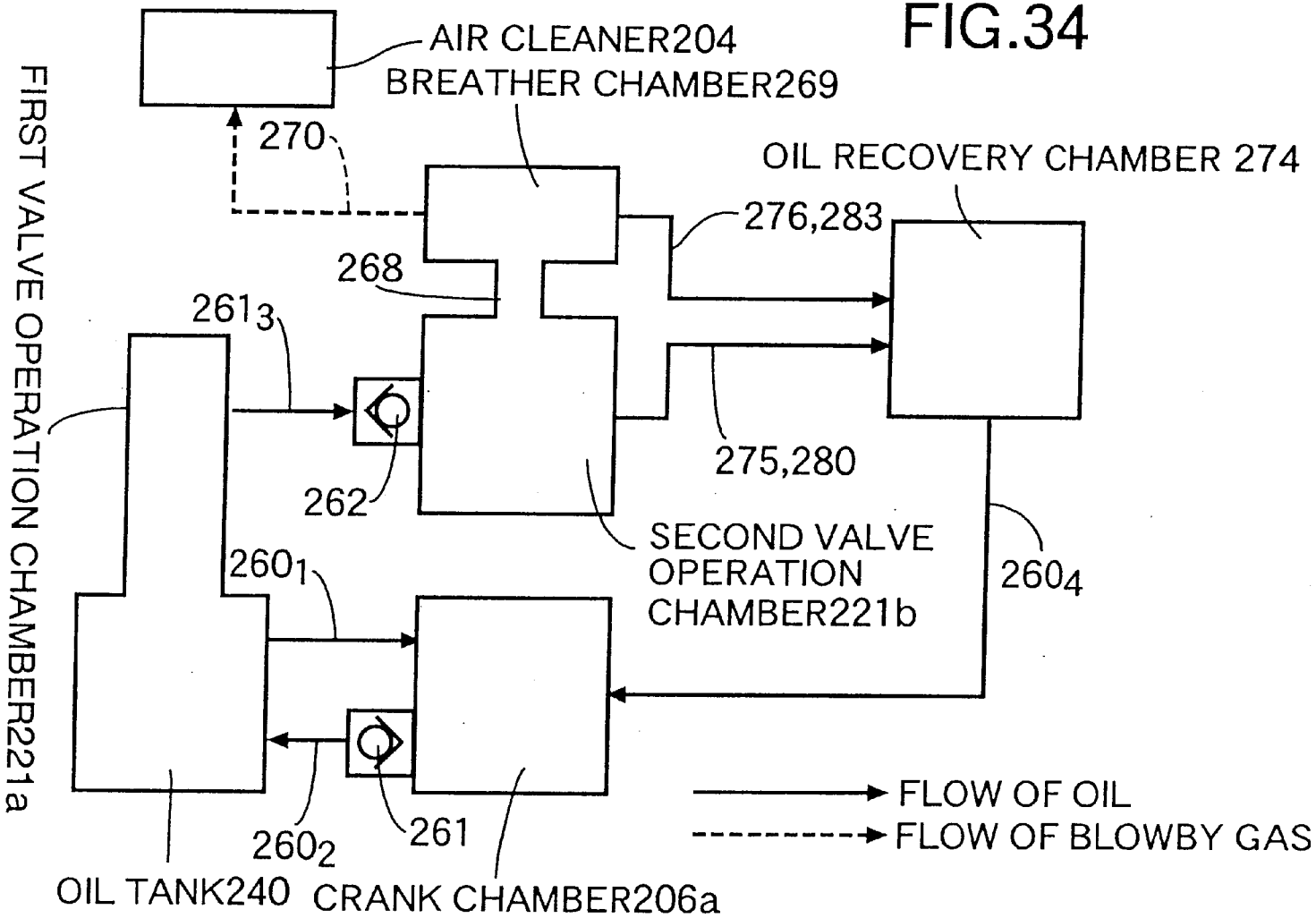

As shown in FIGS. 29, 32 and 33, a circular sealing groove 288*a* corresponding to the above-mentioned sealing bead 287 is formed in the lower end face of a head cover 236, and a linear sealing groove 288*b* linking two sides of the circular groove 288*a* to each other is formed in the inner face of the cover 236. A circular packing 289*a* is fitted in the circular sealing groove 288*a*, and a linear packing 289*b* formed integrally with the circular packing 289*a* is fitted in the linear sealing groove 288*b*. The head cover 236 is joined to the cylinder head 208 by means of a bolt 237 so that the sealing bead 287 and the partition 285 are pressed in to contact with the circular packing 289*a* and the linear packing 289*b* respectively.

The belt guide tube 286 and one half of the head cover 236 form a first valve operation chamber 221*a*, the cylinder head 208 and the other half of the head cover 236 form a second valve operation chamber 221*b*, and the two valve operation chambers 221*a* and 221*b* are divided by the above-mentioned partition 285.

Referring again to FIGS. 25 to 28, the engine main body 201 and the oil tank 240 are divided into an upper block Ba and a lower block Bb on a plane which includes the axis of the crankshaft 213 and is perpendicular to the axis of the cylinder bore 207*a*. That is, the upper block Ba integrally includes the upper half of the crankcase 206, the cylinder block 207, the cylinder head 208, the upper half of the oil tank 240 and the belt guide tube 286. The lower block Bb integrally includes the lower half of the crankcase 206 and the lower half of the oil tank 240. These upper and lower blocks Ba and Bb are cast individually, and joined to each other by means of a plurality of bolts 212 (see FIG. 27) after each part has been machined.

An intake valve 218*i* and an exhaust valve 218*e* for opening and closing the intake port 209 and the exhaust port 210 respectively are provided in the cylinder head 208 so as to be parallel to the axis of the cylinder bore 207*a*, and a spark plug 220 is screwed in so that the electrodes thereof are close to the central area of the combustion chamber 208*a*.

A valve operation mechanism 222 for opening and closing the above-mentioned intake valve 218*i* and exhaust valve 218*e* is explained below by reference to FIGS. 26 to 30.

The valve operation mechanism 222 includes a timing transmission 222*a* that runs from the inside of the oil tank 240 to the first valve operation chamber 221*a*, and a cam system 222*b* that runs from the first valve operation chamber 221*a* to the second valve operation chamber 221*b*.

The timing transmission 222*a* includes a drive pulley 223 fixed to the crankshaft 213 inside the oil tank 240, a driven pulley 224 rotatably supported in the upper part of the belt guide tube 286, and a timing belt 225 wrapped around these drive and driven pulleys 223 and 224. On the side of the partition 285, the end face of the driven pulley 224 is joined integrally to a cam 226 which forms a part of the cam system 222*b*. The cam 226 is thus placed together with the driven pulley 114 on one side of the cylinder head 208. The drive and driven pulleys 223 and 224 are toothed, and the drive pulley 223 drives the driven pulley 224 via the belt 225 at a reduction rate of ½.

A support wall 227 is formed integrally with the outside wall of the belt guide tube 286, the support wall 227 rising inside the circular sealing bead 287 and being in contact with or in the vicinity of the inner face of the head cover 236, and by means of a through hole 228*a* provided in the support wall 227 and a bottomed hole 228*b* provided in the partition 285, both ends of a support shaft 229 are rotatably supported, and the above-mentioned driven pulley 236 and the cam 226 are rotatably supported on the middle part of the support shaft 229. Before the head cover 236 is mounted, the support shaft 229 is inserted from the through hole 228*a* into a shaft hole 235 of the driven pulley 224 and the cam 226, and into the bottomed hole 226*b*. After the insertion, the head cover 236 is joined to the cylinder head 208 and the belt guide tube 286, so that the inner face of the head cover 236 sits opposite the outer end of the support shaft 229 so functioning as a stopper for the support shaft 229.

A pair of bearing bosses 230*i* and 230*e* projecting parallel to the support shaft 229 are formed integrally with the partition 285 on the side of second valve operation chamber 221*b*. The cam system 222*b* includes the above-mentioned cam 226; an intake rocker shaft 231*i* and an exhaust rocker shaft 231*e* rotatably supported in the above-mentioned bearing bosses 230*i* and 230*e* respectively; an intake cam follower 232*i* and an exhaust cam follower 232*e* fixed to one end of the rocker shafts 233*i* and 233*e* respectively inside the first valve operation chamber 221*a*, the forward end of each of the intake cam follower 232*i* and the exhaust cam follower 232*e* being in sliding contact with the lower face of the cam 226; an intake rocker arm 233*i* and an exhaust rocker arm 233*e* fixed to the other end of the intake and exhaust rocker shafts 233*i* and 233*e* respectively inside the second valve operation chamber 221*b*, the forward end of each of the intake rocker arm 233*i* and the exhaust rocker arm 233*e* being in contact with the upper end of each of the intake valve 218*i* and the exhaust valve 218*e*, and intake spring 234*i* and exhaust spring 234*e* mounted on the intake valve 218*i* and the exhaust valve 218*e* respectively and forcing them in the closing direction.

The support shaft 229 and the intake and exhaust rocker arms 231*i* and 231*e* are positioned above the circular sealing bead 287 on the upper ends of the cylinder head 208 and the belt guide tube 286.

When the crankshaft 213 rotates, the drive pulley 223 rotating together with the crankshaft 213 rotates the driven pulley 224 and the cam 226 via the belt 225, the cam 226 then rocks the intake and exhaust cam followers 232*i* and 232*e* with appropriate timing, the rocking movements are transmitted to the intake and exhaust rocker arms 233*i* and 233*e* via the corresponding rocker shafts 231*i* and 231*e*, and the intake and exhaust rocker arms 233*i* and 233*e* so rocked can open and close the intake and exhaust valves 218*i* and 218*e* with appropriate timing while co-operatively working with the intake and exhaust springs 234*i* and 234*e*.

In the timing transmission 222*a*, since the driven pulley 224 and the cam 226 are rotatably supported by the support shaft 229 and the support shaft 229 is also rotatably supported in both side walls of the first valve operation chamber 221*a*, the support shaft 229 rotates due to frictional drag during rotation of the driven pulley 224 and the cam 226, the difference in rotational rate between the support shaft 229 and the driven pulley 224 and the cam 226 decreases and abrasion of the rotating and sliding areas can be suppressed so enhancing the durability.

The cam 226 having a comparatively large diameter is placed on one side of the cylinder head 208 together with the driven pulley 224, and only the intake and exhaust rocker arms 233*i* and 233*e* and the intake and exhaust rocker shafts 231*i* and 231*e* having a comparatively small diameter are placed immediately above the cylinder head 208. The valve operation mechanism 222 therefore does not occupy a large volume above the cylinder head 208, and it is possible to reduce the total height of the engine E thus making the engine E more compact.

Furthermore, the support shaft 229 and the intake and exhaust rocker shafts 231*i* and 231*e* are positioned at a higher position than that of the line of circular sealing bead 287 at the upper end of the cylinder head 208 and the belt guide tube 286, it is therefore possible to assemble and disassemble the support shaft 229 and the intake and exhaust rocker shafts 231*i* and 231*e* above the sealing bead 287 without any obstruction therefrom in a state in which the head cover 236 is removed, and the easy of assembly and maintenance is extremely high.

The lubrication system of the above-mentioned engine E is explained below by reference to FIGS. 26 to 34.

Figure 27:
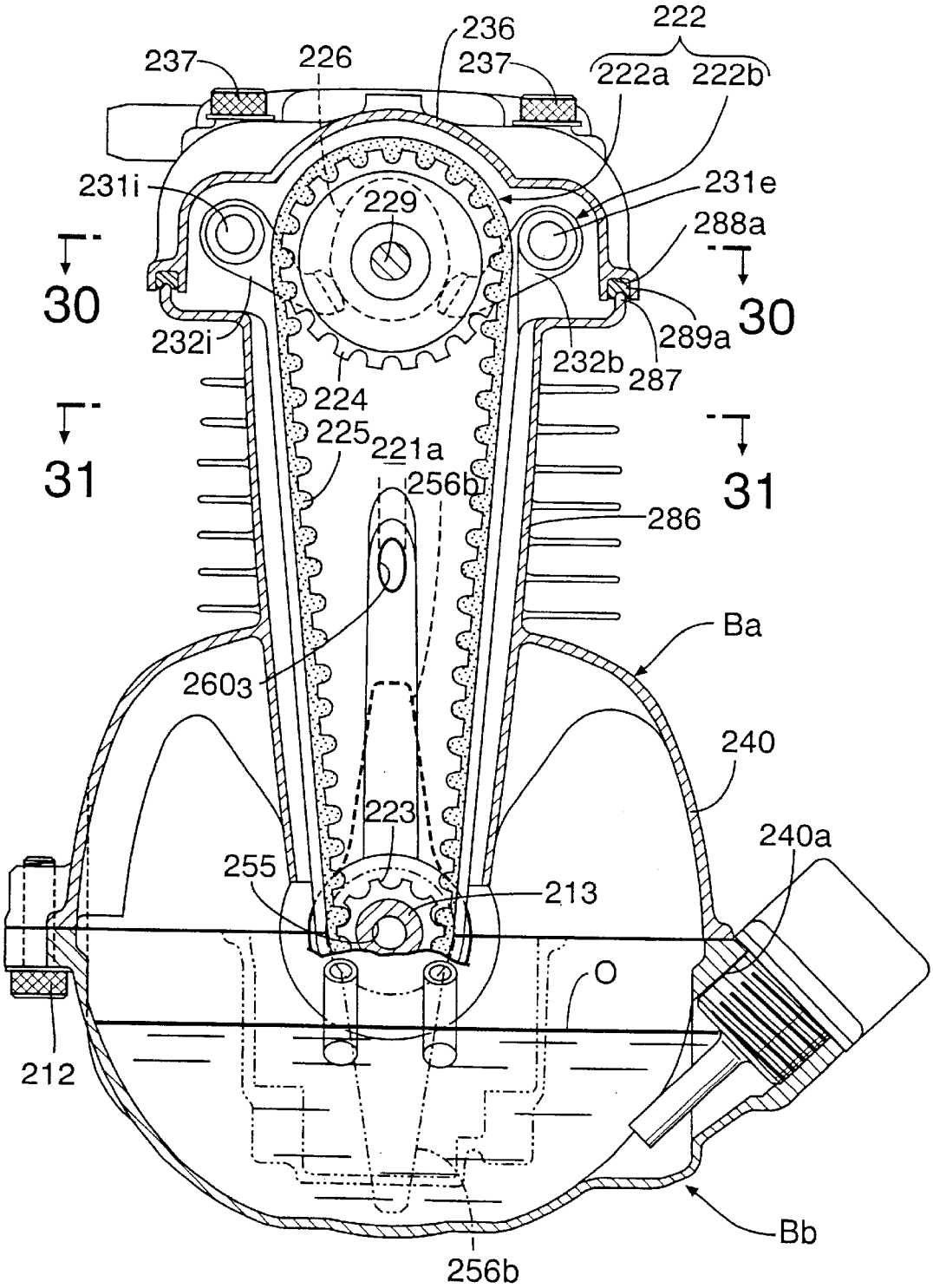
Figure 28:
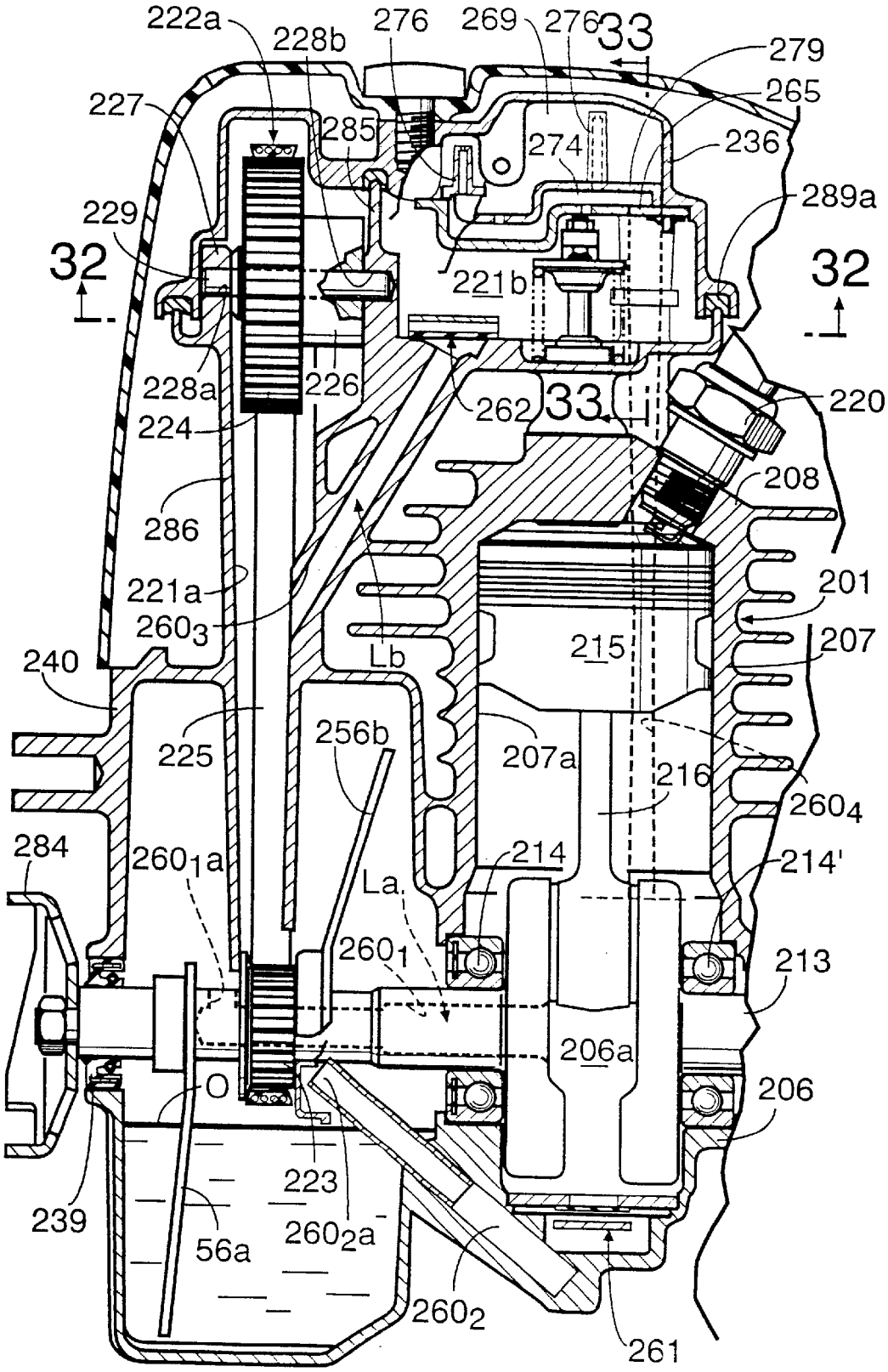

As shown in FIGS. 27 and 28, the lubrication system of the engine E includes a first lubrication part La for lubricating the area around the crank shaft 213, that is, the crank shaft 213, the bearings 214 and 214', the connecting rod 216, the piston 215, etc., and a second lubrication part Lb for lubricating the valve operation mechanism 222. These parts La and Lb share the above-mentioned oil tank 240. The oil tank 240 stores a predetermined amount of lubricating oil O poured in through an oil inlet 240*a*. A pair of oil slingers 256*a* and 256*b* arranged on either side of the drive pulley 223 in the axial direction is press-fitted onto the crankshaft 213. These oil slingers 256*a* and 256*b* extend in directions radially opposite to each other and the forward ends thereof are bent so as to move away from each other in the axial direction so that when the oil slingers 256*a* and 256*b* are rotated by the crankshaft 213, at least one of the oil slingers 256*a* and 256*b* stirs and scatters the oil O stored inside the oil tank 240 so generating an oil mist regardless of the operational position of the engine E.

The first lubrication system La includes a first oil passage $\mathbf{260}_1$ provided through the crank shaft 213 and providing communication between the inside of the oil tank 240 and the crank chamber 206*a*, and a second oil passage $\mathbf{260}_2$ providing communication between the base of the crank chamber 206*a* and the inside of the oil tank 240, and a first one-way valve 261 is provided at the opening of the second oil passage $\mathbf{260}_2$ in the crank chamber 206*a*. The first one-way valve 261 closes and opens as the pressure of the crank chamber 206*a* decreases and increases accompanying the ascent and descent respectively of the piston 215. The first and second oil passages $\mathbf{260}_1$ and $\mathbf{260}_2$ are formed so that their open ends $\mathbf{260}_1a$ and $\mathbf{260}_2a$ inside the oil tank 240 are as close to the central part of the oil tank 240 as possible, with an arrangement such that the open ends $\mathbf{260}_1a$ and $\mathbf{260}_2a$ are always above the liquid level of the stored oil O regardless of the operational position of the engine E.

The second lubrication system Lb includes a third oil passage $\mathbf{260}_3$ provided through the engine main body 201 so as to provide communication between the middle part of the first valve operation chamber 221*a* and the base of the second valve operation chamber 221*b*; an oil recovery chamber 274 formed in the head cover 236 so as to be communicated with the second valve operation chamber 221*b*; a fourth oil passage $\mathbf{260}_4$ provided in the engine main body 201 so as to provide communication between the oil recovery chamber 274 and the crank chamber 206*a*; the second oil passage $\mathbf{260}_2$; and a second one-way valve 262 provided at the opening of the third oil passage $\mathbf{260}_3$ in the second valve operation chamber 221*b*. The second one-way valve 262 closes and opens as the pressure of the crank chamber 206*a* decreases and increases accompanying the ascent and descent respectively of the piston 215.

As shown in FIGS. 28, 32 and 33, a partition plate 265 defining a breather chamber 269 in the upper part of the head cover 236 is fitted to the roof of the cover 236 by means of a plurality of support stays 266 and clips 267 fastened to the support stays 266, the support stays 266 provided so as to project from the roof. The breather chamber 269 is communicated with the second valve operation chamber 221*b* on one side via a large gap, that is, a communication pipe 268 (see FIG. 32) between the periphery of the partition plate 264 and the inner face of the head cover 236, and is communicated with the air cleaner 204 on the other side via a breather pipe 270. The mixture of oil and blowby gas is separated into gas and liquid in the breather chamber 269.

Welded to the partition plate 265 is a box-shaped partition 279 that forms the above-mentioned oil recovery chamber 274 in the space on the upper face of the partition plate 265.

A plurality of suction pipes 275 (four in the illustrated embodiment) are provided integrally with the partition plate 265 so as to project therefrom, each of the suction pipes 275 being separated from the others and communicated with the oil recovery chamber 274. The tip of each of the suction pipes 275 extends towards the vicinity of the base of the second valve operation chamber 221*b*, and an opening at each of their tips forms an orifice 275*a*.

A plurality of suction pipes 276 (three in the illustrated embodiment) are provided integrally with the upper wall of the partition plate 279 so as to project therefrom, each of the suction pipes 276 being separated from the others and communicated with the oil recovery chamber 274. The tip of each of these suction pipes 276 extends towards the vicinity of the roof of the breather chamber 269, and an opening at each of their tips forms an orifice 276*a*.

Furthermore, orifices 280 and 283 are provided in the partition plate 265 and the partition box 279 respectively, the orifices 280 and 283 communicating the oil recovery chamber 274 with the second valve operation chamber 221*b* and the breather chamber 269 respectively.

Moreover, one pipe 281 communicated with the oil recovery chamber 274 is provided integrally with the partition plate 265so as to project therefrom. The tip of the pipe 281 is joined to the upper end of the fourth oil passage $\mathbf{260}_4$ via a grommet 282, the upper end of the fourth oil passage $\mathbf{260}_4$ opening so as to project out of the base of the second valve operation chamber 221*b*. The oil recovery chamber 274 is thus connected to the fourth oil passage $\mathbf{260}_4$.

The action of the lubrication system of this engine E is explained below. Since the oil slingers 256*a* and 256*b* rotating together with the crankshaft 213 stir and scatter the oil O stored inside the oil tank 240 during operation of the engine E so generating an oil mist, the oil tank 240 and the first valve operation chamber 221*a* opening into the upper part of the oil tank 240 are filled with the oil mist. The timing transmission 222*a* housed inside the first valve operation chamber 221*a* is therefore lubricated directly with the oil mist.

The pressure pulsations in which the pressure repeatedly decreases and increases due to the ascent and descent of the piston 215 occur in the crank chamber 206*a*. Accompanying the pressure pulsations, the oil mist generated in the oil tank 240 is transferred back and forth between the oil tank 240 and the crank chamber 206*a*, and the oil mist introduced into the crank chamber 206*a* lubricates the area around the crankshaft 213, that is, the crankshaft 213, the bearings 214 and 214', the connecting rod 216, the piston 215, etc. Since the first one-way valve 261 closes when the pressure of the crank chamber 206*a* decreases and opens when the pressure increases and a proportion of the positive component of the pressure pulsations is thus discharged into the oil tank 240 via the second oil passage $\mathbf{260}_2$, when the oil mist liquefies in the crank chamber 206*a* and resides in the base of the chamber 206*a*, the oil is pushed back to the oil tank 240 via the second oil passage $\mathbf{260}_2$ together with the above-mentioned positive pressure.

The pressure pulsations inside the crank chamber 206*a* also influence the second one-way valve 262 via the oil tank 240, the first valve operation chamber 221*a* and the third oil passage $\mathbf{260}_3$, and the second one-way valve 262 also closes when the pressure of the crank chamber 206*a* decreases and opens when the pressure increases. When the second one-way valve 262 opens, the oil mist inside the oil tank 240 is sequentially transferred to the first valve operation chamber 221*a*, the third oil passage $\mathbf{260}_3$, and the second valve operation chamber 221*b*. In the meantime, the oil mist lubricates the timing transmission 222*a* in the first valve operation chamber 221*a*, and the cam system 222*b* in the second valve operation chamber 221*b*.

Since the positive pressure component of the pressure pulsations in the crank chamber 206*a* is discharged into the oil tank 240 via the first one-way valve 261, and the pressure of the crank chamber 206*a* is negative on average, also the pressure of the oil recovery chamber 274 communicated with the crank chamber 206*a* via the fourth oil passage $\mathbf{260}_4$ becomes negative. On the other hand, since the breather chamber 269 is communicated with the inside of the air clear 204 via the breather pipe 270, and the pressure of the breather chamber 269 is maintained generally at atmospheric pressure even during operation of the engine E, the pressure of the second valve operation chamber 221*b* communicated with the breather chamber 269 via communication pipe 268 is also generally at atmospheric pressure. As a result, the pressures of the second valve operation chamber 221*b* and the breather chamber 269 are transferred to the oil recovery chamber 274 via the suction pipes 275 and 276 and the orifices 280 and 283, and the oil mist inside the second valve operation chamber 221*b* and the breather chamber 269 is also transferred to the oil recovery chamber 274 accompanying the move in pressure. In particular, while the engine E is in an upright state, the oil liquefied in the second valve operation chamber 221*b* and resides in the base thereof is transferred to the oil recovery chamber 274 by means of the oil suction pipe 275 positioned closely to the base of the second valve operation chamber 221*b*. While the engine E is in an upside down state, the oil liquefied in the breather chamber 269 and residesd in the base thereof, that is, the roof of the head cover 236, is transferred to the oil recovery chamber 274 by means of the oil suction pipe 276 positioned closely to the roof of the head cover 236. The oil thus recovered in the oil recovery chamber 274 is transferred to the crank chamber 206*a* via the fourth oil passage $\mathbf{260}_4$ so lubricating the area around the crankshaft 213.

The timing transmission 222*a* and the cam system 222*b* which have comparatively low load are lubricated with the oil mist alone that is introduced into the first and second valve operation chambers 221*a* and 221*b* from the oil tank 240, the amount of lubricating oil is comparatively small and excessive lubrication can be avoided. The surroundings of the crankshaft 213 are lubricated with the oil mist that is introduced into the crank chamber 206*a* from the oil tank 240 and the oil mist, and the liquefied oil that are recovered in the oil recovery chamber 274 after lubrication of the cam system 222*b*; the amount of lubricating oil is comparatively large and it is possible to efficiently lubricate the area around the crankshaft 213 which suffers a comparatively high load. Since the surroundings of the crankshaft 213 and the valve operation mechanism 222 are lubricated according to their loading, the amount of circulating oil, that is, the amount of oil stored inside the oil tank 240 can be reduced in comparison with the conventional system, and the oil tank 240 and, therefore, the entire engine E can be made more compact and lighter.

Since the oil mist generated inside the oil tank 240 is circulated by utilising the pressure pulsations inside the crank chamber 206*a* and the one-way transfer functions of the first and second one-way valves 261 and 262, it is unnecessary to employ a special oil pump for circulating the oil mist, and the structure can be simplified.

The blowby gas generated in the crank chamber 206*a* is transferred to the oil tank 240 via the first oil passage $\mathbf{260}_1$ and to the breather chamber 269 together with the oil mist via the first valve operation chamber 221*a*, the third oil passage $\mathbf{260}_3$ and the second valve operation chamber 221*b*, they are separated into gas and liquid in the breather chamber 269, and the blowby gas separated from the oil is taken into the engine E via the breather pipe 270 and the air cleaner 204 in that order during the intake stroke of the engine E.

Figure 35:
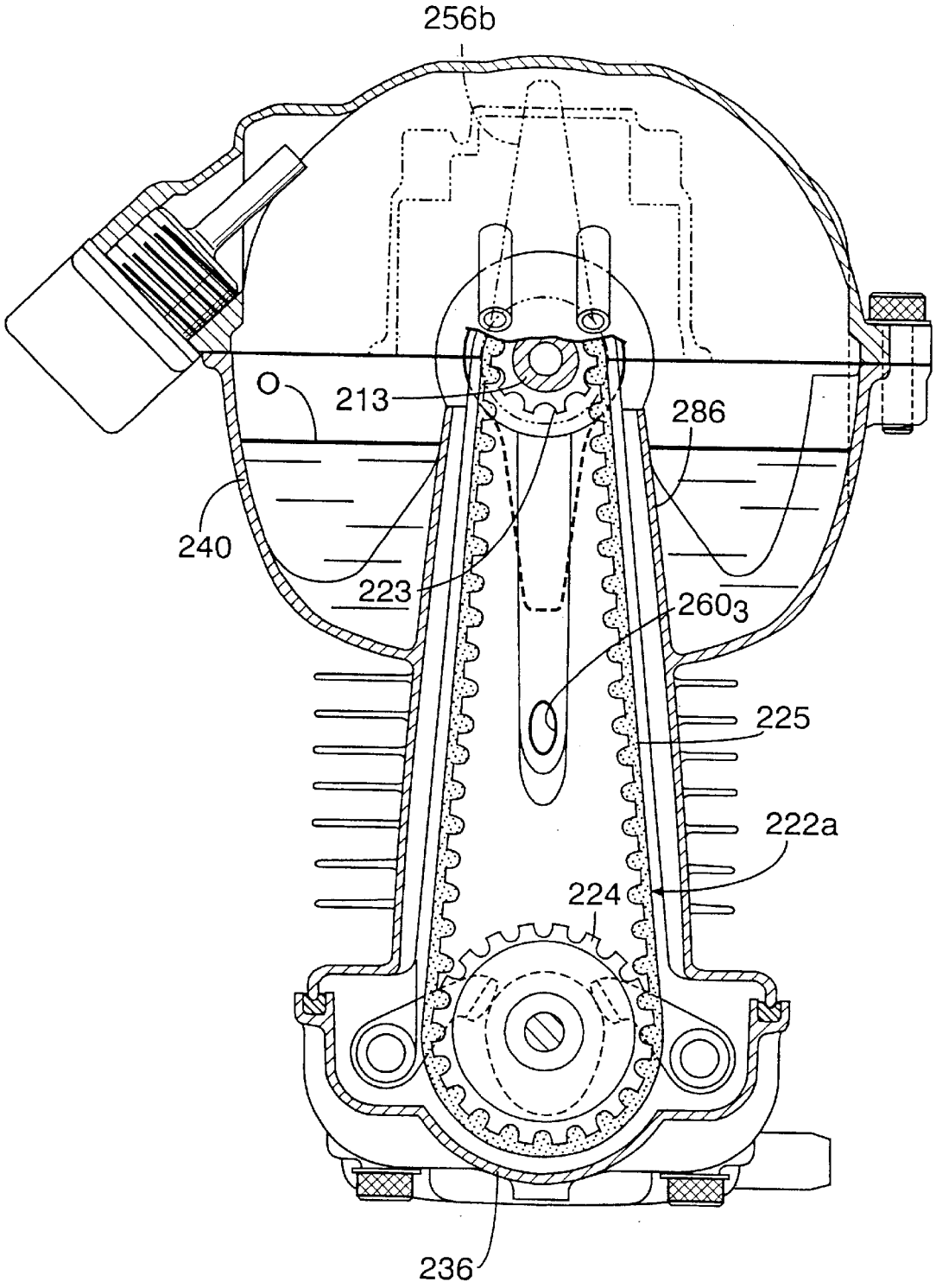
Figure 36:
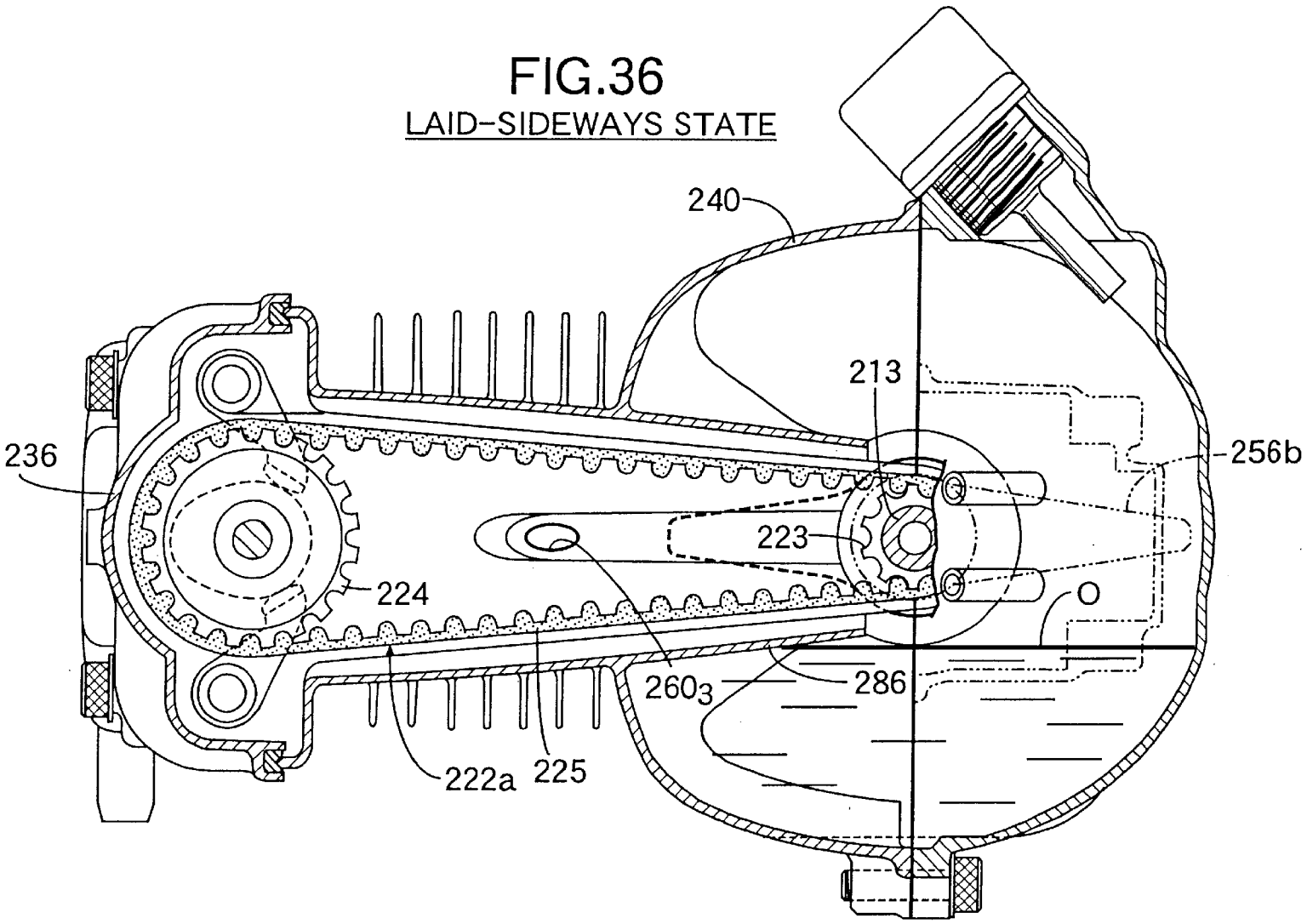

When the engine E is turned upside down as shown in FIG. 35 or laid on its side as shown in FIG. 36, the oil O stored in the oil tank 240 moves towards the roof or the side face of the oil tank 240. However, since the open end of the first valve operation chamber 221*a* toward the oil tank 240 is set so as to always be at a higher level than the liquid level of the stored oil O by means of the belt guide tube 286, the stored oil O is prevented from entering the first valve operation chamber 221*a*, and it is possible to prevent excess oil from being supplied to the timing transmission 222*a*, and maintain a predetermined amount of oil inside the oil tank 240 so allowing the oil slingers 256*a* and 256*b* to continuously generate an oil mist.

Since the oil tank 240 is placed on one exterior side of the engine main body 201, the total height of the engine E can be greatly reduced, and since a part of the timing transmission 222*a* is housed inside the oil tank 240, any increase in the width of the engine E can be minimised so making the engine E more compact and lighter.

In the above-mentioned third embodiment, the third oil passage $\mathbf{260}_3$ is connected to the middle part of the first valve operation chamber 221*a*, but the third oil passage $\mathbf{260}_3$ may be connected to the upper part of the first valve operation chamber 221*a*.

The present invention is not limited to the above-mentioned embodiments and can be modified in a variety of ways without departing from the spirit and scope of the invention. For example, each of the above-mentioned embodiments employs the belt type timing transmission, but a chain type timing transmission may be employed.

What is claimed is:

1. A handheld type four-cycle engine including an engine main body, the engine main body including a crankcase having a crank chamber, a cylinder bore having a cylinder block and a cylinder head having an intake port and an exhaust port;

a crankshaft supported in the crankcase and housed inside the crank chamber;

a piston fitted inside the cylinder bore and connected to the crankshaft;

an intake valve and an exhaust valve for opening and closing the intake port and exhaust port, the intake valve and the exhaust valve being mounted in the cylinder head;

a valve operation mechanism operable in association with the rotation of the crankshaft so as to open and close the intake valve and the exhaust valve; and a power output mechanism provided on one end of the crankshaft projecting out of the engine main body;

wherein the valve operation mechanism includes a camshaft rotatably supported in the cylinder head so as to open and close the intake valve and the exhaust valve; and a timing transmission placed outside the engine main body on the side oppose to the power output mechanism and operated for providing association between the crankshaft and the camshaft, and wherein an oil tank for storing lubricating oil for lubricating the inside of the engine main body is placed outside the timing transmission so as to adjoin and at least partly cover the timing transmission and is supported by the engine main body.

2. A handheld type four-cycle engine according to claim 1 wherein the timing transmission is made as a dry type and is separate from the crank chamber.

3. A handheld type four-cycle engine according to claim 1 or 2 wherein a flywheel is mounted on the crankshaft between the engine main body and the power output mechanism, the flywheel including cooling vanes for sending cooling air to the engine main body and having a diameter larger than that of the power output mechanism.

4. A handheld type four-cycle engine including an engine main body, the engine main body including a crankcase having a crank chamber, a cylinder block having a cylinder bore and a cylinder head having an intake port and an exhaust port;

a crankshaft supported in the crankcase and housed inside the crank chamber;

a piston fitted inside the cylinder bore and connected to the crankshaft;

an intake valve and an exhaust valve for opening and closing the intake port and exhaust port, the intake valve and the exhaust valve being mounted in the cylinder head;

a valve operation mechanism operable in association with the rotation of the crankshaft so as to open and close the intake valve and the exhaust valve; and a power output mechanism provided on one end of the crankshaft projecting out of the engine main body;

wherein the valve operation mechanism includes a camshaft rotatably supported in the cylinder head so as to open and close the intake valve and the exhaust valve; and a timing transmission placed outside the engine main body on the side opposite to the power output mechanism and operated for providing association between the crankshaft and the camshaft, and wherein a flywheel is mounted on the crankshaft between the engine main body and the power output mechanism, the flywheel including cooling vanes for sending cooling air to the engine main body and having a diameter larger than that of the power output mechanism.

* * * * *